US007903064B2

(12) United States Patent
Shiomi

(10) Patent No.: US 7,903,064 B2
(45) Date of Patent: Mar. 8, 2011

(54) METHOD AND APPARATUS FOR CORRECTING THE OUTPUT SIGNAL FOR A BLANKING PERIOD

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 1026 days.

(21) Appl. No.: 11/663,079

(22) PCT Filed: Sep. 14, 2005

(86) PCT No.: PCT/JP2005/016977
§ 371 (c)(1),
(2), (4) Date: Mar. 16, 2007

(87) PCT Pub. No.: WO2006/030842
PCT Pub. Date: Mar. 23, 2006

(65) Prior Publication Data

US 2007/0252795 A1 Nov. 1, 2007

(30) Foreign Application Priority Data

Sep. 17, 2004 (JP) ..... 2004-272366

(51) Int. Cl.
*G09G 3/36* (2006.01)

(52) U.S. Cl. ..... 345/87; 345/204

(58) Field of Classification Search ..... 345/87
See application file for complete search history.

(56) References Cited

U.S. PATENT DOCUMENTS 6,337,676 B1 * 1/2002 Anai et al. ..... 345/89
7,180,474 B2 * 2/2007 Kudo et al. ..... 345/1.1
7,227,519 B1 * 6/2007 Kawase et al. ..... 345/77
7,446,760 B2 * 11/2008 Takada et al. ..... 345/204
7,471,276 B2 * 12/2008 Tomohara ..... 345/98
2001/0043183 A1 * 11/2001 Ishikawa et al. ..... 345/89
2002/0180718 A1 * 12/2002 La ..... 345/204
(Continued)

FOREIGN PATENT DOCUMENTS

JP 2002-149132 5/2002
(Continued)

OTHER PUBLICATIONS

International Search Report (PCT/ISA/210), (Dec. 6, 2005).

*Primary Examiner* — Amare Mengistu
*Assistant Examiner* — Gene W Lee
(74) *Attorney, Agent, or Firm* — Harness, Dickey & Pierce, P.L.C.

(57) ABSTRACT

Based on each of video data repeatedly supplied to a pixel, a signal processing section generates video data (Dd) for an image display period to be supplied to the pixel and video data (Db) for a blanking period to be supplied to the pixel, and outputs the video data (Dd) and (Db) in a predetermined order. Further, when a gradation transition from a gradation indicated by previous video data (D(i,j,k−2)) supplied to the pixel to a gradation indicated by current video data (D(i,j,k)) supplied to the pixel indicates an increase in luminance, a generating circuit for a blanking period of the signal processing section outputs video data indicative of a gradation which is increased compared with a gradation indicated by gradation data for a blanking period in a steady state, the video data thus outputted being regarded as video data (Db(i,j,k−1)) for a blanking period. This allows for providing a display device capable of displaying moving images with high quality.

27 Claims, 23 Drawing Sheets

U.S. PATENT DOCUMENTS

| | | | | |
|---|---|---|---|---|
| 2003/0058229 | A1 | 3/2003 | Kawabe et al. | |
| 2003/0076289 | A1* | 4/2003 | Tokonami et al. | 345/100 |
| 2003/0179221 | A1* | 9/2003 | Nitta et al. | 345/690 |
| 2003/0184572 | A1* | 10/2003 | Kaise | 345/698 |
| 2004/0001054 | A1* | 1/2004 | Nitta et al. | 345/204 |
| 2004/0027323 | A1* | 2/2004 | Tanaka et al. | 345/98 |
| 2004/0140968 | A1* | 7/2004 | Kasai et al. | 345/204 |
| 2004/0164976 | A1* | 8/2004 | Nakamura et al. | 345/204 |
| 2004/0169626 | A1* | 9/2004 | Nakamura et al. | 345/87 |
| 2004/0169631 | A1* | 9/2004 | Tanaka et al. | 345/96 |
| 2004/0252097 | A1* | 12/2004 | Kaneki et al. | 345/102 |
| 2005/0134614 | A1* | 6/2005 | Tomohara | 345/690 |
| 2005/0184933 | A1* | 8/2005 | Tomohara | 345/76 |

FOREIGN PATENT DOCUMENTS

| | | |
|---|---|---|
| JP | 2003-207762 | 7/2003 |
| JP | 2004-253827 | 9/2004 |
| JP | 2004-318131 | 11/2004 |
| JP | 2005-128488 | 5/2005 |

* cited by examiner

FIG. 6

| | POSITION IN HORIZONTAL DIRECTION | | | | | | | | | | | | | | | | | | | | | | | | | |
|---|---|---|---|---|---|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| field 0 | BLACK | BLACK | BLACK | BLACK | | | | | | | | | | | | | | | | | | | | | | |
| field 1 | BLACK | BLACK | BLACK | BLACK | | | | | | | | | | | | | | | | | | | | | | |
| field 2 | BLACK | BLACK | BLACK | BLACK | | | | | | | | | | | | | | | | | | | | | | |
| field 3 | BLACK | BLACK | BLACK | BLACK | | | | | | | | | | | | | | | | | | | | | | |
| field 4 | BLACK | BLACK | BLACK | BLACK | BLACK | BLACK | BLACK | BLACK | | | | | | | | | | | | | | | | | | |
| field 5 | BLACK | BLACK | BLACK | BLACK | BLACK | BLACK | BLACK | BLACK | | | | | | | | | | | | | | | | | | |
| field 6 | BLACK | BLACK | BLACK | BLACK | BLACK | BLACK | BLACK | BLACK | | | | | | | | | | | | | | | | | | |
| field 7 | BLACK | BLACK | BLACK | BLACK | BLACK | BLACK | BLACK | BLACK | | | | | | | | | | | | | | | | | | |
| field 8 | BLACK | BLACK | BLACK | BLACK | BLACK | BLACK | BLACK | BLACK | BLACK | BLACK | BLACK | BLACK | | | | | | | | | | | | | | |
| field 9 | BLACK | BLACK | BLACK | BLACK | BLACK | BLACK | BLACK | BLACK | BLACK | BLACK | BLACK | BLACK | | | | | | | | | | | | | | |
| field10 | BLACK | BLACK | BLACK | BLACK | BLACK | BLACK | BLACK | BLACK | BLACK | BLACK | BLACK | BLACK | | | | | | | | | | | | | | |
| field11 | BLACK | BLACK | BLACK | BLACK | BLACK | BLACK | BLACK | BLACK | BLACK | BLACK | BLACK | BLACK | | | | | | | | | | | | | | |
| field12 | BLACK | BLACK | BLACK | BLACK | BLACK | BLACK | BLACK | BLACK | BLACK | BLACK | BLACK | BLACK | BLACK | BLACK | BLACK | BLACK | | | | | | | | | | |
| field13 | BLACK | BLACK | BLACK | BLACK | BLACK | BLACK | BLACK | BLACK | BLACK | BLACK | BLACK | BLACK | BLACK | BLACK | BLACK | BLACK | | | | | | | | | | |
| field14 | BLACK | BLACK | BLACK | BLACK | BLACK | BLACK | BLACK | BLACK | BLACK | BLACK | BLACK | BLACK | BLACK | BLACK | BLACK | BLACK | | | | | | | | | | |
| field15 | BLACK | BLACK | BLACK | BLACK | BLACK | BLACK | BLACK | BLACK | BLACK | BLACK | BLACK | BLACK | BLACK | BLACK | BLACK | BLACK | | | | | | | | | | |
| field16 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | | | | | |
| field17 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | | | | | |
| field18 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | | | | | |
| field19 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | | | | | |
| field20 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | |
| field21 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | |
| field22 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | |
| field23 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | |

FIG. 7

| | POSITION IN HORIZONTAL DIRECTION | | | | | | | | | | | | | | | | | | | | | | | | | |
|---|---|---|---|---|---|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| field 0 | BLACK | BLACK | BLACK | BLACK | BLACK | BLACK | BLACK | BLACK | BLACK | BLACK | BLACK | BLACK | | | | | | | | | | | | | | |
| field 1 | BLACK | BLACK | BLACK | BLACK | BLACK | BLACK | BLACK | BLACK | BLACK | BLACK | BLACK | | | | | | | | | | | | | | | |
| field 2 | BLACK | BLACK | BLACK | BLACK | BLACK | BLACK | BLACK | BLACK | BLACK | BLACK | | | | | | | | | | | | | | | | |
| field 3 | BLACK | BLACK | BLACK | BLACK | BLACK | BLACK | BLACK | BLACK | BLACK | | | | | | | | | | | | | | | | | |
| field 4 | BLACK | BLACK | BLACK | BLACK | BLACK | BLACK | BLACK | BLACK | BLACK | BLACK | BLACK | BLACK | | | | | | | | | | | | | | |
| field 5 | BLACK | BLACK | BLACK | BLACK | BLACK | BLACK | BLACK | BLACK | BLACK | BLACK | BLACK | | | | | | | | | | | | | | | |
| field 6 | BLACK | BLACK | BLACK | BLACK | BLACK | BLACK | BLACK | BLACK | BLACK | BLACK | | | | | | | | | | | | | | | | |
| field 7 | BLACK | BLACK | BLACK | BLACK | BLACK | BLACK | BLACK | BLACK | BLACK | | | | | | | | | | | | | | | | | |
| field 8 | BLACK | BLACK | BLACK | BLACK | BLACK | BLACK | BLACK | BLACK | BLACK | BLACK | BLACK | BLACK | | | | | | | | | | | | | | |
| field 9 | BLACK | BLACK | BLACK | BLACK | BLACK | BLACK | BLACK | BLACK | BLACK | BLACK | BLACK | | | | | | | | | | | | | | | |
| field10 | BLACK | BLACK | BLACK | BLACK | BLACK | BLACK | BLACK | BLACK | BLACK | BLACK | | | | | | | | | | | | | | | | |
| field11 | BLACK | BLACK | BLACK | BLACK | BLACK | BLACK | BLACK | BLACK | BLACK | | | | | | | | | | | | | | | | | |
| field12 | BLACK | BLACK | BLACK | BLACK | BLACK | BLACK | BLACK | BLACK | BLACK | BLACK | BLACK | BLACK | | | | | | | | | | | | | | |
| field13 | BLACK | BLACK | BLACK | BLACK | BLACK | BLACK | BLACK | BLACK | BLACK | BLACK | BLACK | | | | | | | | | | | | | | | |
| field14 | BLACK | BLACK | BLACK | BLACK | BLACK | BLACK | BLACK | BLACK | BLACK | BLACK | | | | | | | | | | | | | | | | |
| field15 | BLACK | BLACK | BLACK | BLACK | BLACK | BLACK | BLACK | BLACK | BLACK | | | | | | | | | | | | | | | | | |
| field16 | BLACK | BLACK | BLACK | BLACK | BLACK | BLACK | BLACK | BLACK | BLACK | BLACK | BLACK | BLACK | | | | | | | | | | | | | | |
| field17 | BLACK | BLACK | BLACK | BLACK | BLACK | BLACK | BLACK | BLACK | BLACK | BLACK | BLACK | | | | | | | | | | | | | | | |
| field18 | BLACK | BLACK | BLACK | BLACK | BLACK | BLACK | BLACK | BLACK | BLACK | BLACK | | | | | | | | | | | | | | | | |
| field19 | BLACK | BLACK | BLACK | BLACK | BLACK | BLACK | BLACK | BLACK | BLACK | | | | | | | | | | | | | | | | | |
| field20 | BLACK | BLACK | BLACK | BLACK | BLACK | BLACK | BLACK | BLACK | BLACK | BLACK | BLACK | BLACK | | | | | | | | | | | | | | |
| field21 | BLACK | BLACK | BLACK | BLACK | BLACK | BLACK | BLACK | BLACK | BLACK | BLACK | BLACK | | | | | | | | | | | | | | | |
| field22 | BLACK | BLACK | BLACK | BLACK | BLACK | BLACK | BLACK | BLACK | BLACK | BLACK | | | | | | | | | | | | | | | | |
| field23 | BLACK | BLACK | BLACK | BLACK | BLACK | BLACK | BLACK | BLACK | BLACK | | | | | | | | | | | | | | | | | |
| AVERAGE | BLACK | BLACK | BLACK | BLACK | BLACK | BLACK | BLACK | BLACK | BLACK | La | Lb | Lc | Lx | Lx | Lx | Lx | Lx | Lx | Lx | Lx | Lx | Lx | Lx | Lx | Lx | Lx |

FIG. 8

| | POSITION IN HORIZONTAL DIRECTION | | | | | | | | | | | | | | | | | | | | | | | | | |
|---|---|---|---|---|---|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| field 0 | BLACK | BLACK | BLACK | BLACK | | | | | | | | | | | | | | | | | | | | | | |
| field 1 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 2 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 3 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 4 | BLACK | BLACK | BLACK | BLACK | BLACK | BLACK | BLACK | BLACK | | | | | | | | | | | | | | | | | | |
| field 5 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 6 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 7 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 8 | BLACK | BLACK | BLACK | BLACK | BLACK | BLACK | BLACK | BLACK | BLACK | BLACK | BLACK | BLACK | | | | | | | | | | | | | | |
| field 9 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field10 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field11 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field12 | BLACK | BLACK | BLACK | BLACK | BLACK | BLACK | BLACK | BLACK | BLACK | BLACK | BLACK | BLACK | BLACK | BLACK | BLACK | BLACK | | | | | | | | | | |
| field13 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field14 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field15 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field16 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | | | | | |
| field17 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field18 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field19 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field20 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | | |
| field21 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field22 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field23 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |

FIG. 9

| | POSITION IN HORIZONTAL DIRECTION | | | | | | | | | | | | | | | | | | | | | | | | | |
|---|---|---|---|---|---|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| field 0 | BLACK | BLACK | BLACK | BLACK | BLACK | BLACK | BLACK | BLACK | BLACK | BLACK | BLACK | BLACK | | | | | | | | | | | | | | |
| field 1 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 2 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 3 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 4 | BLACK | BLACK | BLACK | BLACK | BLACK | BLACK | BLACK | BLACK | BLACK | BLACK | BLACK | BLACK | | | | | | | | | | | | | | |
| field 5 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 6 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 7 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field 8 | BLACK | BLACK | BLACK | BLACK | BLACK | BLACK | BLACK | BLACK | BLACK | BLACK | BLACK | BLACK | | | | | | | | | | | | | | |
| field 9 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field10 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field11 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field12 | BLACK | BLACK | BLACK | BLACK | BLACK | BLACK | BLACK | BLACK | BLACK | BLACK | BLACK | BLACK | | | | | | | | | | | | | | |
| field13 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field14 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field15 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field16 | BLACK | BLACK | BLACK | BLACK | BLACK | BLACK | BLACK | BLACK | BLACK | BLACK | BLACK | BLACK | | | | | | | | | | | | | | |
| field17 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field18 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field19 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field20 | BLACK | BLACK | BLACK | BLACK | BLACK | BLACK | BLACK | BLACK | BLACK | BLACK | BLACK | BLACK | | | | | | | | | | | | | | |
| field21 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field22 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| field23 | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK | BLACK |
| AVERAGE | BLACK | BLACK | BLACK | BLACK | BLACK | BLACK | BLACK | BLACK | BLACK | BLACK | BLACK | BLACK | Lx | Lx | Lx | Lx | Lx | Lx | Lx | Lx | Lx | Lx | Lx | Lx | Lx | Lx |

FIG. 12

| | | CURRENT VIDEO DATA D (i, j, k) | | | | | | | | |
|---|---|---|---|---|---|---|---|---|---|---|
| | | 0 | 32 | 64 | 96 | 128 | 160 | 192 | 224 | 255 |
| PREVIOUS VIDEO DATA D (i, j, k-2) | 0 | 0 | α 1 | α 2 | α 3 | α 4 | α 5 | α 6 | α 7 | α 8 |
| | 32 | 0 | 0 | α 9 | α 10 | α 11 | α 12 | α 13 | α 14 | α 15 |
| | 64 | 0 | 0 | 0 | α 16 | α 17 | α 18 | α 19 | α 20 | α 21 |
| | 96 | 0 | 0 | 0 | 0 | α 22 | α 23 | α 24 | α 25 | α 26 |
| | 128 | 0 | 0 | 0 | 0 | 0 | α 27 | α 28 | α 29 | α 30 |
| | 160 | 0 | 0 | 0 | 0 | 0 | 0 | α 31 | α 32 | α 33 |
| | 192 | 0 | 0 | 0 | 0 | 0 | 0 | 0 | α 34 | α 35 |
| | 224 | 0 | 0 | 0 | 0 | 0 | 0 | 0 | 0 | α 36 |
| | 255 | 0 | 0 | 0 | 0 | 0 | 0 | 0 | 0 | 0 |

FIG. 13

| | | CURRENT VIDEO DATA D (i, j, k) | | | | | | | | |
|---|---|---|---|---|---|---|---|---|---|---|
| | | 0 | 32 | 64 | 96 | 128 | 160 | 192 | 224 | 255 |
| PREVIOUS VIDEO DATA D (i, j, k-2) | 0 | 32 | α 1 | α 2 | α 3 | α 4 | α 5 | α 6 | α 7 | α 8 |
| | 32 | 32 | 32 | α 9 | α 10 | α 11 | α 12 | α 13 | α 14 | α 15 |
| | 64 | 32 | 32 | 32 | α 16 | α 17 | α 18 | α 19 | α 20 | α 21 |
| | 96 | 32 | 32 | 32 | 32 | α 22 | α 23 | α 24 | α 25 | α 26 |
| | 128 | 32 | 32 | 32 | 32 | 32 | α 27 | α 28 | α 29 | α 30 |
| | 160 | 32 | 32 | 32 | 32 | 32 | 32 | α 31 | α 32 | α 33 |
| | 192 | 32 | 32 | 32 | 32 | 32 | 32 | 32 | α 34 | α 35 |
| | 224 | 32 | 32 | 32 | 32 | 32 | 32 | 32 | 32 | α 36 |
| | 255 | 32 | 32 | 32 | 32 | 32 | 32 | 32 | 32 | 32 |

32b

| | | CURRENT VIDEO DATA D (i, j, k) | | | | | | | | |
|---|---|---|---|---|---|---|---|---|---|---|
| | | 0 | 32 | 64 | 96 | 128 | 160 | 192 | 224 | 255 |
| PREVIOUS VIDEO DATA D (i, j, k-2) | 0 | 0 | α 1 | α 2 | α 3 | α 4 | α 5 | α 6 | α 7 | α 8 |
| | 32 | 0 | 16 | α 9 | α 10 | α 11 | α 12 | α 13 | α 14 | α 15 |
| | 64 | 0 | 0 | 32 | α 16 | α 17 | α 18 | α 19 | α 20 | α 21 |
| | 96 | 0 | 0 | 0 | 48 | α 22 | α 23 | α 24 | α 25 | α 26 |
| | 128 | 0 | 0 | 0 | 0 | 64 | α 27 | α 28 | α 29 | α 30 |
| | 160 | 0 | 0 | 0 | 0 | 0 | 80 | α 31 | α 32 | α 33 |
| | 192 | 0 | 0 | 0 | 0 | 0 | 0 | 96 | α 34 | α 35 |
| | 224 | 0 | 0 | 0 | 0 | 0 | 0 | 0 | 112 | α 36 |
| | 255 | 0 | 0 | 0 | 0 | 0 | 0 | 0 | 0 | 128 |

METHOD AND APPARATUS FOR CORRECTING THE OUTPUT SIGNAL FOR A BLANKING PERIOD

TECHNICAL FIELD

The present invention relates to: a driving method for a display device; a driving device; a program for the driving device, a storage medium, and a display device, each of which allows for displaying moving images with high quality.

BACKGROUND ART

Recently, liquid crystal display devices have been widely used for personal computers, word processors, amusement apparatuses, and television sets. However, unlike impulse-type display devices such as CRTs in which display light is instant, liquid crystal display devices are hold-type displays in which display light changes serially with time, and therefore have lower response time. Consequently, the liquid crystal display devices have a problem such that image deterioration such as motion blurring occurs particularly in displaying moving images. For that reason, methods for improving response characteristics in display have been discussed so as to display moving images with higher quality.

As a kind of the methods, there is provided a method in which a hold-type display device such as a liquid crystal display device is caused to have false impulse display characteristics, that is, display light is caused to be instant or intermittent as with a CRT.

In order that a liquid crystal display device has impulse response characteristics, known citation 1 (Japanese Unexamined Patent Publication No. 66918/2003 (Tokukai 2003-66918; published on Mar. 5, 2003) (corresponding to US20030058229A1) discloses a display device which operates in such a manner that: blanking data is inserted between sets of video data each corresponding to one frame period, and video data and blanking data are displayed alternately in one frame period. This allows for preventing deterioration in image quality due to motion blurring while preventing the display device from having a larger or more complex structure.

To be specific, as illustrated in FIG. 22, the display device of the known citation 1 includes: a plural-scanning data generating circuit 102 for inserting blanking data between sets of video data each corresponding to one frame period, the video data being supplied from a video signal source 101; a plural-scanning timing generating circuit 103 for generating timing for driving a gate line; and a display element array 106.

As illustrated in FIG. 23, in a scanning signal generated by the display device, a frame period 301 is equally divided into an image scanning period 302 and a blanking scanning period 303. That is, A gate line is selected twice in one frame period. In the image scanning period 302, signals are written in two lines simultaneously and two lines are subjected to interlaced scanning. That is, G1 and G2 are selected and video signals are written in G1 and G2 simultaneously, and then G3 and G4 are selected and next video signals are written in G3 and G4 simultaneously. Thereafter, in the same way, blanking data is written in two lines simultaneously and two lines are subjected to interlaced scanning.

At that time, as illustrated in FIG. 24, in a pixel of the display array, a video signal is written in an image writing period 402 of a frame, period 401 and blanking data nearer to a common level than a gradation voltage of an image is written in a blanking writing period 403. That is, a video signal indicated by a source waveform 406 is written in a selection period indicated by a gate driving waveform 405 in the image writing period 402, and transmittance increases as indicated by an optical response waveform 409. A canceling signal indicated by the source waveform 406 is written in a selection period indicated by the gate driving waveform 405 in the blanking writing period 403, and transmittance decreases as indicated by the optical response waveform 409.

The driving method allows for a display as illustrated in FIG. 25(*a*). That is, an original image 801 from the video signal source 101 is compressed by the plural-scanning data generating circuit 102 into one half in a longitudinal direction, and an ineffective image is added to the other half. As illustrated in FIG. 25(*b*), if the image is written with timing generated by the plural-scanning timing generating circuit 103, which timing allows for signals to be simultaneously written in two lines and for two lines to be subjected to interlaced scanning as described above, then video data and blanking data are displayed in one frame, so that image response and black response are repeated. This allows the display device to have impulse-type display characteristics, allowing for preventing deterioration in image quality due to motion blurring.

Further, known citation 1 discloses a method in which an original image is compressed into a quarter and a frame period is divided into four equal parts. In this case, a high-speed-liquid-crystal-response image (image obtained by emphasizing the original image) is generated by use of a high speed response filter so as to have higher response, and is written in a quarter of the frame period, and an image is written in a next quarter of the frame period, and blanking data is written in a remaining half of the frame period. This allows for further higher response.

Further, known citation 1 discloses that: when the same kind of scanning as the above is performed for scanning for one line, a writing time for one line is shortened so as to be approximately a half.

Further, known citation 2 (Japanese Unexamined Patent Publication No. 149132/2002 (Tokukai 2002-149132; published on May 24, 2002) discloses a method in which a canceling signal is written before each sub-frame period and a video signal is corrected so that a larger difference is provided between a canceling signal level and the corrected video signal. This allows for increasing a response speed of a liquid crystal, resulting in higher image quality in displaying moving images.

However, although the display device disclosed in known citation 1 allows for rapid rising from a black level of an optical response waveform by using a high-speed-liquid-crystal-response image, the display device has a problem that if blanking data is not completely written, then an exact image is not displayed.

To be specific, in a case where blanking data is not completely written, a voltage application indicated by a broken line waveform in an upper part of FIG. 26 causes an optical response indicated by a broken line waveform in a lower part of FIG. 26. Note that, in FIG. 26, a polarity is inverted when a transition from a voltage corresponding to a video signal to V0H corresponding to a canceling signal is performed (in FIG. 26, out of voltages corresponding to transmittance Tx, a voltage in a + driving is referred to as VxH and a voltage in a − driving is referred to as VxL).

To be specific, the display device of known citation 1 in which blanking data is displayed is premised on that: transmittance of a liquid crystal becomes Ta in accordance with a voltage VaL corresponding to a previous video signal in a video signal scanning period 32*a* and then the transmittance becomes T0 (steady state) in a canceling signal scanning period 33*a*, as indicated by a full line. Therefore, if a voltage VxH corresponding to a current video signal is supplied in the video signal scanning period 32*b*, then a voltage Vx'H is applied so that transmittance of a liquid crystal changes from T0 to Tx corresponding to a video signal Vx. However, in reality, the liquid crystal has a slow response. Consequently, as indicated by a broken line, a waveform indicative of the transmittance of the liquid crystal does not reach T0 in the cancel signal scanning period (the waveform reaches T0' higher than T0), and in the video signal scanning period 32*b*, the transmittance of the liquid crystal reaches Tx" higher than Tx which is target transmittance.

Further, at that time, even if a voltage V0 of the canceling signal is constant (V0H or V0L is applied according to inversion of polarity), transmittance T0' of the liquid crystal at a time when a next signal begins to be written varies depending on a video signal Va of a previous frame period. Consequently, a voltage Vx' for giving transmittance Tx in accordance with a previous video signal Vx also varies. Therefore, with a conventional method for applying a certain voltage in accordance with the video signal Vx, it is impossible to exactly display a gradation indicated by a supplied video signal. Consequently, it is impossible to display moving images with high quality.

Further, the liquid crystal display device disclosed in known citation 2 sets a video signal on the premise that writing a canceling signal would homogenize initial states of a liquid crystal in a frame period. The liquid crystal display device is not premised on that: because of a slow response of a liquid crystal, applying a voltage corresponding to a canceling signal would not allow for homogeneous transmittance which is desired. As described above, if a liquid crystal in an initial state is not in a uniformed state, then an applied voltage deviates from a voltage to cause target transmittance, so that an image true to an original video signal is not displayed.

DISCLOSURE OF INVENTION

The present invention was made in view of the foregoing problems. An object of the present invention is to provide an image display device capable of displaying moving images with high quality.

In order to solve the foregoing problems, a method of the present invention for driving a display device includes the steps of: (i) the step of displaying an image by supplying an output signal for an image display period to a pixel of the display device so as to control luminance of the pixel, the output signal corresponding to a video signal indicative of an image to be displayed by the display device, the step (i) being performed repeatedly; and (ii) the step, performed between the steps (i), of controlling blanking by supplying an output signal for a blanking period to the pixel so that luminance of the pixel does not exceed luminance of the pixel in at least predetermined one of the steps (i) between which the step (ii) is performed or so that luminance of the pixel becomes predetermined luminance for dark display, in the step (ii), when a change from first luminance to second luminance is a predetermined one where the first and second luminances are luminances indicated by output signals for image display periods in the steps (i) before and after the step (ii), the output signal for a blanking period being corrected so that the output signal for a blanking period has luminance which is corrected in a same direction as a direction of the change from the first luminance to the second luminance, the direction being a direction in which the luminance increases or decreases compared with an output signal for a blanking period obtained in a case where the first luminance is identical with the second luminance.

Here, assume a case where a response speed of a pixel is not so fast that the pixel reaches luminance indicated by an output signal for a blanking period at the end of the step (ii) regardless of luminance of the pixel at the start of the step (ii). In that case, even if an output signal having identical luminance is supplied as gradation data for a blanking period, the pixel reaches different luminance at the end of the step (ii) in accordance with luminance at the start of the step (ii).

Assume a case where a response speed of a pixel is not so fast that the pixel reaches luminance indicated by an output signal for an image display period at the end of the step (i) regardless of luminance of the pixel at the start of the step (i). In that case, too, even if an output signal having identical luminance is supplied as output signal for an image display period, the pixel reaches different luminance at the end of the step (i) in accordance with luminance at the start of the step (i).

Here, assume that, as with conventional cases, an output signal for a blanking period is set to a fixed value and an output signal for an image display period is set so that average luminance of a pixel obtained by alternately outputting output signals for a blanking period and an image display period is luminance in accordance with an image to be displayed by a display device. At that time, when the luminance in accordance with the image is constant, it is possible to set average luminance of the pixel to be in accordance with the image, even if luminance of the pixel at the end of the step (ii) is higher than luminance indicated by the output signal for a blanking period and luminance of the pixel at the end of the step (i) is lower than luminance indicated by the output signal for an image display period.

However, at that time, due to a low response speed of the pixel, luminance of the pixel at the end of the step (ii) is different if the luminance in accordance with the image is different. Luminance of the pixel at the end of the step (ii) is lower in a case where the luminance in accordance with the image is comparatively low than in a case where the luminance is comparatively high. Consequently, when an image signal changes and an output signal in one step (i) (first step (i)) and an output signal in the other step (i) (second step (i)) have different values, there is a possibility that a response of a pixel delays in the second step (i) and therefore luminance of the pixel at the end of the second step (i) does not reach desired luminance (luminance indicated by an image signal).

At that time, although the step (ii) is provided so as to prevent deterioration in image quality such as motion blurring, response delay of the pixel in the second step (i) causes deterioration in image quality such as motion blurring. Consequently, as a whole, it is difficult to prevent deterioration in image quality when moving images are displayed.

In contrast, in the step (ii) of the present invention, when a change from first luminance to second luminance is a predetermined one, the output signal for a blanking period is corrected so as to indicate luminance changed in a same direction as a direction of the change from the first luminance to the second luminance, the direction being a direction in which the luminance increases or decreases compared with an output signal for a blanking period obtained in a case where the first luminance is identical with the second luminance (in a case of a steady state). Consequently, it is possible to cause luminance of the pixel at the end of the second step (i) to be closer to the desired luminance.

For example, when the predetermined change is a change for increasing luminance, an output signal indicative of luminance higher than that indicated by an output signal for a blanking period in a steady state is supplied. Consequently, it is possible to cause luminance of the pixel at the end of the step (ii) to be higher than that at the end of the step (ii) in a steady state. Accordingly, it is possible to cause the luminance at the end of the step (ii) to be closer to luminance at the end of the step (ii) in a case where an output signal in each step (i) is always indicative of the second luminance. Therefore, it is possible to cause luminance at the end of the second step (i) to be closer to the desired luminance.

For another example, when the predetermined change is a change for decreasing luminance, an output signal indicative of luminance lower than that indicated by an output signal for a blanking period in a steady state is supplied. Consequently, it is possible to cause luminance of the pixel at the end of the step (ii) to be lower than that at the end of the step (ii) in a steady state. Accordingly, it is possible to cause the luminance at the end of the step (ii) to be closer to luminance at the end of the step (ii) in a case where an output signal in each step (i) is always indicative of the second luminance. Therefore, it is possible to cause luminance at the end of the second step (i) to be closer to the desired luminance.

As described above, it is possible to cause luminance of the pixel at the end of the second step (i) to be closer to desired luminance. Therefore, unlike an arrangement in which an output signal for a blanking period is fixed, it is possible to prevent deterioration in image quality due to response delay in the second step (i). Consequently, it is possible to provide a display device capable of displaying moving images with high quality.

It is effective to correct the output signal for a blanking period so that the output signal is indicative of luminance which is corrected in the same direction as a direction of the change. Further, assume that: based on the first and second luminances, luminance of the pixel at the end of the step (ii) is corrected so as to substantially identical with luminance at the end of the step (ii) obtained in a case where an output signal in each step (i) is always indicative of the second luminance, so that the luminance of the pixel at the end of the second step (i) is corrected so as to be substantially identical with a desired value. At that time, it is possible to further prevent deterioration in image quality due to response delay in the second step (i). This allows for providing a display device capable of displaying moving images with higher quality.

In order to solve the foregoing problems, a method of the present invention for driving a display device includes the steps of: (i) the step of displaying an image by supplying an output signal for an image display period to a pixel of the display device so as to control luminance of the pixel, the output signal corresponding to a video signal indicative of an image to be displayed by the display device, the step (i) being performed repeatedly; and (ii) the step, performed between the steps (i), of controlling blanking by supplying an output signal for a blanking period to the pixel so that luminance of the pixel does not exceed luminance of the pixel in at least predetermined one of the steps (i) between which the step (ii) is performed or so that luminance of the pixel becomes predetermined luminance for dark display, in the step (ii), when a change from first luminance to second luminance is a predetermined one where the first and second luminances are luminances indicated by output signals for image display periods in the steps (i) before and after the step (ii), the output signal for a blanking period being corrected in accordance with the first luminance and the second luminance.

With the arrangement, when the change from the first luminance to the second luminance is a predetermined one, the output signal for a blanking period is corrected based on the first luminance and the second luminance. Therefore, as with the method for driving a display device, it is possible to cause luminance of the pixel at the end of the step (ii) to be closer to luminance at the end of the step (ii) in a case where an output signal in each step (i) is always indicative of the second luminance. Consequently, unlike the arrangement in which an output signal for a blanking period is fixed, it is possible to prevent deterioration in image quality due to response delay in the second step (i), allowing for providing a display device capable of displaying moving images with high quality.

In order to solve the foregoing problems, a method of the present invention for driving a display device includes the steps of: (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the generating being repeatedly performed based on gradation data supplied as gradation data to the pixel; and (ii) outputting in a predetermined order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, outputting gradation data indicative of a gradation which is corrected in a same direction as a direction of the gradation transition, the direction being a direction in which the gradation increases or decreases compared with gradation data for a blanking period obtained in a case where a gradation indicated by the previous gradation data and a gradation indicated by the current gradation data are identical with each other, the gradation data thus outputted being regarded as gradation data for a blanking period to be supplied between gradation data for an image display period supplied in the step (i) based on the previous gradation data and gradation data for an image display period supplied in the step (i) based on the current gradation data.

The above explanation refers to an output signal to be supplied to a pixel. The explanation is retold as follows with reference to gradation data. Assume a case where a response speed of a pixel is not so fast that the pixel reaches luminance indicated by gradation data for a blanking period at the end of the blanking period regardless of luminance of the pixel at the start of the blanking period. In that case, even if gradation data for a blanking period which has an identical value is supplied, the pixel reaches different luminance at the end of the blanking period in accordance with luminance at the start of the blanking period.

Assume a case where a response speed of a pixel is not so fast that the pixel reaches luminance indicated by gradation data for an image display period at the end of the image display period regardless of luminance of the pixel at the start of the image display period. In that case, too, even if gradation data for an image display period which has an identical value is supplied, the pixel reaches different luminance at the end of the image display period in accordance with luminance at the start of the image display period.

Here, assume that, as with conventional cases, gradation data for a blanking period is set to a constant value and gradation data for an image display period is set so that average luminance of a pixel obtained by alternately outputting gradation data for a blanking period and an image display period is luminance indicated by supplied gradation data. At that time, when the supplied gradation data is constant, it is possible to set average luminance of the pixel to be luminance indicated by the supplied gradation data, even if luminance of the pixel at the end of the blanking period is higher than luminance indicated by the gradation data for the blanking period and luminance of the pixel at the end of the image display period is lower than luminance indicated by the gradation data for an image display period.

However, at that time, due to a low response speed of the pixel, luminance of the pixel at the end of the blanking period is different if supplied gradation data is different. Luminance of the pixel at the end of the blanking period is lower in a case where the luminance indicated by the supplied gradation data is comparatively low than in a case where the luminance indicated by the supplied gradation data is comparatively high. Consequently, when supplied gradation data changes from a previous value to a current value and gradation data for one image display period (first image display period) and gradation data for a next image display period (second image display period) have different values, there is a possibility that a response of a pixel delays in the second image display period and therefore luminance of the pixel at the end of the second image display period does not reach desired luminance (luminance indicated by currently supplied gradation data).

At that time, although the blanking period is provided so as to prevent deterioration in image quality such as motion blurring, response delay of the pixel in the second image display period causes deterioration in image quality such as motion blurring. Consequently, as a whole, it is difficult to prevent deterioration in image quality when moving images are displayed.

In contrast, the present invention includes the step of, when a gradation transition from a gradation indicated by previous gradation data supplied to a pixel of the display device to a gradation indicated by current gradation data supplied to the pixel is a predetermined one, outputting gradation data indicative of a gradation corrected in a same direction as a direction of the gradation transition, the direction being a direction in which the gradation increases or decreases compared with gradation data obtained in a case where a gradation indicated by the previous gradation data and a gradation indicated by the current gradation data are identical with each other (in a case of a steady state). Consequently, it is possible to cause luminance of the pixel at the end of the second image display period to be closer to the desired luminance.

For example, when the predetermined gradation transition is a transition for increasing gradation, gradation data indicative of a gradation higher than that indicated by gradation data for a blanking period in a steady state is supplied. Consequently, it is possible to cause luminance of the pixel at the end of the blanking period to be higher than that at the end of the blanking period in a steady state. Accordingly, it is possible to cause the luminance at the end of the blanking period to be closer to luminance at the end of the blanking period in a case where supplied gradation data is always the current gradation data and is constant. Therefore, it is possible to cause luminance at the end of the second image display period to be closer to the desired luminance.

For another example, when the predetermined gradation transition is a transition for decreasing gradation, gradation data indicative of a gradation lower than that indicated by a gradation data for a blanking period in a steady state is supplied. Consequently, it is possible to cause luminance of the pixel at the end of the blanking period to be lower than that at the end of the blanking period in a steady state. Accordingly, it is possible to cause the luminance at the end of the blanking period to be closer to luminance at the end of the blanking period in a case where supplied gradation data is always indicative of the current gradation data and is constant. Therefore, it is possible to cause luminance at the end of the second image display period to be closer to the desired luminance.

As described above, it is possible to cause luminance of the pixel at the end of the second image display period to be closer to desired luminance. Therefore, unlike an arrangement in which gradation data for a blanking period is fixed, it is possible to prevent deterioration in image quality due to response delay in the second image display period. Consequently, it is possible to provide a display device capable of displaying moving images with high quality.

It is effective to output gradation data indicative of a gradation which is corrected in the same direction as a direction of the gradation transition. Further, assume that: based on the previous gradation data and the current gradation data, luminance of the pixel at the end of the blanking period is corrected so as to substantially identical with luminance at the end of the blanking period obtained in a case where supplied gradation data is always the current gradation data and is constant, so that luminance of the pixel at the end of the second image display period is corrected so as to be substantially identical with a desired value. At that time, it is possible to further prevent deterioration in image quality due to response delay in the second image display period. This allows for providing a display device capable of displaying moving images with higher quality.

In order to solve the foregoing problems, a method of the present invention for driving a display device includes the steps of: (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the generating being repeatedly performed based on gradation data supplied as gradation data to the pixel; and (ii) outputting in a predetermined order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, correcting gradation data for a blanking period supplied between gradation data for an image display period supplied in the step (i) based on the previous gradation data and gradation data for an image display period supplied in the step (i) based on the current gradation data, the correcting being performed based on the previous gradation data and the current gradation data.

With the arrangement, when a gradation transition from a gradation indicated by previously supplied gradation data to a gradation indicated by currently supplied gradation data is a predetermined gradation transition, the gradation data for a blanking period is corrected based on the previously supplied gradation data and the currently supplied gradation data. Therefore, as with the method for driving a display device, it is possible to cause luminance of a pixel at the end of a blanking period to be closer to luminance at the end of a blanking period in a case where each supplied gradation data is always the current gradation data. Consequently, unlike an arrangement in which gradation data for a blanking period is fixed, it is possible to prevent deterioration in image quality due to response delay in the second image display period, allowing for providing a display device capable of displaying moving images with high quality.

On the other hand, in order to solve the foregoing problems, a driving device of the present invention for a display device is a driving device, (i) controlling, during each of repeated image display periods, luminance of a pixel of the display device by supplying to the pixel an output signal for an image display period which output signal varies depending on a video signal indicative of an image to be displayed, till a next image display period, by the display device, and (ii) controlling, during each blanking period between the image display periods, luminance of the pixel by supplying to the pixel an output signal for a blanking period, so that luminance of the pixel does not exceed luminance in at least one of the image display periods between which the blanking period exists or so that the luminance becomes predetermined luminance for dark display, said device comprising blanking controlling means for, when a change from first luminance to second luminance is a predetermined one where the first and second luminances are luminances indicated by output signals for image display periods supplied during the image display periods before and after the blanking period, correcting the output signal for a blanking period so that the output signal for a blanking period has luminance which is corrected in a same direction as a direction of the change from the first luminance to the second luminance, the direction being a direction in which the luminance increases or decreases compared with an output signal for a blanking period obtained in a case where the first luminance is identical with the second luminance.

Further, in order to solve the foregoing problems, a driving device of the present invention for a display device is a driving device, (i) controlling, during each of repeated image display periods, luminance of a pixel of the display device by supplying to the pixel an output signal for an image display period which output signal varies depending on a video signal indicative of an image to be displayed, till a next image display period, by the display device, and (ii) controlling, during each blanking period between the repeated image display periods, luminance of the pixel by supplying to the pixel an output signal for a blanking period, so that luminance of the pixel does not exceed luminance in at least one of the image display periods between which the blanking period exists or so that the luminance becomes predetermined luminance for dark display, said device comprising blanking controlling means for, when a change from first luminance to second luminance is a predetermined one where the first and second luminances are luminances indicated by output signals for image display periods supplied during the image display periods between which the blanking period exists, correcting the output signal for a blanking period, based on the first luminance and the second luminance.

Further, in order to solve the foregoing problems, a driving device of the present invention for a display device is a driving device, (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the gradation data (a) and (b) being generated based on each of gradation data repeatedly supplied to the pixel, and (ii) outputting the gradation data (a) and (b) in a predetermined order, said device comprising blanking controlling means for, when a gradation transition from a gradation indicated by previous gradation data supplied to the pixel to a gradation indicated by current gradation data supplied to the pixel is a predetermined one, outputting gradation data indicative of a gradation which is corrected in a same direction as a direction of the gradation transition, the direction being a direction in which the gradation increases or decreases compared with gradation data for a blanking period obtained in a case where a gradation indicated by the previous gradation data and a gradation indicated by the current gradation data are identical with each other, the gradation data thus outputted being regarded as gradation data for a blanking period to be supplied between gradation data for an image display period generated based on the previous gradation data and gradation data for an image display period generated based on the current gradation data.

Further, in order to solve the foregoing problems, a driving device of the present invention for a display device is a driving device, (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the gradation data (a) and (b) being generated based on each of gradation data repeatedly supplied to the pixel, and (ii) outputting the gradation data (a) and (b) in a predetermined order, said device comprising blanking controlling means for, when a gradation transition from a gradation indicated by previous gradation data supplied to the pixel to a gradation indicated by current gradation data supplied to the pixel is a predetermined one, correcting gradation data for a blanking period supplied between gradation data for an image display period generated based on the previous gradation data and gradation data for an image display period generated based on the current gradation data, the gradation data for a blanking period being corrected based on the previous gradation data and the current gradation data.

Each of the driving devices includes blanking controlling means, and the blanking controlling means is capable of controlling an output signal for a blanking period or gradation data for a blanking period, as with any one of the methods for driving display devices. Therefore, as with the methods for driving display devices, it is possible to prevent deterioration in image quality due to response delay in the second image display period. Consequently, it is possible to provide a display device capable of displaying moving images with high quality.

For a fuller understanding of the nature and advantages of the invention, reference should be made to the ensuing detailed description taken in conjunction with the accompanying drawings.

BRIEF DESCRIPTION OF DRAWINGS

FIG. 6 is a drawing showing luminances of pixels on a horizontal line in frame periods, explaining a cause of motion blurring generated when impulse driving is not performed.

FIG. 7 is a drawing obtained by replacing the origination of a space coordinate in FIG. 6 with human eyes.

FIG. 8 is a drawing of the present embodiment, showing luminances of pixels on a horizontal line in frame periods.

FIG. 9 is a drawing obtained by replacing the origination of a space coordinate in FIG. 8 with human eyes.

FIG. 12 is a table explaining a look-up table provided in the signal processing section.

FIG. 13 is a table of another embodiment of the present invention, explaining a look-up table provided in a signal processing section.

FIG. 25(*b*) is a conceptual drawing, showing how video data is generated in a conventional liquid crystal display device.

BEST MODE FOR CARRYING OUT THE INVENTION

Embodiment 1

The following explains an embodiment of the present invention with reference to FIGS. 1 to 12. An image display device (display device) 1 of the present embodiment can display moving images with high quality by controlling an output signal to be supplied to a pixel during a blanking period. The display device 1 can be preferably used, for example, as an image display device for a TV receiver or a monitor for displaying a video signal such as a video signal from a computer. Examples of TV broadcasting received by the TV receiver include a terrestrial wave television broadcasting, an artificial satellite broadcasting such as BS (Broadcasting Satellite) digital broadcasting and CS (Communication Satellite) digital broadcasting, and cable television broadcasting.

Figure 2:
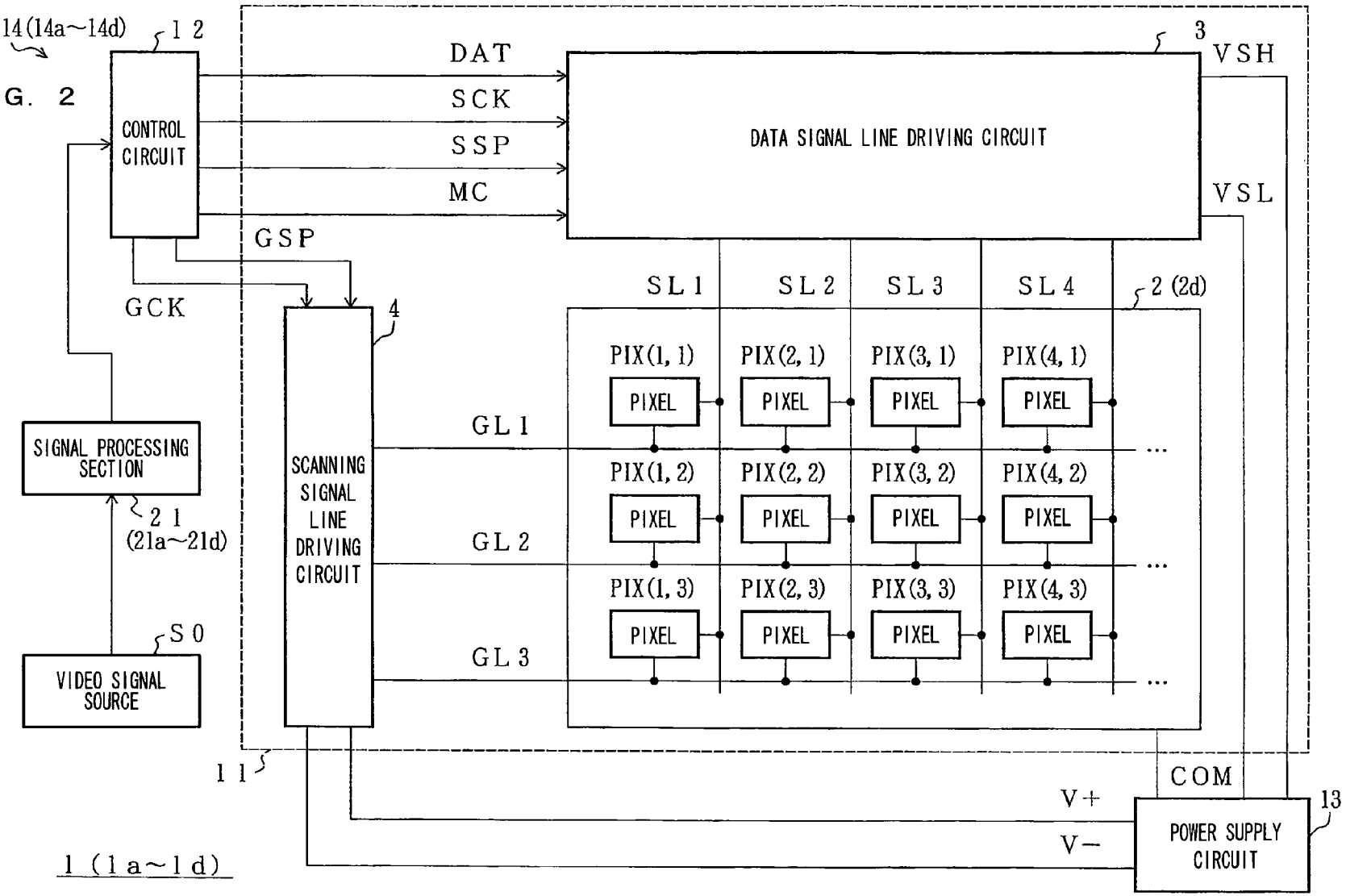
FIG. 2 is a block diagram showing a main structure of the image display device.

As illustrated in FIG. 2, a panel 11 of the image display device 1 includes: a pixel array 2 including pixels PIX(1,1) to PIX(n,m) provided in a matrix manner; a data signal line driving circuit 3 for driving data signal lines SL1 to SLn in the pixel array 2; and a scanning signal line driving circuit 4 for driving scanning signal lines GL1 to GLm in the pixel array 2. Further, the image display device 1 includes: a control circuit 12 for supplying a control signal to the data signal line driving circuit 3 and the scanning signal line driving circuit 4; and a signal processing section (driving device) 21 for performing, with respect to a supplied video signal, a signal process including a signal process for inserting a blanking period and for supplying the video signal thus processed to the control circuit 12. These circuits operate using a power supplied from a power supply circuit 13.

Before explaining a detailed structure of the signal processing section 21, the following explains a schematic structure and an operation of a whole of the image display device (display device) 1. For convenience of explanation, members of the image display device 1 are referred to with position-indicating numerals or alphabets attached thereto only when it is necessary to indicate positions (e.g. i-th data signal line is a data signal line SLi), and the members are referred to without the numerals or the alphabets when it is unnecessary to indicate positions or when the members are referred to generically.

The pixel array 2 includes: a plurality of (n in this case) data signal lines SL1 to SLn; and a plurality of (m in this case) scanning signal lines GL1 to GLm which cross the data signal lines SL1 to SLn. Assuming that any integer from 1 to n is regarded as i and any integer from 1 to m is regarded as j, a pixel PIX (i,j) is provided with respect to each cross point of the data signal line SLi and the scanning signal line GLj. In the present embodiment, each pixel (i,j) is provided in an area surrounded by adjacent two data signal lines SL(i−1) and SLi and by adjacent two scanning signal lines GL(j−1) and GLj.

Figure 3:
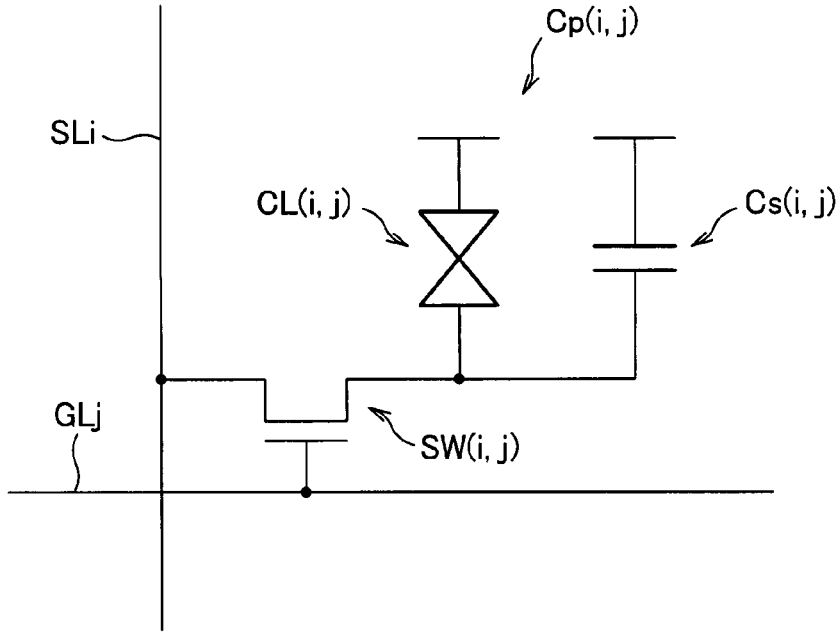
FIG. 3 is a circuit diagram showing an arrangement example of a pixel provided in the image display device.

The following exemplifies a case where the image display device 1 is a liquid crystal display device. As illustrated in FIG. 3 for example, the pixel PIX (i,j) includes: a field effect transistor SW (i,j) serving as a switching element, whose gate and source are connected with the scanning signal line GLj and the data signal line SLi, respectively; and a pixel capacitor Cp (i,j) whose one electrode is connected with a drain of the field effect transistor SW (i,j). Further, the other electrode of the pixel capacitor Cp (i,j) is connected with a common electrode line which is common among all pixel PIXs. The pixel capacitor Cp (i,j) includes a liquid crystal capacitor CL (i,j) and a subsidiary capacitor Cs (i,j) which is added if necessary.

In the pixel PIX (i,j), if the scanning signal line GLj is selected, then the field effect transistor SW(i,j) is conducted and a voltage applied on the data signal line SLi is applied on the pixel capacitor Cp(i,j). On the other hand, while the scanning signal line GLj stops to be selected and the field effect transistor SW(i,j) is not conducted, the pixel capacitor Cp(i,j)

maintains a voltage at a time when the field effect transistor SW(i,j) gets non-conducted. Transmittance or reflectance of a liquid crystal changes in accordance with a voltage applied on a liquid crystal capacitor CL(i,j). Therefore, if the scanning signal line GLj is selected and a voltage corresponding to video data D (i,j,k) to be supplied to the pixel PIX(i,j) is applied, as an output signal O(i,j,k) to be supplied to the pixel PIX(i,j), on the data signal line SLi, then it is possible to change a display of the pixel PIX(i,j) in accordance with the video data D(i,j,k).

The image display device 1 of the present embodiment uses, as a liquid crystal cell for the pixel array 2, a liquid crystal cell in vertical alignment mode, that is, a liquid crystal cell in which liquid crystal molecules are aligned substantially perpendicular to a substrate at a time when no voltage is applied and the liquid crystal molecules get inclined from a state of perpendicular alignment as a voltage is applied on the liquid crystal capacitor CL(i,j) of the pixel PIX (i,j). The liquid crystal cell is used in normally black mode (mode in which black display is maintained while no voltage is applied).

With the arrangement, the scanning signal line driving circuit 4 illustrated in FIG. 2 outputs, to scanning signal lines GL1 to GLm, a signal indicative of a select period. An example of the signal is a voltage signal. Further, the scanning signal line driving circuit 4 switches the scanning signal line GLj which outputs a signal indicative of the select period, in accordance with a timing signal supplied from the control circuit 12. Examples of the timing signal include a clock signal GCK and a start pulse signal GSP. Consequently, the scamming signal lines GL1 to GLm are serially selected at a predetermined timing.

Further, the data signal line driving circuit 3 extracts, as video signals DAT, video data D supplied by time division to the pixels PIX, the extraction being performed by sampling the video data D at predetermined timings. Moreover, the data signal line driving circuit 3 outputs, through the data signal lines SL1 through SLn, output signals 0 corresponding to respective video data D to the pixels PIX(1,j) through (n,j) corresponding to the scanning signal line GLj selected by the scanning signal line driving circuit 4.

Note that, the data signal line driving circuit 3 determines timings of the sampling and output timings of the output signals in accordance with timing signals supplied from the control circuit 12, such as a clock signal SCK and a start pulse signal SSP.

While the scanning signal line GLj corresponding to the pixels PIX(1,j) through PIX(n,j) is selected, the pixels PIX(1, j) through PIX(n,j) adjust their transmittance reflectance so as to determine their luminance, in accordance with output signals supplied to the data signal lines SL1 through SLn corresponding to the PIX(1,j) through PIX(n,j).

Here, the scanning signal line driving circuit 4 sequentially selects the scanning signal lines GL1 through GLm. It is therefore possible to adjust brightness of all of the pixels, PIX(1,1) through PIX(n,m) in the pixel array 2 to brightness indicated by their corresponding video data D, and it is also possible to update an image to be displayed on the pixel array 2. Consequently, the image display device 1 can serially change images to be displayed on the pixel array 2, in accordance with video signals DAT. For convenience of explanation, members provided between the video signal source S0 and the pixel array 2 so as to drive the pixel array 2 in accordance with a video signal from the video signal source S0 (members such as the data signal line driving circuit 3, the scanning signal line driving circuit 4, the control circuit 12, and the signal processing section 21 which will be detailed later) are hereinafter referred to as a driving section 14.

Further, the driving section 14 of the image display device 1 of the present embodiment repeatedly supplies, to the pixel PIX(i,j), an output signal O corresponding to video data D for displaying an image on the pixel array 2, meanwhile the driving section 14 outputs, to the pixel PIX(i,j), an output signal O for a blanking period. Here, if the output signal O for a blanking period is set so that luminance of the pixel PIX(i,j) during the blanking period is not higher than luminance of the pixel PIX(i,j) at a time when the image is displayed or so that the luminance of the pixel PIX(i,j) during the blanking period is luminance predetermined for dark display, then it is possible to cause light emission of the image display device 1 to be closer to impulse light emission of a CRT (Cathode-Ray Tube), resulting in higher image quality in displaying moving images on the pixel array 2. In the present embodiment, the output signal O for the blanking period is set to a value for displaying black.

In order to discriminate the output signal O corresponding to video data D for displaying an image on the pixel array 2 from the output signal O for a blanking period, the former output signal O is hereinafter referred to as an output signal Od for an image display period and the latter output signal O is hereinafter referred to as an output signal Ob. Further, a period from a time when an output signal Od(i,j,k) for an image display period is supplied to a pixel PIX(i,j) to a time when an output signal Ob(i,j,k+1) for a blanking period is supplied as an output signal O(i,j,k+1) to be next supplied to the pixel PIX(i,j) is referred to as an image display period Td. A period from a time when the output signal Ob(i,j,k+1) for a blanking period is supplied to the pixel PIX (i,j) to a time when an output signal Od (i,j,k+2) for an image display period is supplied as an output signal O(i,j,k+2) to be next supplied to the pixel PIX(i,j) is referred to as a blanking period Tb.

Figure 4:
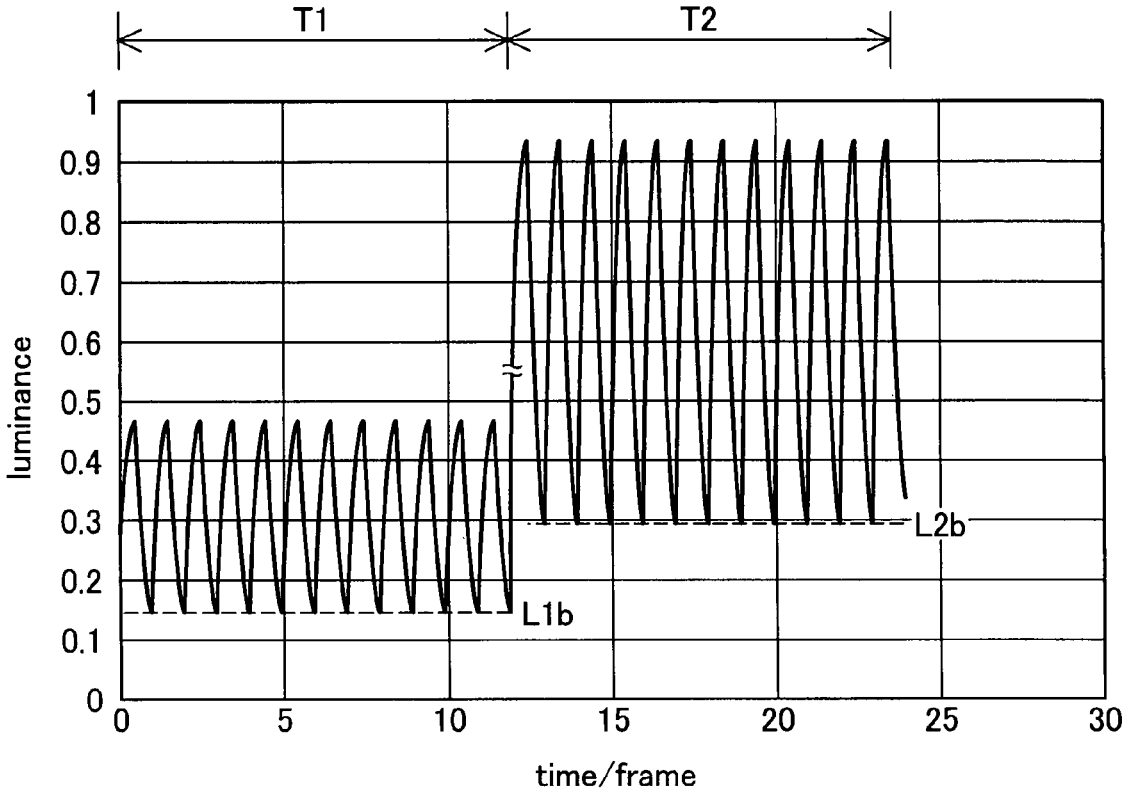
FIG. 4 is a graph showing a temporal change in luminance of the pixel.

Here, in a case where the pixel PIX (i,j) has a slow response speed, even if an output signal Ob(i,j, . . . ) indicative of black is supplied as an output signal Ob(i,j, . . . ) for a blanking period, as illustrated in FIG. 4, luminance of the pixel PIX(i,j) at the end of a blanking period Tb does not reach luminance indicative of black (luminance=0) but reach higher luminance (L1*b* in a period T1 and L2*b* in a period T2 in FIG. 4). The period T1 is a period during which video data D(i,j, . . . ) to be supplied to the pixel PIX(i,j) indicates certain luminance. The period T2 is a period during which video data D(i,j, . . . ) to be supplied to the pixel PIX(i,j) indicates luminance higher than the certain luminance.

However, in a case where video data D (i,j, . . . ) to be supplied to the pixel PIX (i,j) is a certain value D1, the driving section 14 of the image display device 1 of the present embodiment sets an output signal Od1(*i*,j, . . . ) for an image display period and an output signal Ob1(*i*,j, . . . ) for a blanking period so that average luminance of the pixel PIX (i,j) is luminance indicated by the value D1.

With this, although a response speed of the PIX(i,j) is low and a blanking period is provided between image display periods in driving pixel PIX(i,j), if the video data D (i,j, . . . ) to be supplied to the pixel PIX(i,j) has a constant value D1, then the driving section 14 can control the pixel PIX(i,j) so that the pixel PIX(i,j) has luminance corresponding to the value D1 as a whole.

Consequently, although the hold-type pixel array 2 is used, that is, the pixel array 2 capable of maintaining, during a predetermined period, luminance of the pixel PIX(i,j) till a new output signal O is supplied is used, it is possible to cause light emission of each pixel PIX (i,j) in the pixel array 2 to be similar to impulse light emission of a CRT, allowing for preventing motion blurring or other problems. Consequently, it is possible to increase image quality in displaying moving images on the pixel array 2.

Figure 5:
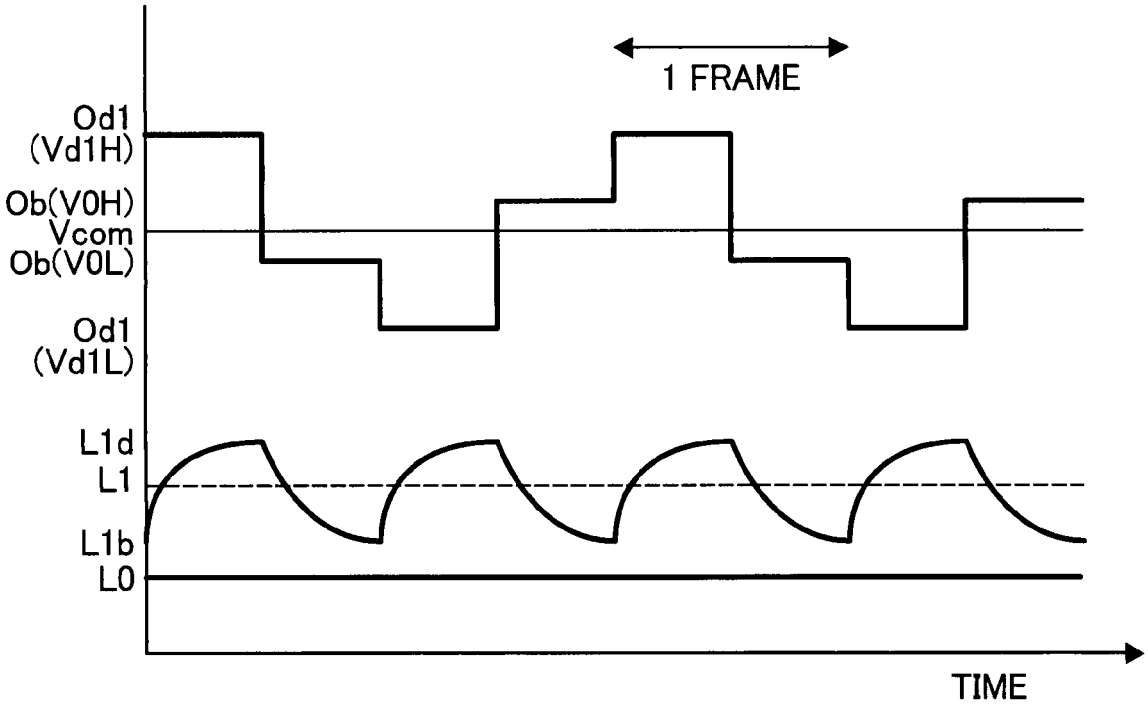
FIG. 5 is a graph showing temporal changes in an output signal applied on the pixel and in luminance of the pixel in a steady state.
Figure 10:
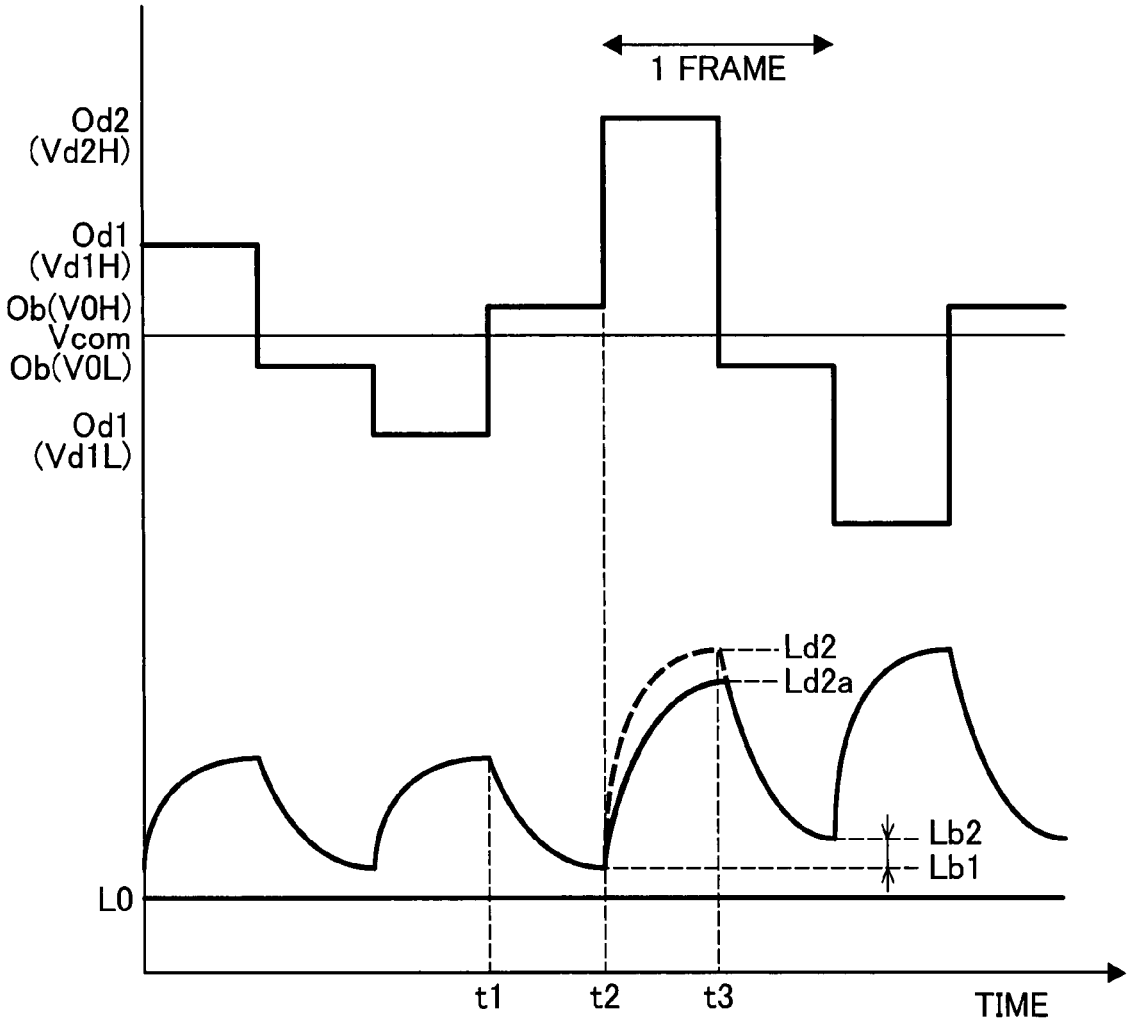
FIG. 10 is a graph of a comparative example, showing temporal changes in an output signal applied on a pixel to be displayed during an image display period and in luminance of the pixel, when luminance of the pixel changes in an arrangement where an output signal for a blanking period is not changed.

For example, as illustrated in FIG. 5, the driving section 14 of the present embodiment sets an output signal Ob for a blanking period to be a value indicative of black (V0H or V0L). Further, the driving section 14 stores output signals Od corresponding to possible values of video data D, and outputs the stored output signals Od(i,j, . . . ) in accordance with supplied video data D.

In FIG. 5, L1(ave) is an average value of luminance, which corresponds to luminance indicated by the D1. Further, luminance L1*d* is luminance which the pixel PIX(i,j) reaches at the end of an image display period by application of an output signal Od1(Vd1H or Vd1L in FIG. 5) corresponding to D1. The method for storing output signals Od may be a method in which output signals Od corresponding to respective video data D are stored in an LUT so as to correspond to the respective video data D, or may be a method in which output signals Od corresponding to representative values of respective video data D are stored in an LUT so as to correspond to the representative values and output signals Od corresponding to values between the representative values are calculated by reading out the output signals Od corresponding to the representative values from the LUT and interpolating the read out output signals Od. In addition, if a calculation equation allowing for calculating output signals with enough accuracy and speed exists, then the calculation equation may be stored.

The following further details motion blurring caused in the hold-type pixel array 2. As many researchers observe, human eyes have a tendency to automatically follow a moving target (eye-tracking). For that reason, in a hold-type display, a fixedly displayed target is perceived by human retinas as if the target moves opposite to a direction in which things other than the target move on the display. Consequently, in the hold-type display, there is a possibility that blurring occurs in displaying moving images.

For example, assume that an image is displayed in which a black target moves from left to right of a white background by four dots with respect to each frame period. Sets of luminance of each pixel existing on a horizontal line in each frame period are disposed longitudinally, which is illustrated in FIG. 6.

An arrow mark in FIG. 6 connects areas where edges exist in each frame period. Human eyes automatically follow movement of the edges. Therefore, in a case where one frame period includes four field periods, if the origination of a spatial coordinate is replaced with human eyes, then FIG. 6 changes to FIG. 7 and therefore a pixel to be an edge changes depending on where a field period is positioned in a frame period. For example, in a first field (e.g. field 0), a pixel whose X-coordinate is 15 with human eyes being the origination is an edge, while in a fourth field period (e.g. field 3), a pixel whose X-coordinate is 12 with human eyes being the origination is an edge.

A value obtained by averaging luminance of a pixel over field periods (average luminance) is shown in the most bottom part in FIG. 7. Average luminance near an edge does not change from white to black at a bound, but changes from white to black gradually. As a result, blurring is generated at the edge. Note that, average luminance over six frame periods is shown in FIG. 7. However, when a moving speed is constant, average luminance is constant regardless of the number of frame periods or the number of field periods over which average luminance is to be calculated.

On the other hand, in an arrangement of the driving section 14 of the present embodiment in which a blanking period is provided (an arrangement in which impulse driving is performed), as illustrated in FIG. 8, in an image display period (first field period in each frame in FIG. 8), luminance of each pixel is controlled so as to be luminance corresponding to video data for displaying an image, while in a blanking period, the luminance of each pixel is not controlled in such a manner, and is kept dark unlike in the image display period. Note that, an arrow in FIG. 8 is the same as the arrow in FIG. 6.

In that case, unlike the case of FIG. 7, a wrong image (an image whose edge different X-coordinate) is not perceived by human retinas. Consequently, as with FIG. 7, if the origination of spatial coordinates in FIG. 8 is replaced with human eyes, FIG. 8 is changed to FIG. 9. In FIG. 9, a value obtained by averaging luminance of a pixel over field periods (average luminance) changes at a bound at an edge (in FIG. 9, a point where X-coordinate changes from 15 to 16). As a result, unlike a display shown in FIG. 6, it is possible to prevent blurring at an edge.

Further, in a case where video data D supplied to a pixel PIX changes so as to increase luminance of the pixel PIX, the driving section 14 of the present embodiment controls an output signal Ob for a blanking period, which output signal Ob is outputted between an output signal Od1 for an image display period corresponding to video data D1 which is not yet increased, and an output signal Od2 for an image display period corresponding to video data D2 which is increased. With this control, the driving section 14 sets the output signal Ob to have a value indicative of luminance higher than luminance of an output signal Ob for a blanking period (black) which is outputted at a time when video data supplied to the pixel PIX does not change, that is, at a time of a steady state.

Here, assume that a response speed of the pixel PIX(i,j) is low. As illustrated in FIG. 4, when the driving section 14 applies a value indicative of black on the pixel PIX(i,j) during a blanking period Tb, the pixel PIX(i,j) reaches different luminance at the end of the blanking period Tb in accordance with luminance Ld at the start of the blanking period Tb. As the luminance Ld is higher, the luminance at the end of the blanking period Tb is also higher. As described above, the luminance Ld at the start of the blanking period Tb is determined by video data D(i,j, . . . ).

Therefore, luminance Lb1 which the pixel PIX(i,j) reaches at the end of the blanking period Tb in the period T1 during which the video data D has a value D1 is lower than luminance Lb2 which the pixel PIX(i,j) reaches at the end of the blanking period Tb in the period T2 during which the video data has luminance higher than the value D1.

At that time, assume a comparative example in which: at a start t1 of a blanking period Tb from a period T1 to a period T2, an output signal Ob for a blanking period having the same value (black) as an output signal Ob for the period T1 or T2 is supplied. In this case, luminance of a pixel PIX(i,j) at an end t2 of the blanking period Tb is Lb1 which is the same as that in the period T1, and which is lower than Lb2 being a value of the period T2. On the other hand, an output signal Od2 and an output signal Ob supplied to the pixel PIX(i,j) in the period T2 are set so that luminance of the pixel PIX(i,j) ranges from the luminance Ld2 to the luminance Lb2.

Consequently, in the comparative example, if the output signal Od2 is supplied to the pixel PIX(i,j) in a first image display period Td of the period T2, then the pixel PIX(i,j) cannot reach the luminance Ld2 due to response delay of the pixel PIX(i,j). To be more specific, at the end t3 of the first image display period Td of the period T2, the pixel PIX(i,j) reaches luminance Ld2*a* which is lower than luminance Ld2 in the period T2.

At that time, the pixel PIX(i,j) cannot response in accordance with a video signal to change luminance. Consequently, improvement in image quality in displaying moving images, realized by causing light emission of each pixel PIX (i,j) of the pixel array 2 to be similar to impulse light emission, is canceled. This makes it difficult to sufficiently increase image quality in displaying moving images.

On the other hand, at the start t1 of the blanking period Tb from the period T1 to the period T2, the driving section 14 of the present embodiment outputs an output signal Ob12 indicative of luminance higher than luminance indicated by an output signal for a blanking period at a time of a steady state, that is, luminance higher than black.

Figure 11:
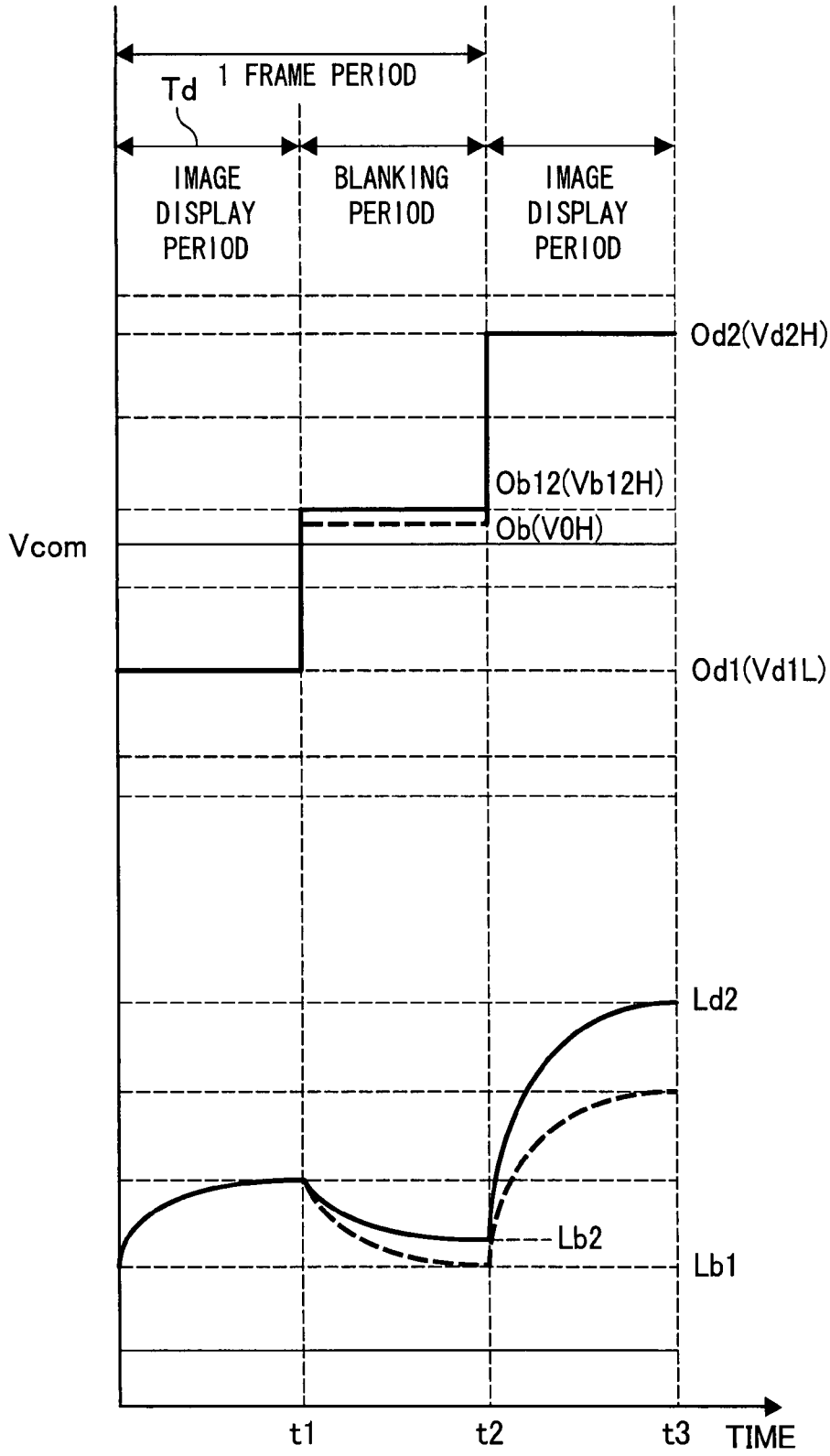
FIG. 11 is a graph of the embodiment, showing temporal changes in an output signal applied on a pixel to be displayed during an image display period and in luminance of the pixel, when luminance of the pixel changes.

Consequently, as illustrated in FIG. 11, luminance at the time t2 is higher than luminance Lb1 at the end of the blanking period Tb in the period T1, so that luminance at the time t3 is closer to desired luminance Ld2 than the case of the comparative example.

In particular, based on the terms T1 and T2 and video data D1 and D2, the driving section 14 of the present embodiment sets the output signal Ob12 so that luminance Lb2 which the pixel PIX(i,j) reaches at the end of the blanking period Tb in the period T2 in response to the output signal Ob indicative of black is identical with luminance at the time t2.

At that time, as illustrated in FIG. 11, luminance at the time t2 is luminance Lb2 at the end of the blanking period Tb in the period T2. This allows luminance at the time t3 to be desired luminance Ld2.

Consequently, unlike the comparative example, it is possible to cause luminance at the time t2 to be in accordance with a video signal to change luminance. As a result, light emission of a pixel is caused to be similar to impulse light emission without deteriorating image quality due to response delay of the pixel during a period from the time t2 to t3, so that it is possible to increase image quality in displaying moving images.

Further, assume a second comparative example in which: an output signal Od to a pixel PIX(i,j) is increased at a time t2 so that the pixel PIX(i,j) reaches luminance Ld2 at a time t3. This example also allows the pixel PIX(i,j) to reach luminance Ld2 at the time t3.

However, in the example, it is necessary to set the output signal Od at the time t3 to be a value indicative of luminance higher than luminance at the start of other image display period Td in a period T2. Therefore, in order to assure that the output signal Od at the time t3 to be indicative of higher luminance, it is necessary to set an output signal Od in other period to be within a range lower than a range which the driving section 14 can set. Consequently, luminance in the other period (period during which video data D to the pixel PIX(i,j) does not change) drops. Here, insertion of a blanking period Tb also drops brightness of the pixel array 2. Although an increase in a response speed of the pixel PIX(i,j) in accordance with a change of video data D is intended, further drop in brightness is not desirable.

On the other hand, the driving section 14 of the present embodiment increases the output signal Ob at the start t1 of the blanking period Tb between the terms T1 and T2, and increases luminance at the end t2 of the blanking period Tb. This allows luminance at the time t3 to be desired luminance Ld2.

Consequently, although the present embodiment adopts an arrangement in which insertion of a blanking period is likely to drop brightness of the pixel array 2, the present embodiment allows a response speed of the pixel PIX(i,j) to be higher without further dropping brightness of the pixel array 2, unlike the second comparative example.

When luminance to be displayed by a pixel PIX(i,j) during each of image display periods Td changes and when an output signal Ob for a blanking period Tb inserted between the image display periods Td can be controlled as described above, the data signal line driving circuit 3 may control an output signal based on a video signal supplied to the data signal line driving circuit 3. Alternatively, the following explains an example in which the signal processing section 21 provided between the video signal source S0 and the control circuit 12 controls a video signal to be supplied to the control circuit 12, thereby controlling an output signal Ob for a blanking period.

To be specific, the signal processing section 21 embeds video data D for a blanking period in a video signal DAT from the video signal source S0 so as to generate a video signal DAT2, and outputs the video signal DAT2 to the control circuit 12.

The video signal DAT includes Dd(i,j,k), Dd(i,j,k+2), Dd(i,j,k+4), . . . as video data D to a pixel PIX(i,j). The signal processing section 21 inserts video data Db(i,j,k+1), Db(i,j,k+3), Db(i,j,k+5), . . . between the video data Dd(i,j,k), Dd(i,j,k+2), Dd(i,j,k+4), . . . , and generates video data DAT2 including the video data Dd(i,j,k), Db(i,j,k+1), Dd(i,j,k+2), Db(i,j,k+3), Dd(i,j,k+4), Db(i,j,k+5), . . . . Note that, when video data D is not classified according to whether the video data D is for an image display period or for a blanking period, each video data is referred to as D(i,j, . . . ).

The control circuit 12 extracts each video data D(i,j, . . . ) from the video signal DAT2, and controls the data signal line driving circuit 3 and the scanning signal line driving circuit 4 as described above, and serially applies, on the pixel (i,j), output signals Od(i,j,k), Ob(i,j,k+1), Od(i,j,k+2), . . . corresponding to the video data Dd(i,j,k), Db(i,j,k+1), Dd(i,j,k+2), . . . .

Here, the video signal DAT supplied from the video signal source S0 to the signal processing section 21 may be transmitted in a frame unit (whole screen unit) or may be transmitted so that one frame is divided into a plurality of fields and the video signal DAT is transmitted in a field unit. The following explains a case where the video signal DAT is transmitted in the field unit.

In the present embodiment, the video signal DAT supplied from the video signal source S0 to the signal processing section 21 is transmitted so that one frame is divided into a plurality of fields (e.g. two fields) and the video signal DAT is transmitted in a field unit.

To be more specific, when the video signal source S0 transmits the video signal DAT to the signal processing section 21 of the image display device 1 via a video signal line VL, the video signal source S0 transmit sets of video data for fields by time division in such a manner so as to transmit whole video data for a certain field and then transmit video data for the subsequent field.

Further, the field includes a plurality of horizontal lines. Through the video signal line VL, sets of video data for horizontal lines are transmitted by time division in such a manner that all sets of video data for a certain horizontal line are transmitted and then sets of video data for the subsequent horizontal line are transmitted.

In the present embodiment, one frame includes two fields. Video data of an even-numbered horizontal line among horizontal lines making up one frame is transmitted for an even-numbered field. Video data of an odd-numbered horizontal line is transmitted for an odd-numbered field. Moreover, the video signal source S0 drives the video signal line VL by time division in transmitting video data of one horizontal line. Thus, sets of video data can be transmitted sequentially in a predetermined order.

Figure 1:
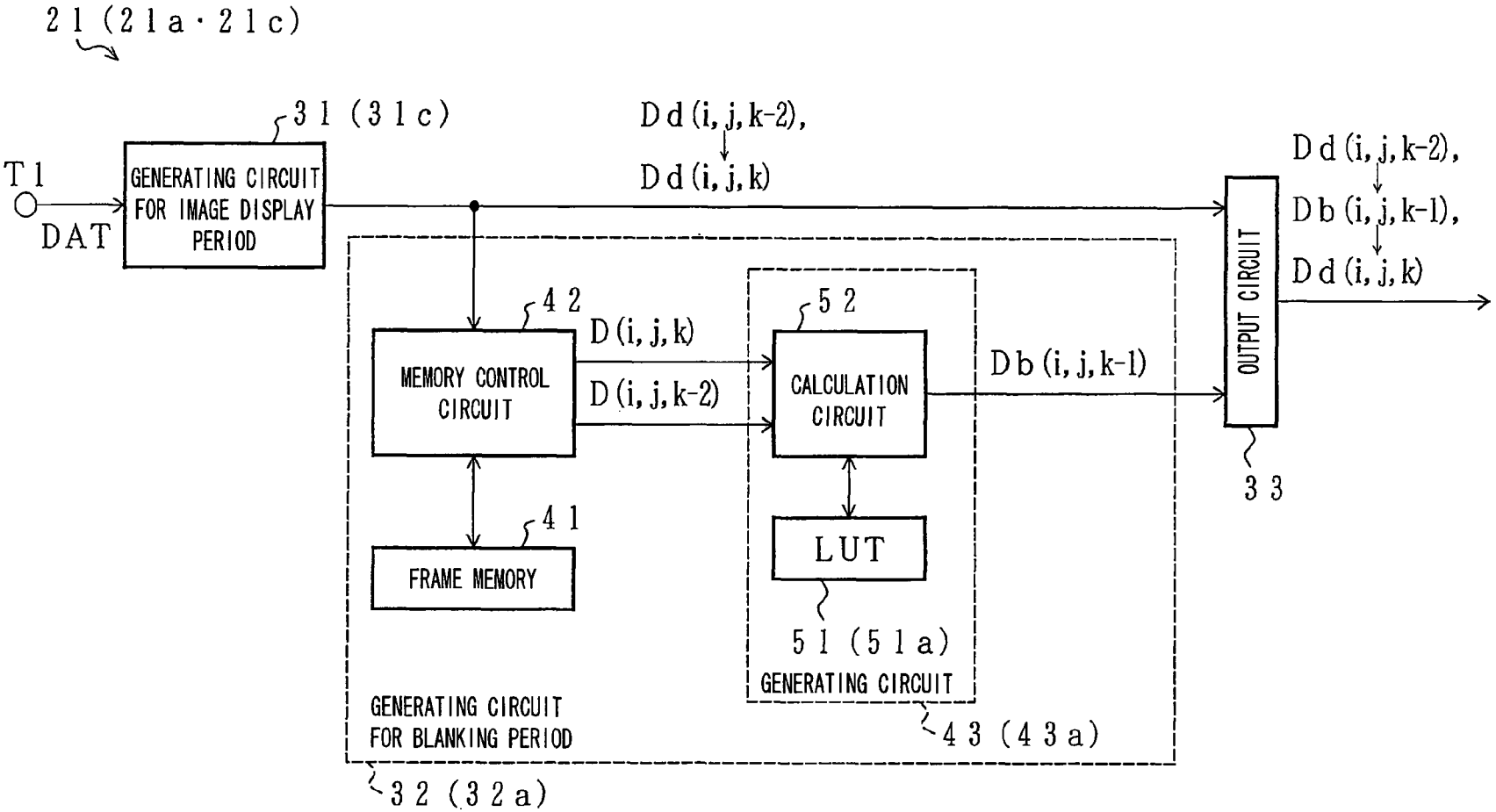
FIG. 1 is a block diagram of an embodiment of the present invention, showing a main structure of a signal processing section provided in an image display device.

As illustrated in FIG. 1, the signal processing section 21 includes: a generating circuit 31 (generating means) for an image display period, which extracts video data (supplied gradation data) for each pixel PIX(i,j) from a video signal DAT and outputs the video data as video data Dd for an image display period (gradation data for an image display period); a generating circuit 32 for a blanking period (blanking controlling means), which generates video data Db for a blanking period (gradation data for a blanking period) to be supplied to each pixel PIX(i,j); and an output circuit 33 which inserts the video data Db generated by the generating circuit 32 between the video data Dd generated by the generating circuit 31 and outputs each video data D obtained by the insertion to the control circuit 12.

The order of outputting each video data D to the control circuit 12 may be any order as long as video data Db for a blanking period to be supplied to a pixel PIX(i,j) is inserted between video data Dd for an image display period to be supplied to the pixel PIX(i,j). The output circuit 33 of the present embodiment transmits each video data D in a video signal DAT2 in the following order.

That is, in transmitting the video signal DAT2 to the control circuit 12 of the image display device 1 through the video signal line VL2, the output circuit 33 of the present embodiment transmits sets of video data for frames by time-division in such a manner that whole video data for an image display period and a blanking period of a certain field is transmitted and then video data for an image display period and a blanking period of the subsequent field is transmitted.

Further, in transmitting the sets of video data for frames, the output circuit 33 divides a frame into a sub-frame corresponding to video data for an image display period and a sub-frame corresponding to video data for a blanking period, and transmits video data for each sub-frame by time-division. Further, the output circuit 33 transmits video data for each sub-frame by time-division with respect to each horizontal line, and transmits video data for each horizontal line by time-division with respect to each video data of a pixel included in the horizontal line.

Each sub-frame may be first transmitted. The output circuit 33 of the present embodiment transmits video data for a sub-frame for an image display period and then transmits video data for a sub-frame for a blanking period.

The generating circuit 32 for a blanking period includes: a frame memory 41 which can store video data D(i,j,k) to be supplied to a pixel PIX(i,j) while a later-mentioned generating circuit 43 needs the video data D(i,j,k); a memory control circuit 42 for writing, in the frame memory 41, video data D of a current frame FR(k) supplied from the generating circuit 31 and for reading, from the frame memory 41, video data D of a previous frame FR(k−2) and outputting the video data D as a previous frame video signal DAT0; and a generating circuit 43 for generating video data Db(i,j,k−1) for a blanking period Tb(k−1) based on sets of video data (D(i,j,k) and D(i,j,k−2) for an image display period to be supplied to the same pixel PIX(i,j) out of video data D of a previous frame FR(k−2) and video data D of a current frame FR(k) supplied from the memory control circuit 42, the video data Db(i,j,k−1) being inserted between the video data D(i,j,k) and D(i,j,k−2).

In the present embodiment, as described above, video data Dd(i,j,k−2) for an image display period is transmitted and then video data Db(i,j,k−1) for a blanking period is transmitted. The video data Db(i,j,k−1) is determined based on the video data Dd(i,j,k−2) and video data D(i,j,k) which is posterior to the video data D(i,j,k−2).

Therefore, the output circuit 33 of the present embodiment outputs previous video data D(i,j,k−2) supplied from the frame memory 41 and then outputs video data Db(i,j,k−1) supplied from the generating circuit 32 for a blanking period. Storage capacity of the frame memory 41 is set so as to be capable of storing previous video data D(i,j,k−2) while the generating circuit 43 generates video data Db(i,j,k−1) for a blanking period based on the previous video data D(i,j,k−2) and current video data D(i,j,k) supplied from the frame memory 41 and outputs the video data Db(i,j,k−1) to the output circuit 33.

As illustrated in FIG. 12 for example, the generating circuit 43 includes an LUT (Look Up Table) 51 (storage means) in which data indicative of video data Db for a blanking period is stored with respect to each combination of previous video data D(i,j,k−2) and current video data D(i,j,k), the video data Db being to be supplied by the generating circuit 32 when the combination is supplied to the generating circuit 32.

In addition, in the present embodiment, in order to reduce storage capacity necessary for the LUT 51, data stored in the LUT 51 is not all combinations of the video data but data corresponding to predetermined combinations. The generating circuit 43 includes a calculation circuit 52 (calculation means) for interpolating the data corresponding to the combinations stored in the LUT 51 and calculating data corresponding to a combination of actually supplied sets of video data and outputting the calculated data.

Note that, the generating circuit 32 of the present embodiment outputs video data Db indicative of black when two sets of video data for image display periods to be supplied to an identical pixel PIX(i,j) do not change. Therefore, in the LUT 51 illustrated in FIG. 12, data at an area where two sets of video data for image display periods to be supplied to an identical pixel PIX(i,j) do not change (data stored so as to correspond to a combination of two sets of video data identical with each other) is set to a value (0) indicative of black.

The following explains video data Db to be supplied by the generating circuit 32 for a blanking period when each of the combinations of video data is supplied to the generating circuit 32.

In a case where two sets of video data constituting a combination have an identical value, video data Db corresponding to the combination is set to a value (0) indicative of black. In a case of a combination in which luminance increases from previous video data to current video data, video data Db corresponding to the combination is set to a value a1 . . . indicative of luminance higher than the value indicative of black. In a case of a combination in which luminance decreases from previous video data to current video data, video data Db corresponding to the combination is set to a value (0) indicative of black.

The following further details the case of the combination in which luminance increases from the previous video data to the current video data. Assume a first steady state in which two operations are alternately repeated: an operation for supplying an output signal Od1 corresponding to video data Dd1 having a certain value during an image display period Td1; and an operation for supplying an output signal Ob indicative of black during a blanking period Tb. Further, assume a second steady state in which two operations are alternately repeated: an operation for supplying an output signal Od2 corresponding to video data Dd2 having higher luminance than the video data Dd1 during an image display period Td2; and an operation for supplying an output signal Ob indicative of black during a blanking period Tb. Further, assume that luminance which a pixel PIX(i,j) reaches at the end of each blanking period Tb of the second steady state is Lb2. Further, video data Db corresponding to a combination of the video data Dd1 and Dd2 is set so that: if an output signal Ob corresponding to the video data Db is applied on a pixel PIX(i,j) during a blanking period Tb posterior to an image display period Td1 in the first steady state, then the pixel PIX(i,j) reaches the luminance Ld2 at the end of the blanking period Tb.

Video data Db corresponding to each combination of the video data Dd1 and Dd2 can be determined as follows for example. With respect to video data Dd2 of a current frame FR(k) constituting each combination, while repeatedly applying on a pixel PIX(i,j) an output signal Od2 corresponding to the video data Dd2 and an output signal Ob indicative of black, luminance L2*b* at the end of the blanking period Tb is measured. On the other hand, with respect to video data Dd1 of a previous frame FR(k−2) constituting each combination, while a first steady state in which output signal Od1 corresponding to the video data Dd1 and the output signal Ob indicative of black are repeatedly applied on the pixel PIX(i,j) is changed so that an output signal Ob to be applied during a next blanking period Tb is changed, luminance at the end of the next blanking period Tb is measured. Further, out of luminances thus measured with respect to each output signal Ob, luminance identical with the luminance L2*b* is searched. Then, Video data Db corresponding to an output signal Ob which is applied when the luminance identical with the luminance L2*b* is measured is regarded as video data corresponding to the video data Dd1 and Dd2.

In the arrangement, assume that video data Dd1 which a pixel PIX(i,j) displays during an image display period Td does not vary, like the case of the period T1 in FIG. 4. At that time, as illustrated in FIG. 12 for example, the LUT 51 stores 0 as an output value corresponding to a combination of identical values (Dd1, Dd1), so that the generating circuit 32 for a blanking period outputs video data Db indicative of 0. At that time, the generating circuit 31 for an image display period outputs video data Dd1 having a certain value. Therefore, the output circuit 33 repeatedly outputs video data Dd1 and video data Db indicative of 0 as video data D to be supplied to the pixel PIX(i,j). Consequently, the data signal line driving circuit 3 in FIG. 2 repeatedly outputs the output signal Od1 corresponding to the video data Dd1 and the output signal Ob indicative of black to the pixel PIX(i,j), so that luminance of the pixel PIX(i,j) goes back and forth between luminance Lb1 and luminance Ld1, like the case of the period T1 in FIG. 4.

Under the circumstance, assume that video data to be supplied to the pixel PIX(i,j) during the image display period Td changes from Dd1 to Dd2. At that time, as illustrated in FIG. 12 for example, the LUT 51 stores, as an output value corresponding to a combination in which luminance increases from previous video data to current video data, a value indicative of luminance higher than luminance indicated by an output value corresponding to a combination of identical values. Therefore, the generating circuit 32 outputs video data Db12 indicative of luminance higher than 0.

With this, the output circuit 33 serially outputs video data Dd1(*i*,j,k−2), video data Db12(*i*,j,k−1), and video data Dd2(*i,j,k*) as video data D to be supplied to the pixel PIX(i,j). The data signal line driving circuit 3 outputs, to the pixel PIX(i,j), an output signal Od1(*i,j,k*−2) corresponding to the video data Dd1(*i,j,k*−2) during an image display period Td(k−2), an output signal Ob12(*i,j,k*−1) corresponding to the video data Db12(*i,j,k*−1) during a blanking period Tb(k−1) posterior to the image display period Td(k−2), and an output signal Od2(*i,j,k*) corresponding to the video data Dd2(*i,j,k*) during an image display period Td(k) posterior to the blanking period Tb(k−1).

As described above, in a case where video data to be displayed during an image display period Td changes so that luminance increases, the signal processing section 21 changes video data Db to be inserted as video data during a blanking period so that the video data Db increases larger than that in a steady state. This allows the signal processing section 21 to change an output signal Ob(i,j,k−1) supplied to a pixel PIX(i,j) during a blanking period Tb(k−1) inserted between an image display period Td(k−2) corresponding to pre-changed video data and an image display period Td(k) corresponding to changed video data. The signal processing section 21 changes the output signal Ob(i,j,k−1) so that the output signal Ob(i,j,k−1) has luminance higher than luminance in the steady state.

This allows for preventing response delay of the pixel PIX(i,j) during the next image display period Td(k), unlike the case where an output signal indicative of the same luminance as that in the steady state is applied on the pixel PIX(i,j). This allows light emission of the pixel PIX(i,j) to be similar to impulse light emission without deteriorating image quality due to response delay of the pixel PIX(i,j). Consequently, it is possible to increase image quality in displaying moving images.

An explanation was made above as to the arrangement in which a blanking period is provided after an image display period in each frame period. Alternatively, a blanking period may be provided before an image display period. In this case, it is possible to further reduce storage capacity necessary for the frame memory 41.

Embodiment 2

An explanation was made above as to the arrangement in which a generating circuit for a blanking period outputs a value (0) indicative of black as video data Db for a blanking period in a steady state. In the present embodiment, an explanation will be made as to an arrangement in which a predetermined value whose luminance is higher than black and is dark enough is supplied. This arrangement is particularly desirable in a case where a liquid crystal cell in vertical alignment mode is used in normally black mode.

To be specific, as illustrated in FIG. 1, a signal processing section 21*a* of the present embodiment has substantially the same arrangement as the signal processing section 21 of Embodiment 1 except that a generating circuit 32*a* for a blanking period, which is provided instead of the generating circuit 32 for a blanking period, outputs a predetermined value whose luminance is higher than black and is dark enough as video data Db for a blanking period in a steady state.

Here, the luminance dark enough is luminance which does not cause dark gray display instead of black display (low contrast ratio) to a problematic extent and which can cover deterioration in impulse effect (which can sufficiently prevent deterioration in image quality due to motion blurring), even if luminance of PIX(i,j) during the blank period Tb is set to the luminance. For example, a value indicative of luminance being 1% or less of luminance indicative of white is preferably used. Further, video data Db corresponding to the luminance is, for example, 32-gradation or less when video data D is of 8 bits and a gamma value of the video data D is 2.2.

To be more specific, in general, contrast is more desirable if it is larger in making television images, and contrast is not considered to be problematic in visual quality if it is approximately 250 gradations. Here, assume that a liquid crystal cell in vertical alignment mode is driven in normally black mode. At that time, in a case of a steady mode in which a gradation transition is not emphasized, in general, a response from black to gray (1%) is greatly faster than a response from gray (1%) to black. Therefore, average black luminance at a time when a gradation transition between black and gray (1%) is repeated is much closer to black luminance than to 0.5% which is an intermediate value between black and gray. Here, black luminance in this mode is generally set to 0.1% (0.2% at maximum) of white luminance. Consequently, it is expected that average black luminance becomes approximately 0.2% (0.35% at maximum). For that reason, if luminance during a blanking period is set to 1% or less of white luminance, then it is possible to realize the above contrast and to keep the contrast in a level which is not visually problematic. The relation in response does not change at a low temperature at which response speed of a liquid crystal greatly drops. Therefore, a certain value (e.g. 32-gradation) can be used regardless of environmental changes.

Further, the generating circuit 32*a* for a blanking period includes an LUT 51*a* in FIG. 13 instead of the LUT 51. The LUT 51*a* includes Dbc, which is the above-mentioned certain value, instead of 0 included in the LUT 51. The generating circuit 32*a* for a blanking period outputs Dbc instead of a value (0) indicative of black in a case where the generating circuit 32 for a blanking period would output 0.

Here, in the present embodiment in which a liquid crystal cell in vertical alignment mode is used as a pixel array 2 in normally black mode, if a gradation transition is performed so that a gradation increases (gradation transition for rise), then liquid crystal molecules are inclined from a direction parallel to a liquid crystal cell substrate to a direction inclined to the substrate by a gradient electric field caused by a voltage applied on pixel electrodes. On the other hand, if a gradation transition is performed so that a gradation drops (gradation transition for decay), then liquid crystal molecules are brought back in a vertical direction by a regulating power exerted in a vertical direction by a vertical alignment film formed on the substrate. For that reason, in a case where the liquid crystal cell is used, in a gradation transition for rise, a start response from 0 where a direction in which liquid crystal molecules are to be inclined (in-plane component in an orientation direction) is not determined is extremely slower than a start response from a halftone where the direction in which liquid crystal molecules are to be inclined is already determined.

Therefore, if 0 (black) is supplied as video data Db for a blanking period and an alignment state corresponding to a pixel PIX(i,j) is a state indicative of black as with Embodiment 1, that is, a state in which liquid crystal molecules are vertically aligned, then a gradation transition for rise in the subsequent image display period Td is greatly slower than a gradation transition from an alignment state indicative of a gradation other than black (state indicative of a halftone), so that a response speed of the pixel PIX(i,j) during the image display period Td drops greatly.

On the other hand, in the present embodiment, the generating circuit 32*a* for a blanking period supplies, as video data Db for a blanking period, a predetermined value whose luminance is higher than black and is dark enough. Consequently, a driving section 14*a* including the generating circuit 32*a* for a blanking period applies, as an output signal Ob for a blanking period in a steady state, on the pixel PIX(i,j), an output signal having a predetermined value indicative of luminance higher than black and dark enough.

Therefore, even if response of the pixel PIX(i,j) is fast enough during a blanking period Tb and the pixel PIX(i,j) reaches luminance indicated by video data Db for a blanking period at the end of the blanking period Tb, the luminance is not black and therefore response of the pixel PIX(i,j) does not delay during the subsequent image display period Td.

To be specific, in the arrangement in which the driving section 14*a* drives the pixel PIX(i,j), even if response of the pixel PIX(i,j) is fast enough during the blanking period Tb, an alignment state of a liquid crystal at the end of the blanking period Tb is such that liquid crystal molecules are already inclined to such an extent that contrast is not impaired. Here, if a voltage is applied on a liquid crystal in a state indicative of black, it must be determined, as to each liquid crystal molecule in a substantially vertical alignment state, which direction the liquid crystal molecule is inclined and what inclination angle (angle seen from a normal line direction of a substrate) the liquid crystal molecule has, based on an applied electric field, states of surrounding liquid crystal molecules, and shapes of members (such as electrodes) touching the liquid crystal molecule. In contrast, in a state indicative of a gradation other than black, a direction in which liquid crystal molecules are inclined is already determined. Therefore, it is suffice to determine at what inclination angle each liquid crystal molecule is inclined in accordance with an applied voltage. In other words, unlike the state indicative of black, that is, a state where a direction in which liquid crystal molecules are inclined is not controlled, in a state indicative of a gradation other than black, a direction in which liquid crystal molecules are inclined is controlled enough. Therefore, the state indicative of a gradation other than black allows for easier control of a response of liquid crystal molecules than the state indicative of black does. Consequently, the state indicative of a gradation other than black makes it easier to deal with problems such as a drop in a temperature of a liquid crystal panel as the pixel array 2 and limitation of voltages applied on the data signal line driving circuit 3.

In the present embodiment, luminance of each pixel PIX of the pixel array 2 is controlled, during a blanking period, not to be black but to be luminance predetermined for dark display. Consequently, if luminance to be displayed by a pixel during an image display period Td is close to luminance for the dark display, then it is impossible to cause luminance of the pixel during a blank display period Tb to be greatly lower than luminance of the pixel during the image display period Td. In some cases, luminance of the pixel during the blank display period Tb may be higher than luminance of the pixel during the image display period Td.

However, as described above with reference to FIGS. 7 to 9, motion blurring is caused because: when a relatively bright area and a relatively dark area change their positions, the bright area is mixed with the dark area and an intermediate area (blurring) is caused. Therefore, in a case where an image (alternatively, an area of the image) having a gradation close to luminance for the dark display (e.g. luminance not more than 1% of white luminance; not more than 32-gradation) is displayed, motion blurring rarely occurs, and even if motion blurring occurs, it is difficult to be recognized.

On the other hand, in a case where an image (alternatively, an area of the image) brighter enough than the luminance for the dark display is displayed, it is possible to cause luminance of the pixel during a blank display period Tb to be greatly lower than luminance of the pixel during an image display period Td, so that it is possible to prevent motion blurring.

As a result, even if luminance of a pixel is controlled so as to be luminance for dark display during a blanking period as described in the present embodiment, it is possible to prevent deterioration in image quality due to motion blurring without any inconvenience.

The following shortly exemplifies a method for setting a gradation voltage in a case where the pixel array 2 is in normally black mode and gamma value is 2.2. For convenience of explanation, the following explains a case where video data is of 8 bits (0 to 255 gradations) and a gradation voltage can be set with respect to every 32 gradations.

First, in order to use maximum luminance and maximum contrast of the pixel array 2, black voltage (V0) is set as the minimum voltage and white voltage (V255) is set as the maximum voltage.

Next, video data Db for a blanking period (how to set a gradation during a blanking period) is determined. Further, a voltage to be applied on a pixel PIX during a blanking period Tb (blanking voltage) is determined so that: luminance at a time when video data for a blanking period and white are alternately displayed (white luminance) and luminance at a time when video data Db for a blanking period is displayed during both an image display period Td and the blanking period Tb have desired gamma characteristics.

For example, assume that video data Db for a blanking period is 32-gradation, a voltage applied on a pixel PIX during the blanking period is V32, a voltage applied on the pixel PIX during white display is V255, luminance of the pixel PIX driven in response to V255, V32, V255, V32, is L255, and luminance of the pixel PIX driven in response to V32, V32, V32, . . . is L32. At that time, a blanking voltage V32 is adjusted so that L255/L32=(255/32)^2.2≈96.2.

Further, using the blanking voltage (V32) determined above, a voltage Vx for realizing desired γ is determined based on luminance Lx and the ratio of luminance L32 to luminance L255. The luminance Lx is luminance at a time when a voltage Vx and a blanking voltage are alternately applied on the pixel PIX while video data Dd for an image display period indicates any gradation x.

Next, based on gradation voltages determined as described above, video data Db for a blanking period at a time when a gradation transition is performed is determined, and stored in the LUT (51*a*).

To be specific, final luminance during the blanking period Tb in a case where a gradation X is displayed in a steady state (a case where a gradation voltage Vx corresponding to the gradation X is applied during the image display period Td and a blanking voltage is applied during the blanking period Tb) is measured, and the final luminance is regarded as TDx. In the same way, final luminance during the blanking period Tb in a case where the gradation X is displayed during the image display period Td is measured, and the final luminance is regarded as TCx. The final luminance is measured with respect to each combination of video data for an image display period and video data for a blanking period. Results of the measurements are recorded as waveforms of oscilloscope for example.

Further, luminance TDx and TCx at a time of a gradation transition is measured. Based on results of the measurements, video data Db for a blanking period to be supplied at the time of a gradation transition is determined.

For example, if input gradation data changes from 32-gradation to 255-gradation, then TD32<TD255 and TC32<TC255 in a steady state. Therefore, a blank gradation for changing TD32 to TD255 necessarily exists between a blank gradation corresponding to 32-gradation and a blank gradation corresponding to 255-gradation.

A change in luminance in a case of a gradation transition is measured by using a photodiode and an oscilloscope for example and a result of the measurement is recorded, and a waveform in the case of the gradation transition is compared with a waveform in the steady state. Out of waveforms recorded with respect to each of the combinations, a combination is selected, which combination is a combination in which a gradation indicated by video data Td for an image display period is identical with a gradation before the gradation transition, and luminance TDx indicated by the video data Db for a blanking period is closest to luminance TDx in the case of the gradation transition. Then, video data Db for a blanking period constituting the selected combination is selected. This allows for determining the video data Db for a blanking period to be supplied in the case of the gradation transition. Note that, for a part of a gradation transition for decay, a normal corrected gradation may be 0 (without correction).

Embodiment 3

In Embodiments 1 and 2, explanations were made as to cases where the signal processing section 21 (21*a*) outputs a constant value as video data Db for a blanking period in a steady state, regardless of video data Dd for an image display period. In contrast, in the present embodiment, an explanation will be made as to a case where video data Db for a blanking period in a steady state is changed in accordance with video data Dd for an image display period.

Figure 14:
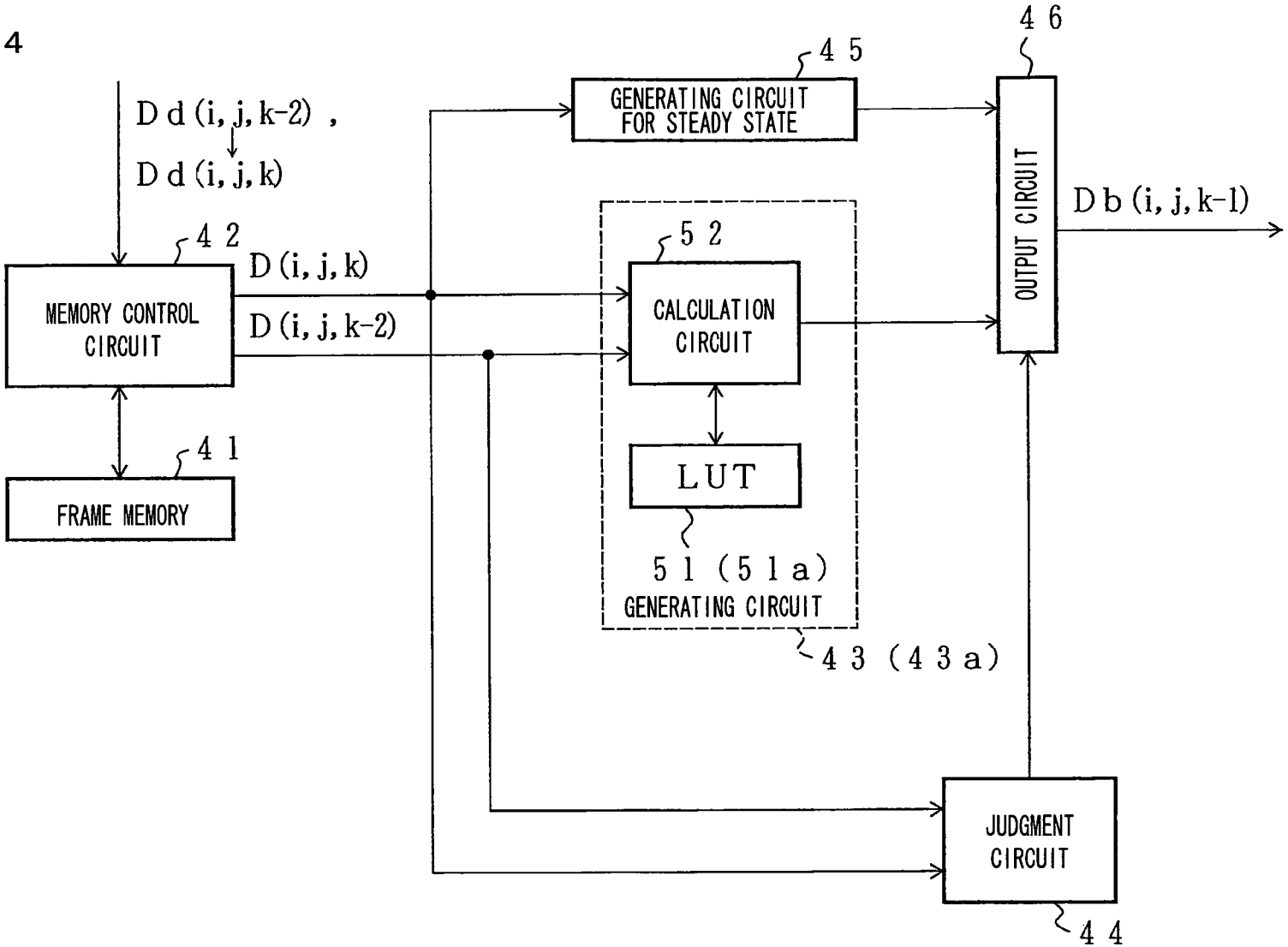
FIG. 14 is a block diagram of further another embodiment of the present invention, showing a main structure of a generating circuit for a blanking period provided in a signal processing section.

To be specific, a signal processing section 21*b* of the present embodiment is substantially the same as the signal processing section 21 in FIG. 1 except that a generating circuit 32*b* for a blanking period in FIG. 14 is provided instead of the generating circuit 32 for a blanking period.

In addition to the arrangement of the generating circuit 32 for a blanking period, the generating circuit 32*b* for a blanking period includes: a judgment circuit 44 (judging means) for judging whether image display is in a steady state or not based on sets of image data (D(i,j,k) and D(i,j,k−2)) for image display periods to be supplied to an identical pixel PIX(i,j), the image data D(i,j,k) and D(i,j,k−2) being one of image data D of a previous frame FR(k−2) and image data D of a current frame FR(k), respectively, supplied from the memory control circuit 42; a generating circuit 45 for a steady state (generating means for a steady state) for generating video data Db for a blanking period in a steady state, based on the video data D(i,j,k) of a current frame FR(k) supplied from the memory control circuit 42; and an output circuit 46 (output means) for selecting one of an output of the generating circuit 43 (blank generating means) and an output of the generating circuit 45 for a steady state based on a result of the judgment performed by the judgment circuit 44 and outputting the selected output. This allows the generating circuit 32*b* for a blanking period to output video data Db generated by the generating circuit 45 in a steady state and to output video data Db generated by the generating circuit 43 when video data for an image display period varies.

The following explains an example in which the generating circuit 45 for a steady state generates video data Db for a blanking period based on video data D(i,j,k) of a current frame FR(k). Note that, the generating circuit 45 for a steady state functions in a steady state, that is, a state in which video data D(i,j,k) of a current frame FR(k) is identical with video data D(i,j,k−2) of a previous frame FR(k−2). Therefore, the same effect can be obtained if the generating circuit 45 for a steady state generates video data Db based on the video data D(i,j,k−2) of the previous frame FR(k−2) instead of the video data D(i,j,k) of the current frame FR(k).

The generating circuit 45 of the present embodiment multiplies the video data D(i,j,k) of the current frame FR(k) with a predetermined constant so as to generate video data Db for a blanking period in a steady state, the predetermined constant assuring a sufficient difference in luminance between the video data D(i,j,k) and the video data Db.

Here, as luminance indicated by the video data Db for a blanking period gets lower, it is possible to cause light emission of the pixel array 2 to be closer to impulse light emission of a CRT, resulting in further improvement in image quality when the pixel array 2 displays moving images. On the other hand, as the luminance indicated by the video data Db for a blanking period gets lower, average luminance of a pixel PIX(i,j) drops more, resulting in lower brightness of the pixel array 2. For that reason, it is desirable to set the constant to be a value allowing for sufficiently increasing image quality in displaying moving images and for sufficiently maintaining brightness of the pixel array 2.

To be specific, in a case of impulse drive for providing a blanking period Tb, it is ideally desirable that the blanking period Tb is long enough and luminance during the blanking period Tb is 0 so as to increase image quality in displaying moving images. However, in a case where response speed of a pixel is low, e.g., in a case where a pixel is a liquid crystal, it is difficult to completely realize both an increase in image quality in displaying moving images and an increase in brightness of the pixel array 2. For that reason, in the case, it is desirable that luminance of each pixel during a blanking period Tb is set so that a wrong image is not recognized by a user during the blanking period Tb.

Here, an experiment was made in which: while a ratio of luminance of the blanking period Tb to luminance of the image display period Td was changed, images were displayed on the pixel array 2 and motion blurring of images displayed with respect to each ratio were evaluated by users. A result of the experiment showed that if the ratio of the luminance is ½ or less, then motion blurring is improved so obviously as to be practically allowable. Further, the result showed that if the ratio of the luminance is ¼ or less (particularly ⅕ or less), then motion blurring is more obviously improved, allowing for enough improvement in image quality in displaying moving images.

Figures 15, 16:
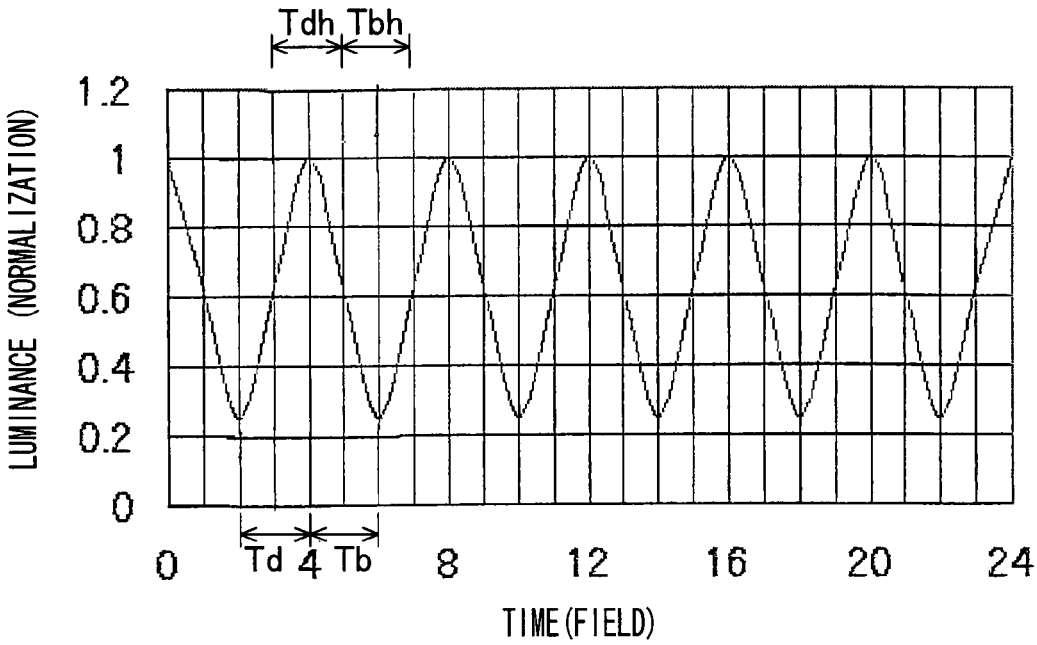
FIG. 15 is a graph showing a change in luminance of a pixel in a blanking period and in an image display period.
FIG. 16 is a table of another arrangement example, showing a look-up table provided in the signal processing section.

Note that, liquid crystals have lower response speed than CRTs. Therefore, luminance of a pixel changes in a waveform manner as illustrated in FIG. 15. Consequently, the blanking period Tb and the image display period Td are perceived by human eyes as shifted in time to be the blanking period Tbh and the image display period Tdh. Further, in FIG. 15, the blanking period Tb and the image display period Td are normalized so that peak luminance is 1 in a case where a ratio of luminance is approximately ⅕ (a ratio at a time of gradation display with gamma value being 2.2 is ½).

Here, it was confirmed that the ratio of luminance (¼ or less, particularly ⅕ or less) is approximately ½ or less when indicated by gradations whose gamma value is 2.2, and if a ratio of gradations is set to ½ or less, then it is possible to improve response in displaying moving images, compared with an arrangement in which the blanking period Tb is not provided.

Therefore, it is desirable that the constant is set to at least not more than these limitation values. Further, in consideration of a slow response of the pixel PIX(i, j), it is more desirable that the constant is set to 1/20 or less in luminance and to ¼ or less in gradations whose gamma value is 2.2. If the constant is set to not more than these limitation values, then it is possible to sufficiently increase response in displaying moving images even if response speed of a pixel PIX(i,j) is low.

Further, as luminance during the blanking period Tb is lower, average luminance of the pixel array 2 is lower. For that reason, out of the desirable numeral range (¼ or less in gradations), if the constant is set to ⅕ or more in gradations whose gamma value is 2.2, then it is possible to increase response in displaying moving images while keeping average brightness of the pixel array 2. This is more desirable.

In the present embodiment, the constant is set to ¼ in gradations as a value allowing an increase in brightness of the pixel array 2 out of the desirable numerical range. The generating circuit 45 for a steady state outputs, as video data Db, a value which is ¼ of video data D(i,j,k) of a current frame FR(k).

An explanation was made above as to an arrangement in which there is provided the generating circuit 45 for a steady state for multiplying video data of a current frame FR(k) or video data of a previous frame FR(k−2) with a constant so as to calculate video data Db for a blanking period. Alternatively, the same effect can be obtained in an arrangement in which the judgment circuit 44, the generating circuit 45, and the output circuit 46 are not provided and an LUT 51*b* is provided instead of the LUT 51 or the LUT51*a* illustrated in FIG. 1 as long as a value obtained by multiplying image data D of a current frame FR(k) or a previous frame FR(k−2) with a constant is supplied as image data Db for a blanking period.

FIG. 16 illustrates the LUT 51*b* in which: in a storage area corresponding to a steady state, that is, a storage area corresponding to a combination of video data D(i,j,k) of a current frame FR(k) and video data D (i,j,k−2) of a previous frame FR(k−2) identical with each other, a value obtained by multiplying D(i,j,k)=D (i,j,k−2) with a constant is stored. FIG. 16 exemplifies a case where, as with FIG. 12, the constant is ½ and a value (0) indicative of black is stored in an area of a gradation transition for decay of luminance.

Therefore, the signal processing section 21*b* of the present embodiment changes video data Db for a blanking period in a steady state in accordance with video data Dd for an image display period, regardless of how video data Db for a blanking period in a steady state is generated. Therefore, it is possible to realize the image display device 1*b* capable of increasing image quality in displaying moving images and increasing brightness of the pixel array 2 at a higher level and in a more balanced manner than an arrangement in which video data Db for a blanking period in a steady state is fixed.

To be specific, as described above, as a darker gradation is displayed during the blanking period Tb, image quality in displaying moving images is more improved, but brightness of the pixel array 2 drops. For that reason, it is desirable that video data Db for a blanking period in a steady state is set to a value allowing for both increasing image quality in displaying moving images and increasing brightness of the pixel array 2 with a good balance.

However, luminances during blanking periods Tb necessary for improving, to an equal extent, image quality in displaying moving images have different values if luminances during image display periods Td which are adjacent to the blanking periods Tb are different from each other. As luminance during an image display period Td is higher, luminance necessary for improving image quality to an equal extent is higher.

Therefore, in the arrangement in which video data Db for a blanking period in a steady state is fixed, it is necessary to determine luminance during the blanking period Tb so that image quality in displaying moving images is improved even in relatively dark display. This makes it difficult to sufficiently improve brightness of the pixel array 2.

On the other hand, the signal processing section 21*b* of the present embodiment changes video data Db for a blanking period in a steady state in accordance with video data Dd for an image display period. As luminance indicated by the video data Dd is higher, the signal processing section 21*b* sets luminance indicated by the video data Db for the blanking period in a steady state to be higher. Consequently, it is possible to realize the image display device 1*b* capable of increasing image quality in displaying moving images and increasing brightness of the pixel array 2 at a higher level and with better balance than the arrangement in which video data Db for the blanking period in a steady state is fixed.

As with the above example, the following shortly explains how to set a gradation voltage in a case where the pixel array 2 is in normally black mode and a gamma value is set to 2.2. For convenience of explanation, the following explains an example in which video data is of 8 bits (0 to 255 gradations) and a gradation voltage can be set with respect to every 16 gradations.

First, in order to use maximum luminance and maximum contrast of the pixel array 2, black voltage (V0) is set as the minimum voltage and white voltage (V255) is set as the maximum voltage.

Next, video data Db for a blanking period (how to set a gradation during a blanking period) is determined. Further, a voltage corresponding to each gradation is temporarily determined.

Next, using the temporarily determined gradation voltage, luminances at a time when video data Dd for image display periods are displayed (at a time when video data Dd for image display periods and video data Db for blanking periods determined in accordance with the image display periods are alternately displayed) are measured. Adjustment of each gradation voltage is repeatedly performed so that a result of evaluation of whole errors between luminances thus measured and luminances at gradation displays calculated based on desired gamma characteristics is within an allowable range.

Each gradation voltage may be adjusted after all errors at gradation displays are obtained. However, at that time, the number of measurement increases. For that reason, in the present embodiment, in order that luminance at a time when a first gradation (firstly, white gradation) is displayed and luminance at a time when a gradation corresponding to image data Db for a blanking period in the case where the first gradation is displayed (in the case of the constant in the present embodiment, the gradation is ¼ of the white gradation) have desired gamma characteristics (2.2 in this example), a gradation voltage corresponding to the first gradation is adjusted, the adjustment being serially performed from white display. After the adjustment of the gradation voltage, video data Db for a blanking period at a time when the first gradation is displayed is regarded as a first gradation and adjustment of gradation voltages is performed repeatedly. Further, while the adjustment of gradation voltages is performed repeatedly, when the first gradation becomes smaller than a minimum gradation which allows for the adjustment of gradation voltages and is larger than a black gradation, the adjustment is stopped, and luminance at a time when a gradation whose voltage has been adjusted lastly is compared with luminance at a time when white display is provided, and an error from desired gamma characteristics is evaluated. If the error exceeds an allowable range, adjustment processes (e.g. adjustment amount and adjustment ratio) of gradation voltages are changed, and the adjustments of gradation voltages are repeated from a first process (adjustment using white as a first gradation). Further, adjustment processes of gradation voltages are changed repeatedly until gradation voltages are stabilized (until the error is within an allowable range).

For example, in a case where video data is of 8 bits (0 to 255 gradations), a gradation voltage V64 is adjusted assuming that a first gradation is 255-gradation. To be more specific, luminance at a time when 255-gradation is displayed (luminance at a time when V255 and V64 are applied repeatedly) and luminance at a time when 64-gradation is displayed (luminance at a time when V64 and V16 are applied repeatedly) are compared with each other and a gradation voltage V64 corresponding to 64-gradation is adjusted so that gamma characteristics determined based on the luminances are close to desired gamma characteristics (2.2).

Next, a gradation voltage V16 is adjusted assuming that a first gradation is 64-gradation. To be more specific, luminance at a time when 64-gradation is displayed (luminance at a time when V64 and V16 are applied repeatedly) and luminance at a time when 16-gradation is displayed (luminance at a time when V16 and V4 are applied repeatedly) are compared with each other and a gradation voltage V16 corresponding to 16-gradation is adjusted so that gamma characteristics determined based on the luminances are close to desired gamma characteristics (2.2).

In the above example, gradation voltages are adjusted with a step of 16 gradations. Therefore, if a first gradation is next set to 4-gradation, the gradation (4-gradation) is smaller than the lower limit value, that is, the minimum gradation which allows for adjustment of gradation voltages and is larger than a black gradation. For that reason, the repeated adjustment is stopped, and luminance at a time when 16-gradation is displayed (at a time when V16 and V4 are applied repeatedly) and luminance at a time when white display is provided are compared with each other, and an error from desired gamma characteristics is evaluated.

In this way, in the repeated adjustment of gradation voltages using white display as a start point, a voltage (e.g. V64 and V16 in the above example) of a gradation regarded as a first gradation is determined, and then gradation voltages that can be calculated from the voltages are serially searched so as to determine remaining gradation voltages.

To be specific, a gradation voltage smaller than V16 is determined based on a black voltage and a gradation voltage corresponding to the lower limit value. Therefore, luminance in a case where a gradation (32-gradation) which is larger by a step of 16 gradations than a gradation for lower limitation (16-gradation) and which is capable of adjusting a gradation voltage is displayed (luminance in a case where a gradation corresponding to V32 and a gradation corresponding to V8 are repeatedly displayed) is compared with luminance in a case where white is displayed, and a gradation voltage V32 is adjusted so as to have desired gamma characteristics. This allows for determining the gradation voltage V32. In the same manner, with respect to remaining adjustable gradation voltages, gradation voltages are determined serially from lower gradations.

Note that, after each gradation value is determined, video data Db for a blanking period at a time when a gradation transition is performed is determined as with Embodiment 2, and is stored in the LUT (51*b*).

Embodiment 4

In Embodiments 1 to 3, explanations were made as to the arrangement in which the generating circuit 31 for an image display period outputs, as video data Dd for an image display period, the same value as supplied video data D. In contrast, in the present embodiment, an explanation will be made as to an arrangement in which current video data D(i,j,k) supplied to a pixel PIX(i,j) is amended in accordance with previous video data D(i,j,k−2) supplied to the pixel PIX(i,j) and the corrected video data D is outputted as video data Dd(i,j,k) for an image display period.

Figure 17:
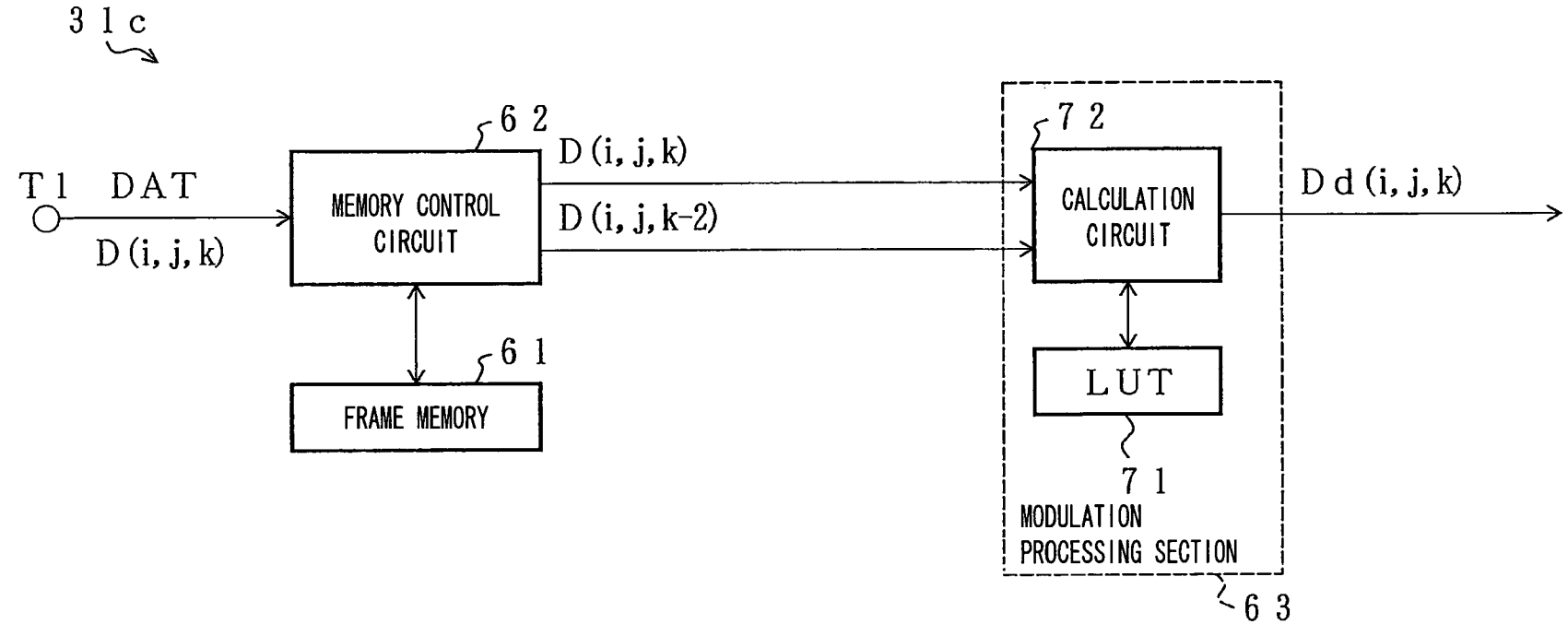
FIG. 17 is a block diagram of another embodiment of the present invention, showing a main structure of a generating circuit for an image display period provided in a signal processing section.

That is, a signal processing section 21*c* of the present embodiment is provided with a generating circuit 31*c* for an image display period in FIG. 17, instead of the generating circuit 31 for an image display period in FIG. 1. To be specific, the generating circuit 31*c* for an image display period includes: a frame memory 61 for storing, till a next frame, video data D corresponding to one frame supplied to a pixel PIX; a memory control circuit 62 for writing video data D(i,j,k) of a current frame FR(k) in the frame memory 61 and reading video data D0(*i,j,k*−2) of a previous frame FR(k−2) from the frame memory 61 so as to output the video data D0(*i,j,k*−2); and a modulation processing section 63 for correcting the video data D(i,j,k) of the current frame FR(k) by referring to the video data D(i,j,k−2) of the previous frame FR(k−2) and for outputting the corrected video data as correction video data Dd(i,j,k).

The modulation processing section 63 includes an LUT (Look-Up Table) 71 in which video data Dd(i,j,k) for an image display period is stored with respect to each combination of previous video data D(i,j,k−2) and current video data D(i,j,k), the video data Dd(i,j,k) being to be supplied by the modulation processing section 63 when the combination is supplied to the modulation processing section 63.

In addition, in the present embodiment, in order to reduce storage capacity necessary for the LUT 71, data stored in the LUT 71 is not data corresponding to all combinations of the previous video data and current video data, but data corresponding to predetermined combinations of the video data. The modulation processing section 63 includes a calculation circuit 72 for interpolating the data corresponding to the combinations stored in the LUT 71 and calculating data corresponding to an actually supplied combination of the video data and outputting the calculated data.

In the above arrangement, the modulation processing section 63 corrects the video data Dd(i,j,k) for an image display period of the current frame FR(k) by referring to the video data D(i,jk−2) of the previous frame FR(k−2). Therefore, the above arrangement is more complex than Embodiments 1 to 3 in which the generating circuit 31 for an image display period outputs video data D(i,j,k) of a current frame FR(k) as video data D(i,j,k) for an image display period without any correction. However, the above arrangement allows for more flexibly controlling response of a pixel PIX(i,j) than the arrangement in which the video data D(i,j,k) is outputted without any correction.

For example, if video data Dd for a blanking period in a steady state is not 0, then it is possible to increase response during the blanking period within a certain range and to improve decay response.

Explanations were made in the above embodiments as to the arrangement in which: when video data D to a pixel PIX changes for increasing luminance of the pixel PIX, an output signal Ob for a blanking period outputted between an output signal Od1 for an image display period corresponding to video data D1 before the increase and an output signal Od2 for an image display period corresponding to video data D2 after the increase is controlled so as to have higher luminance than an output signal Ob for a blanking period which is outputted in a steady state. However, the present invention is not limited to the arrangement.

For example, the present invention may be arranged so that: when video data D to a pixel PIX changes for decreasing luminance of the pixel PIX, an output signal Ob for a blanking period outputted between an output signal Od1 for an image display period (first image display period) corresponding to video data D1 before the decrease and an output signal Od2 for an image display period (second image display period) corresponding to video data D2 after the decrease is controlled so as to have lower luminance than an output signal Ob for a blanking period which is outputted in a steady state.

In this arrangement, too, it is possible to cause luminance at the end of the blanking period to be close to luminance at the end of the blanking period in a case where video data D2 after the decrease is always applied, allowing for preventing response delay of a pixel PIX during the second image display period.

In either arrangements, provided that luminance indicated by an output signal Od supplied to a pixel PIX(i,j) during an image display period Td changes from first luminance to second luminance in accordance with a change in video data D, the same effect can be obtained if the output signal Ob for a blanking period is corrected to indicate luminance which is corrected in the same direction as a direction of the change, the direction being a direction in which the luminance increases or decreases compared with an output signal Ob for a blanking period in a steady state.

However, a change in luminance of a pixel PIX during a blanking period is basically a change for decreasing luminance. Consequently, if an output signal Ob for a blanking period is corrected so that luminance of the pixel PIX during the blanking period is increased, then the correction decreases a change in luminance. Therefore, unlike correction for emphasizing a change in luminance, even if a numeral range for outputting an emphasized output signal Ob for a blanking period is not positioned out of a numeral range for outputting output signal Ob for a blanking period in a steady state, the output signal Ob for a blanking period is surely corrected. As a result, it is possible to correct an output signal for a blanking period or gradation data for a blanking period, without deteriorating image quality in the image display device 1 to 1*c* in a steady state.

In a case where an output signal Ob for a blanking period is corrected when luminance decreases, the control circuit 12, the data signal line driving circuit 3, and the scanning signal line driving circuit 4 remain to be used without any change. Therefore, if video data Db for a blanking period is corrected so that the output signal Ob for a blanking period is corrected, then the following inconvenience may occur.

To be specific, it is necessary to set video data Db for a blanking period at a time when luminance decreases (the data is hereinafter referred to as corrected video data Dbb) to be lower than video data (Dba) for a blanking period in a steady state. However, particularly in an arrangement in which video data Dba for a blanking period in a steady state is set to 0 gradation indicative of the darkest luminance (black), a gradation lower than 0 gradation does not exist. As a result, the signal processing section cannot exactly supply corrected video data Dbb to the control circuit 12. Further, if the video data Dba is set to a predetermined gradation or to a multiplication of video data for an image display period Td and a constant, there is a case where video data D supplied to the control circuit 12 cannot have a value lower than the video data Dba by gradations necessary for exact correction.

For example, assume that video data D supplied to the control circuit 12 can indicate 0 to 255 gradations. In addition, assume that the video data Dba is 16-gradation and it is necessary to set the video data Dba to be lower by 20 gradations to perform exact correction. At that time, a gradation to be displayed after the correction is −4-gradation. However, −4-gradation cannot be indicated by the video data D.

If a transmission route via which the signal processing section transmits an amount of correction to the control circuit 12 so as to exactly inform the corrected video data Dbb, then it is necessary to modify the control circuit 12 and the driving circuits 3 and 4 so that the control circuit 12 and the driving circuits 3 and 4 can receive the amount. This is troublesome and increases the size of a circuit.

As an arrangement which is preferable for correcting an output signal Ob for a blanking period at a time when luminance decreases and which is free from the above inconvenience, the following explains an arrangement in which a video signal DAT is converted so that video data indicative of a gradation lower than a predetermined gradation is not generated. As described above, the arrangement is applicable to any one of Embodiments 1 to 4. As a preferably applicable example, the following explains a case where the arrangement is applied to Embodiment 1.

Figure 18:
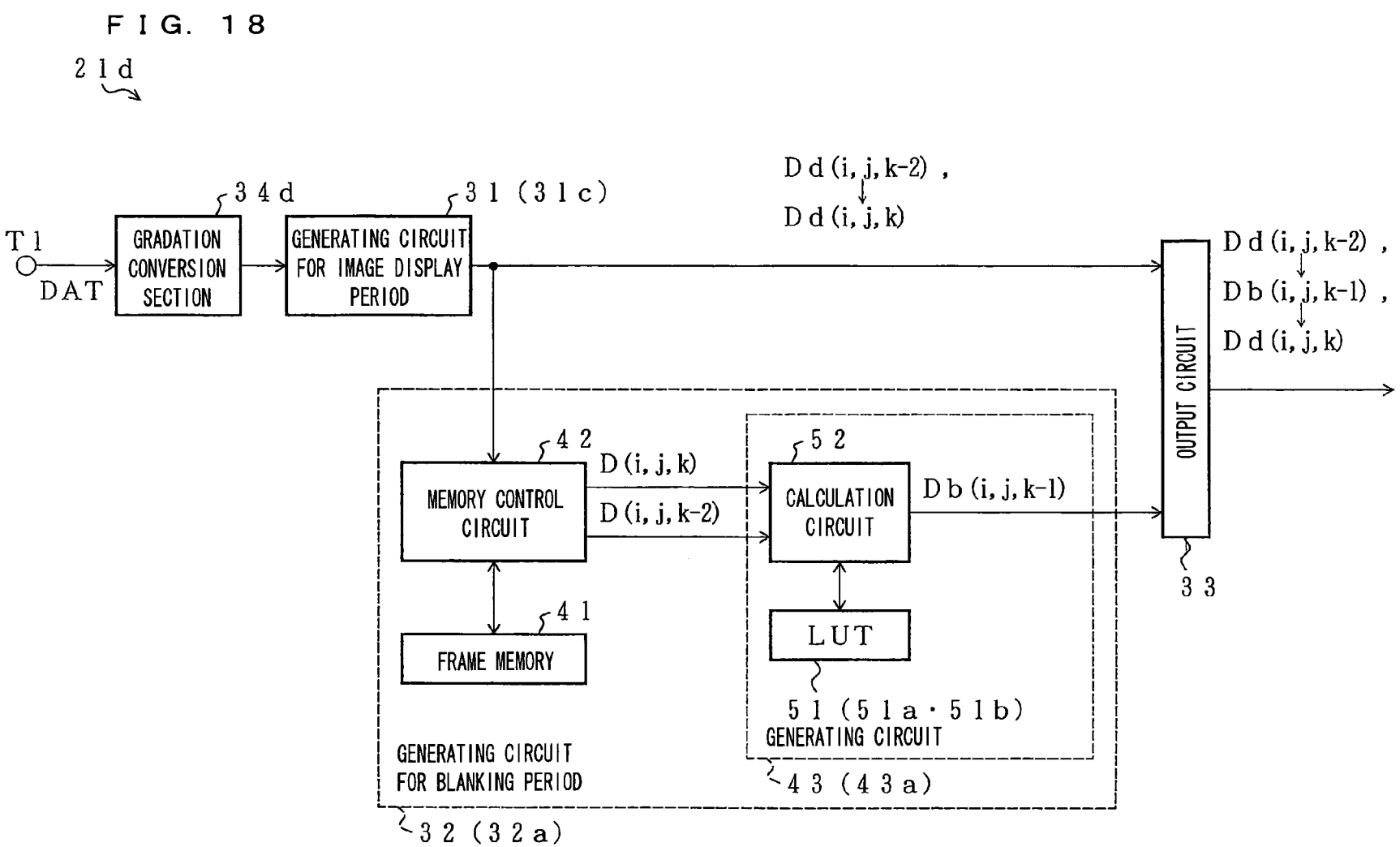
FIG. 18 is a block diagram of a modification example of the present invention, showing a main structure of a signal processing section.

A signal processing circuit 21*d* of the present modification example has the substantially the same arrangement as that in FIG. 1 except that, as illustrated in FIG. 18, the signal processing section 21*d* has a gradation conversion section 34*d* in a previous stage of the generating circuit 31 for an image display period.

The gradation conversion section 34*d* converts video data supplied to the generating circuit 31 for an image display period so that a lower limit of the video data is larger than the lower limit (0) of a numeral range which the video data can indicate. In order to convert each video data of a video signal DAT without deteriorating image quality too much, the gradation conversion section 34*d* sets a gradation depth (a bit width at a time when video data is displayed) of the video data of the video signal DAT to be a deeper grayscale depth (to be a wider bit width) and sets gradation-luminance characteristics to have desired characteristics and then adds noise information predetermined in time and space to the video data, and then rounds the video data to which the noise information has been added.

Figure 19:
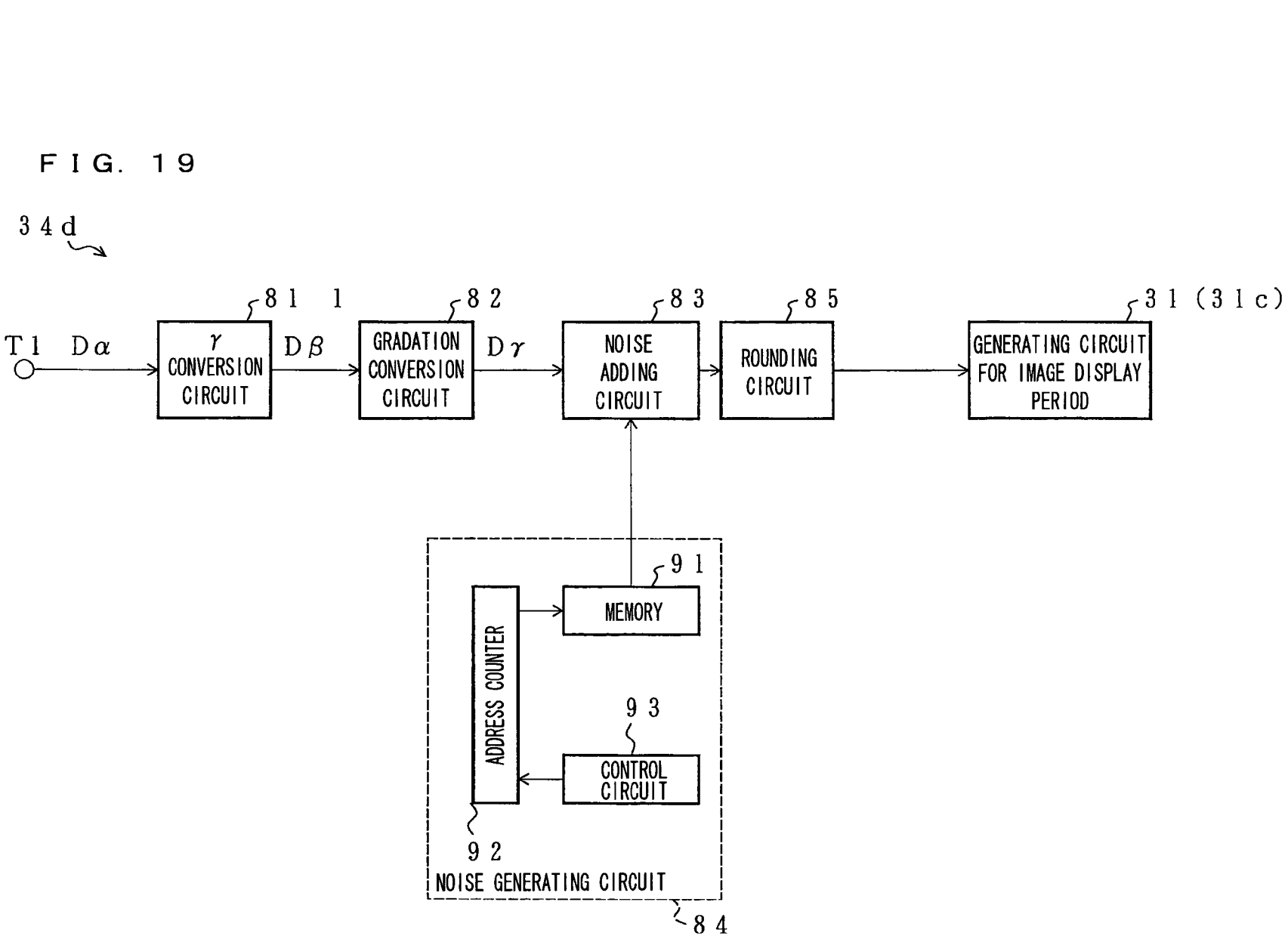
FIG. 19 is a block diagram showing a main structure of a gradation conversion section provided in the signal processing section.

To be specific, a pixel array 2*d* (see FIG. 2) of the present modification example is configured so as to include γ characteristics larger than γ of video data Dα for each pixel PIX to be supplied to an input terminal T1. As illustrated in FIG. 19, the gradation conversion section 34*d* includes a BDE (Bit-Depth Extension) circuit including: a γ conversion circuit 81 for performing γ conversion of the video data D for each pixel PIX to be supplied to the input terminal T1, thereby converting the video data D into video data Dβ to be displayed by a display device having larger γ characteristics; a gradation conversion circuit 82 for generating video data Dγ by compressing a numeral range which the video data Dβ can indicate, the video data Dγ allowing for displaying a value which has the same bit width as the video data Dβ and which is lower than a black level of the video data Dβ; a noise adding circuit 83 for adding a noise generated by a noise generating circuit 84 to the video data Dγ and outputting video data thus generated; and a rounding circuit 85 (rounding means) for rounding lower bits of each video data supplied from the noise adding circuit 83 so as to reduce a bit width of the video data. Video data D supplied by the rounding circuit 85 is supplied to the generating circuit 31 for an image display period as video data of a current frame FR(k).

In the present modification example, video data (Dα) to be displayed by a display device having characteristics of γ=2.2 is supplied as a general video signal to the input terminal T1. γ characteristics of the pixel array 2*d* is set so that γ=2.8. Further, the γ conversion circuit 81 generates video data Dβ having the same characteristics as γ characteristics of the pixel array 2*d*, that is, video data Dβ to be displayed by a display device having characteristics of γ=2.8. Further, in order to prevent errors due to γ conversion, the γ conversion circuit 81 of the present modification example converts video data D into video data Dβ having a wider bit width.

For example, video data of 8 bits is supplied to the input terminal T1 as a general video signal with respect to each color. The γ conversion circuit 81 converts video data Dα of 8 bits into video data Dβ of 10 bits.

Figure 20:
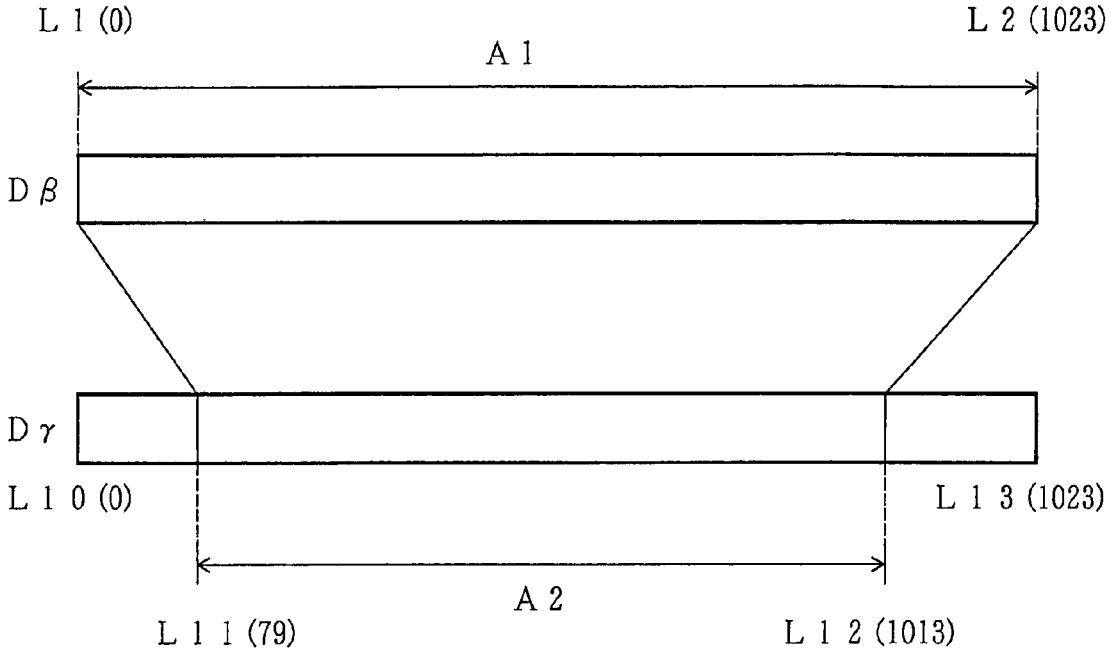
FIG. 20 is a drawing showing a gradation conversion operation performed by the gradation conversion section.

Further, as illustrated in FIG. 20, the gradation conversion circuit 82 compresses a numeral range A1 which the video data Dβ can indicate so that the numeral range A1 is converted into a numeral range A2 narrower than the numeral range A1. Further, the numeral range A2, that is, a range from gradations L11 to L12 is set so that: when video data Dγ can indicate gradations L10 to 13, relations L10<L11 and L12<L13 are satisfied. In the present modification example, each of video data Dβ and Dγ is of 10 bits, L1=L10=0, L2=L13=1023, and L11 and L12 are set to 79 and 1013, respectively, for example. In the video data Dβ, a minimum gradation (L1) indicates black and a maximum gradation (L2) indicates white.

On the other hand, the noise generating circuit 84 generates a noise with a randomness allowing for preventing a false outline in an image displayed by the pixel array 2*d*. Further, if a maximum value of noise data is too large, a noise pattern may be recognized by a user of the image display device 1*d*. For that reason, the maximum value of noise data is set so that a noise pattern is not recognized.

In the present modification example, video data Dγ(i,j,k) for each pixel PIX(i,j) to be supplied to the noise adding circuit 83 is of 10 bits and the size of noise data is within ±7 bits.

The noise generating circuit 85 may be one of various calculating circuits such as a calculating circuit including a linear feedback shift register (e.g. M series or Gold series). The noise generating circuit 85 of the present modification example includes: a memory 91 in which noise data corresponding to a predetermined block such as 16×16 or 32×32 is stored; an address counter 92 for serially reading noise data from the memory 91; and a control circuit 93 for generating a reset signal which resets the address counter 92.

The control circuit 93 resets the address counter 92 so that identical noise data is added to video data D(i,j,*) for an identical pixel PIX(i,j) throughout whole frames. For example, in the present modification example, the control circuit 93 resets the address counter 92 in synchronization with at least one of a horizontal synchronization signal and a vertical synchronization signal both transmitted along with video data from the video signal source S0 in FIG. 2. As a result, the noise adding circuit 84 can add identical noise data to video data D(i,j,*) for an identical pixel PIX(i,j) throughout whole frames. Therefore, when the image display device 1*d* displays a still image on the pixel array 2*d*, it is possible to display a stable still image without flicker or noise due to temporal change in noise data. Here, indicates any value.

Note that, random noise data is stored in the memory 91. Consequently, random noise data is added to video data to be supplied to pixels PIX in one block and therefore a false outline does not occur in an image displayed on the pixel array 2*d*.

The rounding circuit 85 rounds lower 2 bits out of 10-bit video data supplied from the noise generating circuit 84 and outputs 8-bit video data D(i,j,k). Therefore, a storage area in which each video data D1(*i,j,k*) of a current frame FR(k) is stored has 8-bit capacity with respect to each video data D(i,j,k).

Rounding performed by the rounding circuit 85 may be rounding down or rounding up. Further, the rounding may be a process in which rounding down or rounding up is selected according to whether data exceeds a predetermined threshold value or not, such as rounding in the decimal system in which 4 or less is rounded down and 5 or more is rounded up (rounding in the binary system in which 0 is rounded down and 1 is rounded up). Note that, in the case of rounding down, it is unnecessary to change upper digits. Therefore, if simpler rounding is requested, the rounding circuit 85 preferably performs rounding down so as to round lower bits.

As described above, rounding is performed after a noise is added. Consequently, while an image displayed on the pixel array 2*d* does not have a noise pattern or a false outline and is not apparently different from a case where video data D before rounding is displayed, it is possible to reduce the number of bits of video data processed in a circuit in a subsequent stage of the rounding circuit 85.

Added noise is recognized by a user of the image display device 1*d* as how different an observed gradation is from gradations of surrounding pixels (regulation) and how different the observed gradation is from a gradation of target luminance (error). It is known that: in a display device such as the image display device 1*d* in which image display is performed with 100 ppi as a standard, tolerance limit of the error is approximately 5% of white luminance and tolerance limit of the regulation is approximately 5% of display gradations.

It was calculated how much percentage transmittance of a pixel increases compared with surrounding luminance (transmittance before a gradation increases), if a gradation displayed on the pixel PIX increases by x gradation. The result of the calculation showed that: in a case where γ characteristics of the pixel array 2*d* is γ=2.8 and video data Dγ is of 10 bits, if x ranges from 32-gradation to 48-gradation, the regulation is within the tolerance limits with respect to almost all gradations. In the same manner, It was calculated how much percentage transmittance of a pixel increases compared with original luminance (transmittance before a gradation increases), if a gradation displayed on the pixel PIX increases by x gradation. The result of the calculation showed that: in a case where γ characteristics of the pixel array 2*d* is γ=2.8 and video data Dγ is of 10 bits, if x ranges from 32-gradation to 48-gradation, the regulation is within the tolerance limits with respect to almost all gradations. Consequently, when the noise corresponds to 32-gradation to 48-gradation, the regulation and the error are within the tolerance limits with respect to almost all gradations, allowing a user to consider that apparent display quality does not drop.

Therefore, in a case where it is expected that a user see image display at a distance not allowing the user to see a pixel itself, the regulation and the error should be set to be lower than 5% among 2 to 3 (6 to 9) pixels. Here, if the noise data is in substantially normal distribution, 32 to 48 [gradation]×6 (1/2) to 9(1/2)=80 to 144 [gradation]. Therefore, if a fixed noise of approximately 7 bits, that is, of a bit width smaller than that of video data Db by approximately 3 bits is sequentially added, there is no possibility that a noise pattern is recognized by a user of the image display device.

Here, in general, although pixel size gets larger, a distance between a viewer and pixels does not get so large as to be in proportion to the enlargement of the pixel size. Consequently, as the pixel size gets larger, tolerance level of noise data gets lower. Therefore, out of a numeral range from 1-gradation to 144-gradation (within 7 bits), a numeral range preferably used as the maximum value of an absolute value of the noise data in image display devices ranges from 48-gradation to 80-gradation, more preferably 63-gradation (6 bits).

In the above arrangement, the gradation conversion section 34*d* is provided in a previous stage of the generating circuit 31 for an image display period. The gradation conversion section 34*d* converts video data D to be supplied to the generating circuit 31 so that the video data D has only gradations larger than a predetermined gradation (L11). Consequently, the generating circuit 32 for a blanking period can use gradations lower than the above gradations (L10 and L11) to adjust video data Db for a blanking period at a time when a gradation transition is performed. As a result, even though circuits in subsequent stages of the control circuit 12 is not changed, the above inconvenience does not occur, and even when luminance decreases, it is possible to correct an output signal Ob for a blanking period without any problem.

Further, the pixel array 2*d* is configured so as to have γ characteristics larger than those of video data (Dα) to be supplied to the input terminal T1. The video data Dα supplied to the input terminal T1 is converted by the γ conversion circuit 81 into video data Dβ having further larger γ characteristics, and is converted by the gradation conversion circuit 82 into video data Dγ allowing for displaying a lower value than a black level of the video data Dβ, and then the video data Dγ is supplied to the generating circuit 31 for an image display period.

Figure 21:
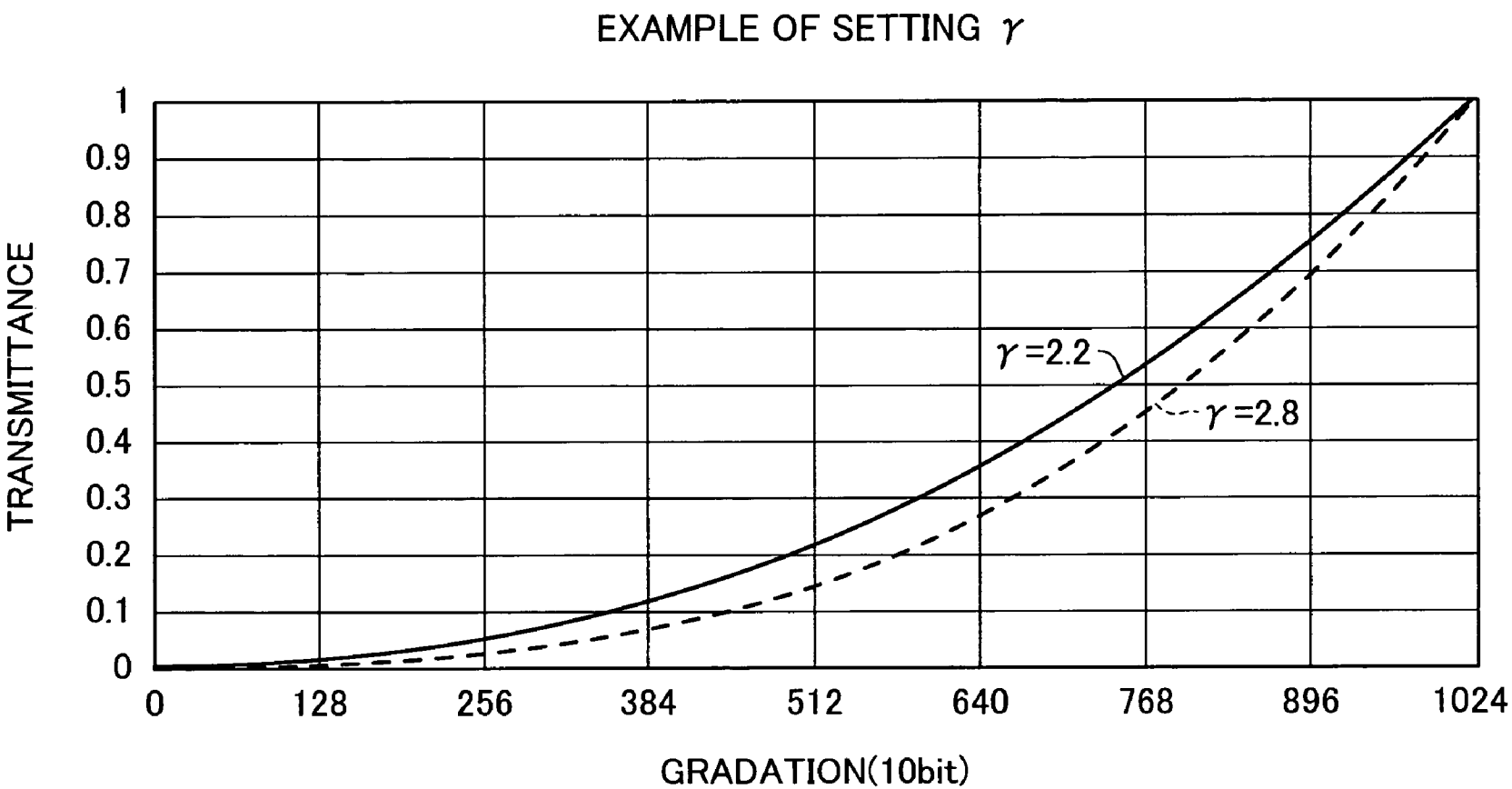
FIG. 21 is a graph showing a gamma conversion performed by the gradation conversion section.
Figure 22:
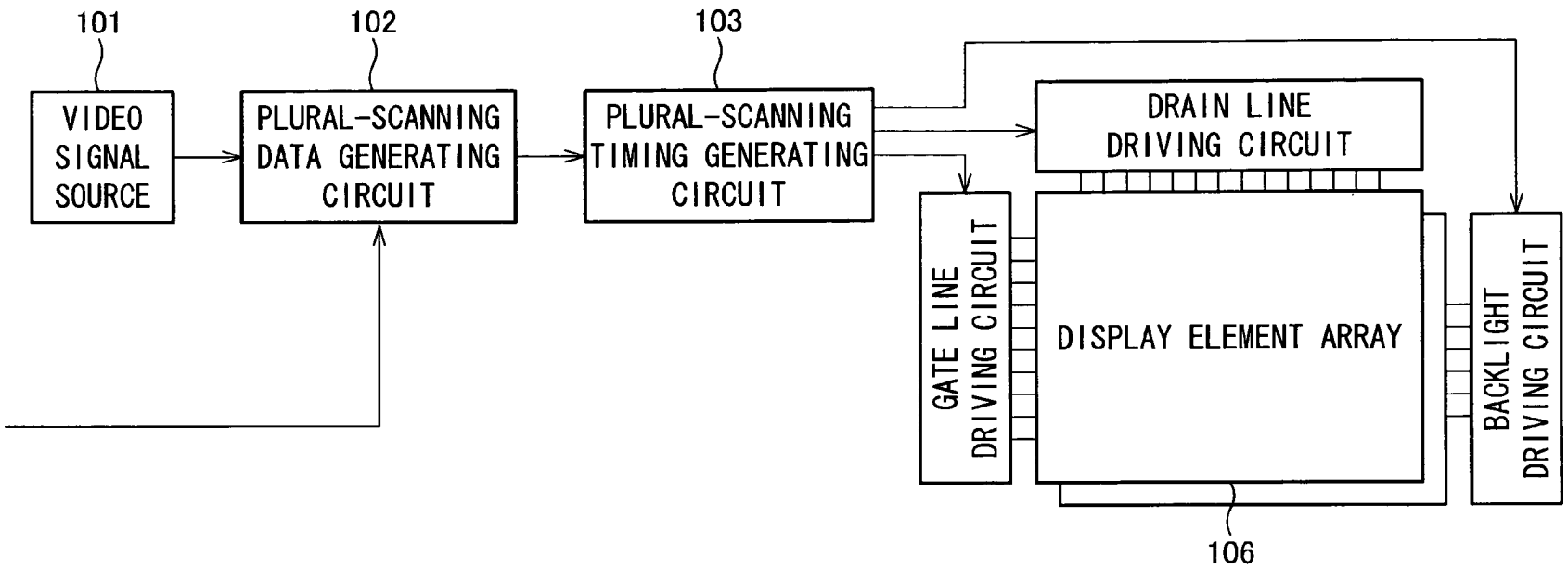
FIG. 22 is a system block diagram showing a conventional liquid crystal display device.
Figure 23:
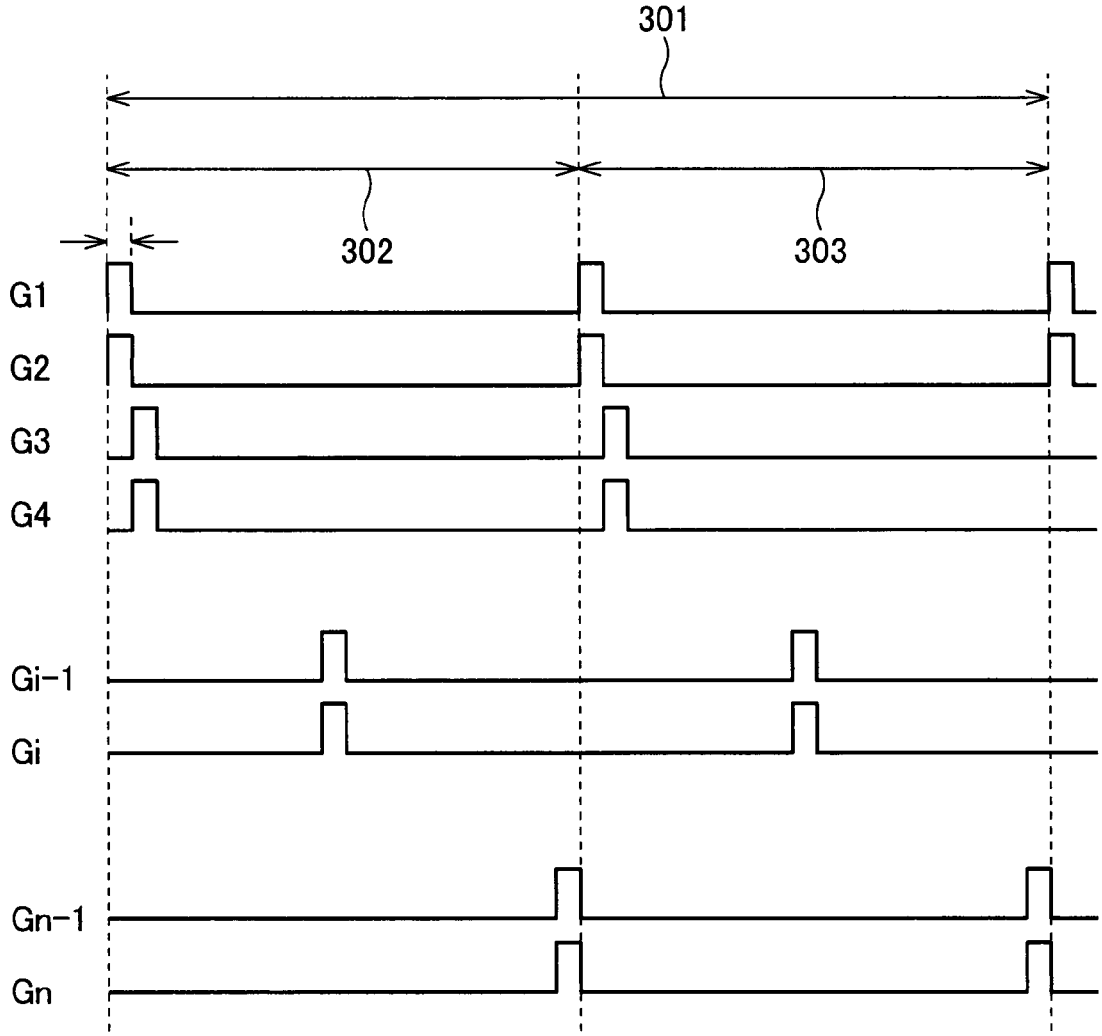
FIG. 23 is a timing chart for a gate selection pulse of a conventional liquid crystal display device.
Figure 24:
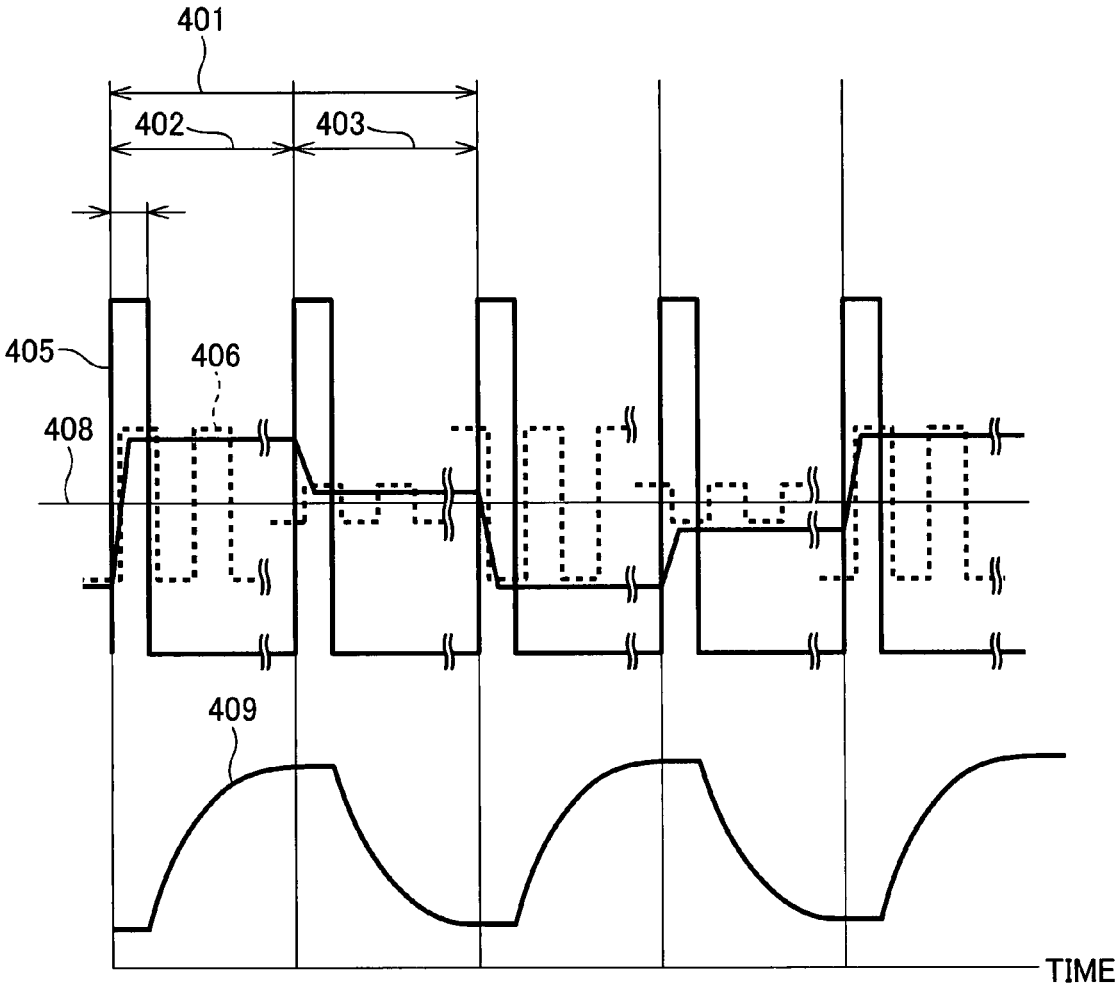
FIG. 24 is a graph showing each signal line driving waveform of a conventional liquid crystal device and an optical response waveform of a display element.
Figure 25:
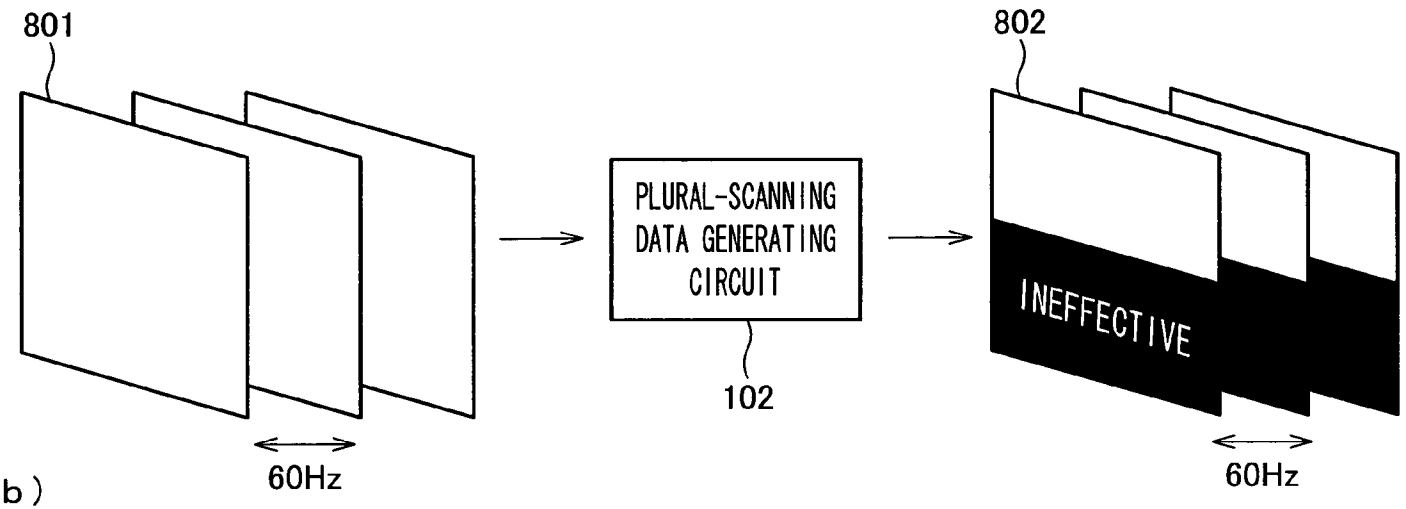
FIG. 25(*a*) is a conceptual drawing, showing how video data is generated in a conventional liquid crystal display device.
Figure 25:
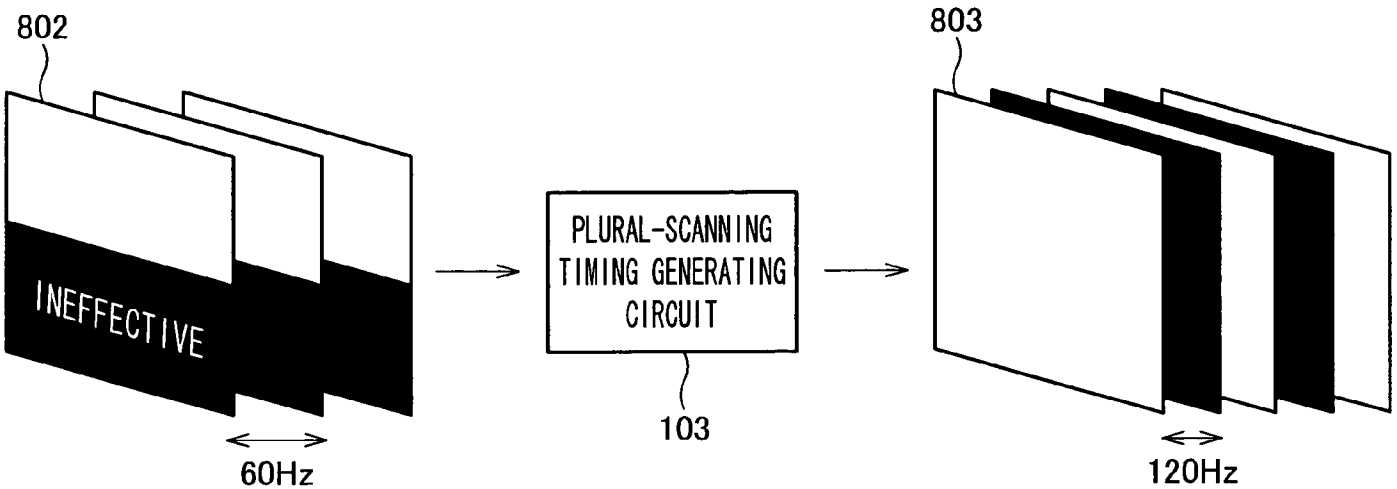
Figure 26:
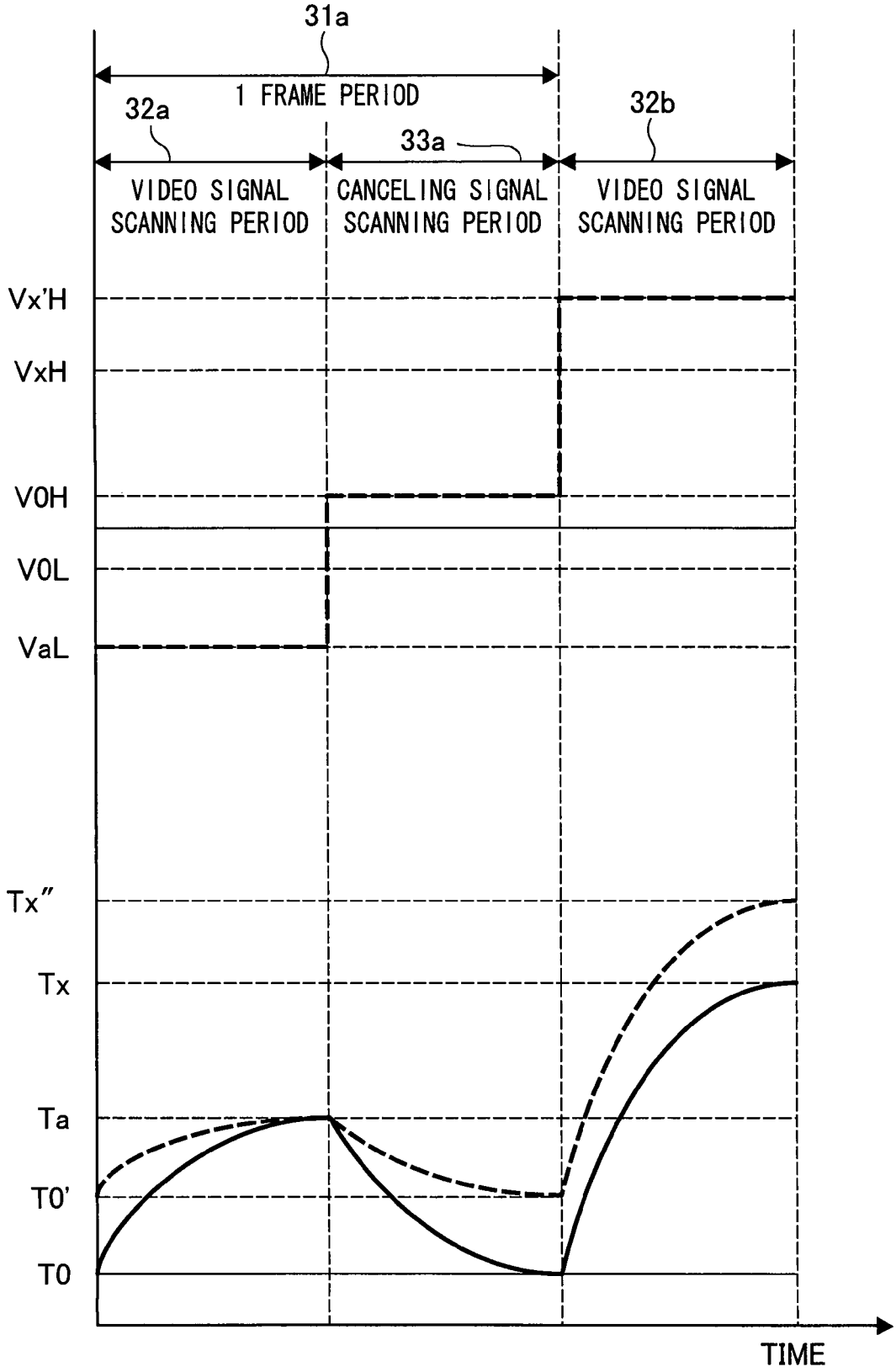
FIG. 26 is a graph showing an output signal waveform and optical response waveforms in a conventional liquid crystal display device.

Therefore, as illustrated in FIG. 21, more number of gradations are made black by γ conversion when the pixel PIX displays the gradations. In addition, predetermined gradations (gradations L10 and L11 in FIG. 20) out of the gradations are assigned to gradations lower than a black level of the video data Dα. As a result, compared with the arrangement in which the gradation conversion section 34*d* is not provided, the generating circuit 32 for a blanking period can greatly change the video data D so that gradations are decreased. Therefore, even in a case where a gradation transition for greatly decreasing luminance is performed and it is necessary to greatly correct video data Db for a blanking period so as to perform appropriate correction, it is possible to adjust the video data Db without any problem.

Further, in the above arrangement, rounding is performed after a noise is added. Consequently, although a numeral range used for normal video data (a numeral range larger than that of the predetermined gradation) out of a numeral range of video data to be supplied to the generating circuit 31 is narrower than a numeral range of video data to be supplied to the input terminal T1, an image displayed on the pixel array 2*d* does not have a noise pattern or a false outline and is not apparently different from a case where video data D before rounding is displayed.

Note that, an explanation was made above as to a case where a noise to be added by the noise adding circuit 84 to video data (i,j,*) is fixed chronologically and always identical noise is added to video data Dγ to be supplied to a pixel PIX(i,j). Alternatively, the same effect can be obtained if a noise to be added by the noise adding circuit 84 to video data Dγ is changed chronologically.

For example, if the control circuit 93 changes a phase difference between reset timing of the address counter 92 and first video data D(1,1,k) of a frame FR(k) with respect to each frame, it is possible to chronologically change a noise.

An explanation was made above as to a case where a maximum value of a noise generated by a noise generating circuit is constant. Alternatively, the same effect can be obtained if a gradation indicated by video data D(i,j,k) to be supplied to the input terminal T1 is detected and a maximum value of a noise generated by the noise generating circuit is changed in accordance with the gradation.

In the present modification example, the gradation conversion section 34*d* is provided in a previous stage of the generating circuit 31 for an image display period. Alternatively, the gradation conversion section 34*d* may be provided between the generating circuit 31 for an image display period and the generating circuit 32 for a blanking period as long as the gradation conversion circuit 34*d* is provided in a previous stage of the generating circuit 32. Note that, in the case where the gradation conversion section 34*d* is provided in a previous stage of the generating circuit for an image display period as with the present embodiment, even if the generating circuit 31*c* for an image display period emphasizes a gradation transition as with Embodiment 4, it is possible to prevent a phenomenon in which an unpredictable noise is added to video data whose gradation transition is emphasized and the noise is recognized by a user. Consequently, it is possible to display an image with higher quality.

An explanation was made above as to a case where the generating circuit for a blanking period corrects an output signal Ob for a blanking period with respect to all cases where video data D to be supplied to a pixel PIX changes so that luminance of the pixel PIX rises or decays. Alternatively, the present invention may be arranged so that an output signal Ob for a blanking period is corrected with respect to only a change to be corrected.

In the above embodiments, an explanation was made as to a case where a liquid crystal cell in vertical alignment mode and normally black mode is used as a display element. Substantially the same effect can be obtained as long as there is used a display element in which response speed is low and therefore a difference is caused between an actual gradation transition and a desired gradation transition in a gradation transition from a previous frame to a current frame even if the gradation transition is emphasized.

At present, a liquid crystal cell does not have enough response speed to perform image display with a blanking period. Therefore, it is particularly effective if any one of the driving sections 14 to 14*d* of Embodiments 1 to 4 is used as a driving device for driving a liquid crystal cell such as a liquid crystal TV receiver or a liquid crystal monitor.

In the embodiments, explanations were made as to a case where members constituting the signal processing section (21 to 21*d*) are realized entirely by means of hardware. Alternatively, the members may be realized entirely or partly by a combination of a computer program providing the aforementioned functions and hardware (computer) executing the program. An example of such a signal processing section is a computer being connected to the image display device 1 to act as a device driver driving the image display device 1. In addition, if the signal processing section can be realized as an built-in or external conversion board to the image display device 1, and the operation of a circuit providing the signal processing section is alterable by rewriting firmware or another computer program, the software may be distributed by distributing a storage medium which stores the software or transmitting the software via transmission path so that the hardware executes the software and functions as the signal processing section of the embodiments.

In these cases, if hardware capable of executing the aforementioned functions is prepared, the signal processing section in accordance with the embodiments can be realized simply by having the hardware execute the computer program.

To be specific, in the case of realizing the signal processing section by software, the signal processing section in accordance with the embodiments can be realized by having CPU or computing means including hardware capable of executing the above function execute a program code stored in a ROM, RAM, or other storage medium, and control a marginal circuit (not shown) such as an input/output circuit.

At that time, the signal processing section can be realized by a combination of hardware carrying out some of the processes and the computing means controlling the hardware and executing program code for the other processes. Further, those members which were described as hardware may be realized by a combination of hardware carrying out some of the processes and the computing means controlling the hardware and executing program code for the other processes. The computing means may be a single entity, or a set of computing means connected over internal device bus and various communications paths may work together to execute program code.

The program code itself directly executable by the computing means or the program as data that can generate program code by decompression or other process (detailed later) is executed by the computing means after the program (program code or the data) is recorded and distributed on a storage medium or the program is transmitted and distributed over communications means which transmits the program over wired or wireless communications paths.

To transmit over a communications path, a program is transmitted through the communications path by means of a series of signals indicative of a program which propagate through the transmission media constituting the communications path. To transmit a series of signals, a transmitter device may modulate a carrier wave with the series of signals indicative of the program to transmit the series of signals on the carrier wave. In this case, a receiver device will restore the series of signals by demodulating the carrier wave. Meanwhile, when transmitting the series of signals, the transmitter device may divide the series of signals as a series of digital data into packets for a transmission. In this case, the receiver device will combine received group of packets to restore the series of signals. In addition, the transmitter device may transmit the series of signals by time division, frequency division, code division, or another multiplex scheme involving the series of signals and another series of signals. When this is the case, the receiver device will extract individual series of signals from a multiplex series of signals to restore them. In any case, similar effects are obtained if the program can be transmitted over a communications path.

Here, the storage medium for the distribution of a program is preferably removable. After the distribution of the program, the storage medium may or may not be removable. In addition, the storage medium may or may not be rewritable (writable) or volatile, be recordable by any method, and come in any shape at all, provided that the medium can hold the program. Examples of such a storage medium include tapes, such as magnetism tapes and cassette tapes; magnetic disks, such as floppy (registered trademark) disks and hard disks; and other discs, such as CD-ROMs, magneto-optical discs (MOs), mini discs (MDs), and digital video discs (DVDs). In addition, the storage medium may be a card, such as an IC card or an optical card; a semiconductor memory, such as a mask ROM, an EPROM, an EEPROM, or a flash ROM; or a memory provided inside a CPU or other computing means.

The program code may be such that it instructs the computing means regarding all the procedures of the processes. If there is already a basic computer program (for example, an operating system or library) which can be retrieved by a predetermined procedure to execute all or some of the processes, code or a pointer which instructs the computing means to retrieve that basic computer program can replace all or some of the processes.

In addition, the program storage format of the storage medium may be, for example, such that: the computing means can access the program for an execution as in an actual memory having loaded the program; the program is not loaded into an actual memory, but installed in a local storage medium (for example, an actual memory or hard disk) always accessible to the computing means; or the program is stored before installing in a local storage medium from a network or a mobile storage medium. In addition, the program is not limited to compiled object code. The program may be stored as source code or intermediate code generated in the course of interpretation or compilation. In any case, similar effects are obtained regardless of the format in which the storage medium stores the program, provided that decompression of compressed information, decoding of encoded information, interpretation, compilation, links, or loading to a memory or combinations of these processes can convert into a format executable by the computing means.

In order to solve the foregoing problems, a method of the present invention for driving a display device includes the steps of: (i) the step of displaying an image by supplying an output signal for an image display period to a pixel of the display device so as to control luminance of the pixel, the output signal corresponding to a video signal indicative of an image to be displayed by the display device, the step (i) being performed repeatedly; and (ii) the step, performed between the steps (i), of controlling blanking by supplying an output signal for a blanking period to the pixel so that luminance of the pixel does not exceed luminance of the pixel in at least predetermined one of the steps (i) between which the step (ii) is performed or so that luminance of the pixel becomes predetermined luminance for dark display, in the step (ii), when a change from first luminance to second luminance is a predetermined one where the first and second luminances are luminances indicated by output signals for image display periods in the steps (i) before and after the step (ii), the output signal for a blanking period being corrected so that the output signal for a blanking period has luminance which is corrected in a same direction as a direction of the change from the first luminance to the second luminance, the direction being a direction in which the luminance increases or decreases compared with an output signal for a blanking period obtained in a case where the first luminance is identical with the second luminance.

In order to solve the foregoing problems, a method of the present invention for driving a display device includes the steps of: (i) the step of displaying an image by supplying an output signal for an image display period to a pixel of the display device so as to control luminance of the pixel, the output signal corresponding to a video signal indicative of an image to be displayed by the display device, the step (i) being performed repeatedly; and (ii) the step, performed between the steps (i), of controlling blanking by supplying an output signal for a blanking period to the pixel so that luminance of the pixel does not exceed luminance of the pixel in at least predetermined one of the steps (i) between which the step (ii) is performed or so that luminance of the pixel becomes predetermined luminance for dark display, in the step (ii), when a change from first luminance to second luminance is a predetermined one where the first and second luminances are luminances indicated by output signals for image display periods in the steps (i) before and after the step (ii), the output signal for a blanking period being corrected in accordance with the first luminance and the second luminance.

In order to solve the foregoing problems, a method of the present invention for driving a display device includes the steps of: (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the generating being repeatedly performed based on gradation data supplied as gradation data to the pixel; and (ii) outputting in a predetermined order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, outputting gradation data indicative of a gradation which is corrected in a same direction as a direction of the gradation transition, the direction being a direction in which the gradation increases or decreases compared with gradation data for a blanking period obtained in a case where a gradation indicated by the previous gradation data and a gradation indicated by the current gradation data are identical with each other, the gradation data thus outputted being regarded as gradation data for a blanking period to be supplied between gradation data for an image display period supplied in the step (i) based on the previous gradation data and gradation data for an image display period supplied in the step (i) based on the current gradation data.

In order to solve the foregoing problems, a method of the present invention for driving a display device includes the steps of: (i) generating (a) gradation data for an image display period which is to be supplied to a pixel of the display device and (b) gradation data for a blanking period which is to be supplied to the pixel and is indicative of a gradation not brighter than a gradation indicated by the gradation data for an image display period or of a predetermined gradation for dark display, the generating being repeatedly performed based on gradation data supplied as gradation data to the pixel; and (ii) outputting in a predetermined order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, correcting gradation data for a blanking period supplied between gradation data for an image display period supplied in the step (i) based on the previous gradation data and gradation data for an image display period supplied in the step (i) based on the current gradation data, the correcting being performed based on the previous gradation data and the current gradation data.

Further, in addition to the arrangement, the present invention may be arranged so that the predetermined change or the predetermined gradation transition indicates an increase in luminance of a pixel, and when an increase in luminance is indicated, the blanking controlling means corrects the output signal or the gradation data for a blanking period so that luminance of the pixel increases during the blanking period.

With the arrangement, blanking controlling means, which corrects an output signal in a case of a predetermined change, corrects an output signal so that luminance of a pixel during a blanking period increases when a change from first luminance to second luminance is a change indicative of rising of luminance of the pixel. In the same manner, blanking controlling means, which corrects gradation data in a case of a predetermined gradation transition, corrects gradation data so that luminance of a pixel during a blanking period increases when a gradation transition from luminance indicated by previously supplied gradation data to luminance indicated by currently supplied gradation data indicates rising of luminance of the pixel.

Here, a change in luminance of a pixel during a blanking period is basically a change for decreasing luminance. Therefore, when an output signal or gradation data for a blanking period is corrected so that luminance of the pixel increases during the blanking period, a change in luminance weakens. Therefore, unlike correction for emphasizing a change in luminance, even if a numeral range for outputting an emphasized output signal or gradation data for a blanking period is not positioned out of a numeral range for an outputting output signal or gradation data for a blanking period in a steady state, the output signal or the gradation data for a blanking period is surely corrected. As a result, it is possible to correct an output signal or gradation data for a blanking period, without deteriorating image quality in a display device in a steady state.

Further, in addition to the arrangement, the present invention may be arranged so as to include generating means for generating, as the gradation data for an image display period, gradation data identical with supplied gradation data.

With the arrangement, the generating means generates gradation data identical with supplied gradation data. Consequently, it is unnecessary to provide means (such as a table) for correcting a gradation so as to generate gradation data for an image display period. Therefore, the arrangement can be simpler than an arrangement in which the means for correcting a gradation is provided.

Further, in addition to the arrangement, the present invention may be arranged so that: when a change or a gradation transition is not the predetermined one, the blanking controlling means controls an output signal for a blanking period or gradation data for a blanking period so that the output signal or the gradation data has a predetermined value.

With the arrangement, the output signal or the gradation data for a blanking period is controlled so as to have a predetermined value. Therefore, it is possible to surely increase image quality in displaying moving images by inserting a blanking period with a simpler arrangement than the arrangement in which an output signal or gradation data for a blanking period is changed.

Further, in a case where the blanking controlling means controls gradation data, the present invention may be arranged so that the supplied gradation data is indicative of one of 256 gradations, and when a gradation transition is not the predetermined one, the blanking controlling means controls the gradation data for a blanking period so that the gradation data has a predetermined value of more than 0-gradation and not more than 32-gradation.

With the arrangement, gradation data for a blanking period is controlled so as to be a predetermined value. Therefore, it is possible to surely increase image quality in displaying moving images by inserting a blanking period with a simpler arrangement than the arrangement in which gradation data for a blanking period is changed.

Further, with the arrangement, as the gradation data for a blanking period is set to 32-gradation or less, it is possible to cause luminance of a pixel during a blanking period to be luminance which does not cause dark gray display instead of black display (low contrast ratio) to a problematic extent when comparatively prevailing gradation data whose gamma value is 2.2 is supplied. Further, as the gradation data for a blanking period is set to a value of more than 0-gradation, it is possible to cause a pixel to respond with a sufficient speed, even if a liquid crystal cell in vertical alignment mode and in normally black mode is used as a display panel including a pixel in a display device and a direction in which liquid crystal molecules are to be inclined is not controlled in black display unlike other color display and therefore response speed greatly deteriorates.

Further, in addition to the arrangement, the present invention may be arranged so that: when a change or a gradation transition is not the predetermined one, the blanking controlling means controls an output signal or gradation data for a blanking period so that the output signal or the gradation data is in accordance with an output signal or gradation data for an image display period adjacent to the blanking period.

With the arrangement, when a change from first luminance to second luminance is not a predetermined change, the blanking controlling means controls an output signal for a blanking period in accordance with an output signal for an image display period. In the same manner, when a gradation transition from luminance indicated by previously supplied gradation data to luminance indicated by currently supplied gradation data is not a predetermined gradation transition, the blanking controlling means controls gradation data for a blanking period in accordance with the gradation data for an image display period.

Further, in addition to the arrangement, the present invention may be arranged so that data indicative of a gradation displayed by a pixel is supplied to the driving device as video data to the pixel, and when a gradation transition is not the predetermined one, the blanking controlling means controls the gradation data for a blanking period so that the gradation data is a multiplication of the gradation indicated by the video data and a constant value.

Here, as luminance of a pixel during a blanking period is darker, image quality in displaying moving images is more improved, but brightness of a screen of a display device drops. For that reason, it is desirable that an output signal or gradation data for a blanking period in a steady state is set to a value allowing for both increasing image quality in displaying moving images and increasing brightness of the screen with a good balance.

However, output signals or gradation data during blanking periods necessary for improving, to an equal extent, image quality in displaying moving images have different values if luminances during image display periods which are adjacent to the blanking periods are different from each other. As luminance during an image display period is higher, luminance necessary for improving image quality to an equal extent is higher.

Therefore, in the arrangement in which an output signal or gradation data for a blanking period in a steady state is fixed, it is necessary to determine luminance during the blanking period so that image quality in displaying moving images is improved even in relatively dark display. This makes it difficult to sufficiently improve brightness of the screen.

On the other hand, each of the arrangements controls an output signal or gradation data for a blanking period so that the output signal or the gradation data is in accordance with an output signal or gradation data for an image display period adjacent to the blanking period. Consequently, it is possible to realize a display device capable of increasing image quality in displaying moving images and increasing brightness of the screen at a higher level and with better balance than the arrangement in which an output signal or gradation data for a blanking period in a steady state is fixed.

Further, in addition to the arrangement, the present invention may be arranged so that at least a part of the predetermined gradation transition indicates a decrease in luminance of a pixel, and said device further comprising gradation converting means for converting the supplied gradation data so that the gradation data includes only a gradation brighter than a predetermined gradation. The predetermined gradation is preferably gradation data for a blanking period.

With the arrangement, the supplied gradation data is converted by the gradation converting means so that the gradation data is indicative of only a gradation brighter than the predetermined gradation. Consequently, the blanking controlling means can adjust image data for a blanking period so that luminance decreases. Therefore, even if at least a part of the predetermined gradation transition indicates decay of luminance of a pixel, the blanking controlling means can cause luminance of the pixel at the end of the second image display period to be closer to a desired value without inconvenience. As a result, it is possible to prevent deterioration in image quality due to response delay during the second image display period, even if luminance of the pixel decreases. Consequently, it is possible to provide a display device capable of displaying moving images with high quality.

Further, in addition to the arrangement, the present invention may be arranged so that the gradation converting means converts the supplied gradation data so that the gradation data has a deeper gradation depth and the gradation converting means outputs the gradation data thus converted, and the gradation converting means includes rounding means for adding noise information to the gradation data converted by the gradation converting means and then rounding the gradation data to which the noise information is added. The noise information may be a value which is random in time or space. The rounding may be rounding down or rounding up. Further, the rounding may be a process in which rounding down or rounding up is selected according to whether data exceeds a predetermined threshold value or not, such as rounding in the decimal system in which 4 or less is rounded down and 5 or more is rounded up (rounding in the binary system in which 0 is rounded down and 1 is rounded up).

With the arrangement, the supplied gradation data is converted so that the gradation data has a deeper gradation depth. Therefore, it is possible to prevent calculation errors due to gradation conversion. Further, noise information is added to the supplied gradation data after the gradation conversion and then the gradation data is rounded. Therefore, unlike an arrangement in which false outlines are generated in an image displayed by pixels due to rounding without adding noise information, the present arrangement allows for preventing false outlines due to rounding. Therefore, it is possible to prevent deterioration in image quality due to gradation conversion and rounding. Consequently, it is possible to provide a display device capable of displaying moving images with high quality.

Further, in addition to the arrangement, the present invention may be arranged so that the gradation converting means converts a gamma value of gamma characteristics of the supplied gradation data to be larger. With the arrangement, more number of gradations are made black in display compared with an arrangement in which gamma conversion is not performed. Therefore, it is possible to provide a display device capable of displaying moving images with high quality, in which there are provided gradations allowing the blanking controlling means to control video data for a blanking period so that luminance decreases, while preventing too much deterioration in image quality.

The driving device may be realized by hardware or causing a computer to execute a program. To be specific, a program of the present invention is a program causing a computer to function as each means of the driving device. The program is stored in a storage medium of the present invention.

When the program is execute by a computer, the computer functions as the driving device. Therefore, as with the driving device, it is possible to prevent deterioration in image quality due to response delay in the second image display period. Consequently, it is possible to provide a display device capable of displaying moving images with high quality.

Further, a display device of the present invention includes any one of the driving devices. Therefore, as with the driving device, it is possible to prevent deterioration in image quality due to response delay in the second image display period. Consequently, it is possible to display moving images with high quality.

Further, in addition to the arrangement, the display device of the present invention may be a TV receiver which uses a liquid crystal as the pixel. Further, in addition to the arrangement, the display device of the present invention may be a liquid crystal monitor which uses a liquid crystal as the pixel and which displays a video signal.

At present, a liquid crystal cell does not have enough response speed to perform image display with a blanking period. Therefore, a display device including the driving device can be preferably used as a liquid crystal TV receiver or a liquid crystal monitor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

In the present invention, by correcting an output signal or gradation data for a blanking period, it is possible to prevent deterioration in image quality due to response delay of a pixel at a time when luminance to be displayed during an image display period changes. Consequently, it is possible to display moving images with high quality. Therefore, the present invention is preferably applicable to driving various display devices such as liquid crystal TV receivers and liquid crystal monitors.

The invention claimed is:

1. A method for driving a liquid crystal display device which uses a liquid crystal as a pixel, said method comprising the steps of:

(i) the step of displaying an image by supplying an output signal for an image display period to a the pixel of the liquid crystal display device so as to control luminance of the pixel, the output signal corresponding to a video signal indicative of an image to be displayed by the liquid crystal display device, the step (i) being performed repeatedly; and (ii) the step, performed between the steps (i), of controlling blanking by supplying an output signal for a blanking period to the pixel so that luminance of the pixel does not exceed luminance of the pixel in at least one of the steps (i) between which the step (ii) is performed or so that luminance of the pixel becomes a luminance for dark display, in the step (ii), when a change from first luminance to second luminance is a predetermined one where the first and second luminances are luminances indicated by output signals for image display periods in the steps (i) before and after the step (ii), the output signal for a blanking period being corrected so that the output signal for a blanking period has luminance which is corrected in a same direction as a direction of the change from the first luminance to the second luminance, the direction being a direction in which the luminance increases or decreases compared with an output signal for a blanking period obtained in a case where the first luminance is identical with the second luminance.

2. A method for driving a liquid crystal display device which uses a liquid crystal as a pixel, said method comprising the steps of:

(i) the step of displaying an image by supplying an output signal for an image display period to the pixel of the liquid crystal display device so as to control luminance of the pixel, the output signal corresponding to a video signal indicative of an image to be displayed by the liquid crystal display device, the step (i) being performed repeatedly; and (ii) the step, performed between the steps (i), of controlling blanking by supplying an output signal for a blanking period to the pixel so that luminance of the pixel does not exceed luminance of the pixel in at least one of the steps (i) between which the step (ii) is performed or so that luminance of the pixel becomes a luminance for dark display, in the step (ii), when a change from first luminance to second luminance is a predetermined one where the first and second luminances are luminances indicated by output signals for image display periods in the steps (i) before and after the step (ii), the output signal for a blanking period being corrected in accordance with the first luminance and the second luminance.

3. A method for driving a liquid crystal display device which uses a liquid crystal as a pixel, said method comprising the steps of:

(i) generating (a) gradation data for an image display period which is to be supplied to the pixel of the liquid crystal display device and (b) gradation data for a blanking period which is to be supplied to the pixel and is indicative of a gradation not brighter than a gradation indicated by the gradation data for an image display period or of a gradation for dark display, the generating being repeatedly performed based on gradation data supplied as gradation data to the pixel; and (ii) outputting in an order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, outputting gradation data indicative of a gradation which is corrected in a same direction as a direction of the gradation transition, the direction being a direction in which the gradation increases or decreases compared with gradation data for a blanking period obtained in a case where a gradation indicated by the previous gradation data and a gradation indicated by the current gradation data are identical with each other, the gradation data thus outputted being regarded as gradation data for a blanking period to be supplied between gradation data for an image display period supplied in the step (i) based on the previous gradation data and gradation data for an image display period supplied in the step (i) based on the current gradation data.

4. A method for driving a liquid crystal display device which uses a liquid crystal as a pixel, said method comprising the steps of:

(i) generating (a) gradation data for an image display period which is to be supplied to the pixel of the liquid crystal display device and (b) gradation data for a blanking period which is to be supplied to the pixel and is indicative of a gradation not brighter than a gradation indicated by the gradation data for an image display period or of a gradation for dark display, the generating being repeatedly performed based on gradation data supplied as gradation data to the pixel; and (ii) outputting in an order the gradation data (a) and (b) generated in a corresponding step (i), the step (ii) being performed to correspond to each of the steps (i), said method further comprising the step of, when a gradation transition from a gradation indicated by previous gradation data supplied to the pixel to a gradation indicated by current gradation data supplied to the pixel is a predetermined one, correcting gradation data for a blanking period supplied between gradation data for an image display period supplied in the step (i) based on the previous gradation data and gradation data for an image display period supplied in the step (i) based on the current gradation data, the correcting being performed based on the previous gradation data and the current gradation data.

5. A driving device for a liquid crystal display device which uses a liquid crystal as a pixel, the driving device (i) controlling, during each of repeated image display periods, luminance of the pixel of the liquid crystal display device by supplying to the pixel an output signal for an image display period which output signal varies depending on a video signal indicative of an image to be displayed, till a next image display period, by the liquid crystal display device, and (ii) controlling, during each blanking period between the image display periods, luminance of the pixel by supplying to the pixel an output signal for a blanking period, so that luminance of the pixel does not exceed luminance in at least one of the image display periods between which the blanking period exists or so that the luminance becomes a luminance for dark display, said device comprising blanking controlling means for, when a change from first luminance to second luminance is a predetermined one where the first and second luminances are luminances indicated by output signals for image display periods supplied during the image display periods before and after the blanking period, correcting the output signal for a blanking period so that the output signal for a blanking period has luminance which is corrected in a same direction as a direction of the change from the first luminance to the second luminance, the direction being a direction in which the luminance increases or decreases compared with an output signal for a blanking period obtained in a case where the first luminance is identical with the second luminance.

6. A driving device for a liquid crystal display device which uses a liquid crystal as a pixel, the driving device (i) controlling, during each of repeated image display periods, luminance of the pixel of the liquid crystal display device by supplying to the pixel an output signal for an image display period which output signal varies depending on a video signal indicative of an image to be displayed, till a next image display period, by the liquid crystal display device, and (ii) controlling, during each blanking period between the repeated image display periods, luminance of the pixel by supplying to the pixel an output signal for a blanking period, so that luminance of the pixel does not exceed luminance in at least one of the image display periods between which the blanking period exists or so that the luminance becomes a luminance for dark display, said device comprising blanking controlling means for, when a change from first luminance to second luminance is a predetermined one where the first and second luminances are luminances indicated by output signals for image display periods supplied during the image display periods between which the blanking period exists, correcting the output signal for a blanking period, based on the first luminance and the second luminance.

7. A driving device for a liquid crystal display device which uses a liquid crystal as a pixel, the driving device (i) generating (a) gradation data for an image display period which is to be supplied to the pixel of the liquid crystal display device and (b) gradation data for a blanking period which is to be supplied to the pixel and is indicative of a gradation not brighter than a gradation indicated by the gradation data for an image display period or of a gradation for dark display, the gradation data (a) and (b) being generated based on each of gradation data repeatedly supplied to the pixel, and (ii) outputting the gradation data (a) and (b) in an order, said device comprising blanking controlling means for, when a gradation transition from a gradation indicated by previous gradation data supplied to the pixel to a gradation indicated by current gradation data supplied to the pixel is a predetermined one, outputting gradation data indicative of a gradation which is corrected in a same direction as a direction of the gradation transition, the direction being a direction in which the gradation increases or decreases compared with gradation data for a blanking period obtained in a case where a gradation indicated by the previous gradation data and a gradation indicated by the current gradation data are identical with each other, the gradation data thus outputted being regarded as gradation data for a blanking period to be supplied between gradation data for an image display period generated based on the previous gradation data and gradation data for an image display period generated based on the current gradation data.

8. A driving device for a liquid crystal display device which uses a liquid crystal as a pixel, the driving device (i) generating (a) gradation data for an image display period which is to be supplied to the pixel of the liquid crystal display device and (b) gradation data for a blanking period which is to be supplied to the pixel and is indicative of a gradation not brighter than a gradation indicated by the gradation data for an image display period or of a gradation for dark display, the gradation data (a) and (b) being generated based on each of gradation data repeatedly supplied to the pixel, and (ii) outputting the gradation data (a) and (b) in an order, said device comprising blanking controlling means for, when a gradation transition from a gradation indicated by previous gradation data supplied to the pixel to a gradation indicated by current gradation data supplied to the pixel is a predetermined one, correcting gradation data for a blanking period supplied between gradation data for an image display period generated based on the previous gradation data and gradation data for an image display period generated based on the current gradation data, the gradation data for a blanking period being corrected based on the previous gradation data and the current gradation data.

9. The driving device as set forth in claim 7 or 8, wherein the blanking controlling means includes storage means for storing data indicative of the gradation data for a blanking period corresponding to a combination of the previous gradation data and the current gradation data, and the blanking controlling means corrects the gradation data for a blanking period based on the data.

10. The driving device as set forth in claim 9, wherein the blanking controlling means further includes calculating means for, when only data indicative of the gradation data for a blanking period corresponding to a combination of the previous gradation data and the current gradation data is stored in the storage means, calculating, by interpolating the data, the gradation data for a blanking period corresponding to a combination other than the combination.

11. The driving device as set forth in any one of claims 5 to 8, wherein the predetermined change or the predetermined gradation transition indicates an increase in luminance of the pixel, and when an increase in luminance is indicated, the blanking controlling means corrects the output signal or the gradation data for a blanking period so that luminance of the pixel increases during the blanking period.

12. The driving device as set forth in claim 7 or 8, further comprising generating means for generating, as the gradation data for an image display period, gradation data identical with supplied gradation data.

13. The driving device as set forth any one of claims 5 to 8, wherein: when a change or a gradation transition is not the predetermined one, the blanking controlling means controls an output signal for a blanking period or gradation data for a blanking period so that the output signal or the gradation data has a value.

14. The driving device as set forth in claim 7 or 8, wherein the supplied gradation data is indicative of one of 256 gradations, and when a gradation transition is not the predetermined one, the blanking controlling means controls the gradation data for a blanking period so that the gradation data has a value of more than 0-gradation and not more than 32-gradation.

15. The driving device as set forth in claim 5, 6, 7, or 8, wherein: when a change or a gradation transition is not the predetermined one, the blanking controlling means controls an output signal or gradation data for a blanking period so that the output signal or the gradation data varies in accordance with an output signal or gradation data for an image display period adjacent to the blanking period.

16. The driving device as set forth in claim 15, wherein the blanking controlling means includes:

judging means for judging whether the gradation data for an image display period is in a steady state or not;

generating means for a steady state, for generating the gradation data for a blanking period, the gradation data for a blanking period being generated when the gradation data for an image display period is in a steady state;

blanking generating means for generating the gradation data for a blanking period, the gradation data for a blanking period being generated when the gradation data for an image display period changes; and output means for selecting and outputting one of an output of the generating means for a steady state and an output of the blanking generating means, based on a result of judgment performed by the judging means.

17. The driving device as set forth in claim 7 or 8, wherein video data indicative of a gradation displayed by a the pixel is supplied to the driving device as video data to the pixel, and when a gradation transition is not the predetermined one, the blanking controlling means controls the gradation data for a blanking period so that the gradation data is a multiplication of the gradation indicated by the video data and a constant value.

18. The driving device as set forth in claim 17, wherein the multiplication of the gradation indicated by the video data and the constant value is ½ or less of the gradation indicated by the video data.

19. The driving device as set forth in claim 7 or 8, wherein at least a part of the predetermined gradation transition indicates a decrease in luminance of the pixel, and said device further comprising gradation converting means for converting the supplied gradation data so that the gradation data includes only a gradation brighter than a predetermined gradation.

20. The driving device as set forth in claim 19, wherein the gradation converting means converts the supplied gradation data so that the gradation data has a deeper gradation depth and the gradation converting means outputs the gradation data thus converted, and the gradation converting means includes rounding means for adding noise information to the gradation data converted by the gradation converting means and then rounding the gradation data to which the noise information is added.

21. The driving device as set forth in claim 19, wherein the gradation converting means converts a gamma value of gamma characteristics of the supplied gradation data to a larger value.

22. A program causing a computer to function as each means as set forth in any one of claims 5 to 8.

23. A storage medium in which a program as set forth in claim 22 is stored.

24. A liquid crystal display device, comprising a driving device as set forth in any one of claims 5 to 8.

25. The liquid crystal display device as set forth in claim 24, said liquid crystal display device being a TV receiver.

26. The liquid crystal display device as set forth in claim 24, said liquid crystal display device being a liquid crystal monitor which displays a video signal.

27. The liquid crystal driving device as set forth in claim 20, wherein the gradation converting means converts a gamma value of gamma characteristics of the supplied gradation data to a larger value.

* * * * *